US006106195A

United States Patent [19]

Komatsu et al.

[11] Patent Number: 6,106,195

[45] Date of Patent: Aug. 22, 2000

[54] METHOD OF FORMATION OF TIDAL RESIDUAL CURRENT IN WATER AREA

[75] Inventors: Toshimitsu Komatsu; Shinichiro Yano, both of Fukuoka, Japan

[73] Assignee: Toeishokou Kabushiki Kaisha, Fukuoka, Japan

[21] Appl. No.: 09/011,592

[22] PCT Filed: May 17, 1997

[86] PCT No.: PCT/JP97/01683

§ 371 Date: Jan. 16, 1998

§ 102(e) Date: Jan. 16, 1998

[87] PCT Pub. No.: WO97/44531

PCT Pub. Date: Nov. 27, 1997

[30] Foreign Application Priority Data

May 20, 1996 [JP] Japan ..... 8-124735

[51] Int. Cl.[7] ..... E02B 3/06

[52] U.S. Cl. ..... 405/25; 405/15; 405/21

[58] Field of Search ..... 405/15, 16, 21, 405/25, 31; 244/200; 119/221; 114/67 R

[56] References Cited

U.S. PATENT DOCUMENTS

| | | | |
|---|---|---|---|
| 4,560,304 | 12/1985 | Jenkins et al. | 405/15 X |
| 4,661,013 | 4/1987 | Jenkins | 405/15 X |
| 4,998,844 | 3/1991 | Mouton et al. | 405/21 |
| 5,215,406 | 6/1993 | Hudson | 405/21 X |
| 5,246,307 | 9/1993 | Rauch | 405/25 |
| 5,478,167 | 12/1995 | Oppenheimer et al. | 405/15 X |

FOREIGN PATENT DOCUMENTS

| | | | |
|---|---|---|---|
| 228336 | 5/1960 | Australia | 405/25 |
| 0151712 | 9/1982 | Japan | 405/25 |
| 8005158 | 4/1982 | Netherlands | 405/25 |

*Primary Examiner*—Dennis L. Taylor
*Attorney, Agent, or Firm*—Jordan and Hamburg LLP

[57] ABSTRACT

A plurality of bottom structure members for controlling a tidal oscillation flow are disposed on a bottom in a sea area, thereby creating a new tidal residual current.

6 Claims, 73 Drawing Sheets

CALCULATIONAL RESULT OF TIDAL CURRENT SIMULATION (MAXIMUM EBB TIDE)

CALCULATIONAL RESULT OF TIDAL CURRENT SIMULATION (MAXIMUM FLOOD TIDE)

CALCULATIONAL RESULT OF CONTAMINANT DISTRIBUTION

→=3.000e-03 (m/sec.)

CALCULATIONAL RESULT OF TIDAL CURRENT SIMULATION (TIDAL RESIDUAL CURRENT)

CALCULATIONAL RESULT OF CONTAMINANT DISTRIBUTION

→=3.000e-03 (m/sec.)

CALCULATIONAL RESULT OF TIDAL CURRENT SIMULATION (TIDAL RESIDUAL CURRENT)

CALCULATIONAL RESULT OF CONTAMINANT DISTRIBUTION

→=3.000e-03 (m/sec.)

CALCULATIONAL RESULT OF TIDAL CURRENT SIMULATION (TIDAL RESIDUAL CURRENT)

CALCULATIONAL RESULT OF CONTAMINANT DISTRIBUTION AFTER 100 CYCLES (HIGH TIDE)

CALCULATIONAL RESULT OF CONTAMINANT DISTRIBUTION AFTER 50 CYCLES (HIGH TIDE)

CALCULATIONAL RESULT OF CONTAMINANT DISTRIBUTION AFTER 200 CYCLES (HIGH TIDE)

CALCULATIONAL RESULT OF CONTAMINANT DISTRIBUTION AFTER 150 CYCLES (HIGH TIDE)

CALCULATIONAL RESULT OF CONTAMINANT DISTRIBUTION AFTER 50 CYCLES (HIGH TIDE)

CALCULATIONAL RESULT OF CONTAMINANT DISTRIBUTION AFTER 100 CYCLES (HIGH TIDE)

CALCULATIONAL RESULT OF CONTAMINANT DISTRIBUTION AFTER 150 CYCLES (HIGH TIDE)

CALCULATIONAL RESULT OF CONTAMINANT DISTRIBUTION AFTER 200 CYCLES (HIGH TIDE)

CALCULATIONAL RESULT OF CONTAMINANT DISTRIBUTION AFTER 50 CYCLES(HIGH TIDE)

CALCULATIONAL RESULT OF CONTAMINANT DISTRIBUTION AFTER 100 CYCLES(HIGH TIDE)

CALCULATIONALY RESULT OF CONTAMINANT DISTRIBUTION AFTER 150 CYCLES(HIGH TIDE)

CALCULATIONALY RESULT OF CONTAMINANT DISTRIBUTION AFTER 200 CYCLES(HIGH TIDE)

TIME-SERIES OF REMAINING RATE OF CONTAMINANT IN THE WHOLE BAY

CALCULATIONAL RESULT OF TIDAL CURRENT SIMULATION (MAXIMUM EBB TIDE)

CALCULATIONAL RESULT OF TIDAL CURRENT SIMULATION (MAXIMUM FLOOD TIDE)

CALCULATIONAL RESULT OF CONTAMINANT DISTRIBUTION

→=3.000e-03 (m/sec.)

CALCULATIONAL RESULT OF TIDAL CURRENT SIMULATION (TIDAL RESIDUAL CURRENT)

CALCULATIONAL RESULT OF CONTAMINANT DISTRIBUTION

→=2.000e-02 (m/sec.)

CALCULATIONAL RESULT OF TIDAL CURRENT SIMULATION (TIDAL RESIDUAL CURRENT)

CALCULATIONAL RESULT OF CONTAMINANT DISTRIBUTION AFTER 50 CYCLES (HIGH TIDE)

CALCULATIONAL RESULT OF CONTAMINANT DISTRIBUTION AFTER 100 CYCLES (HIGH TIDE)

CALCULATIONAL RESULT OF CONTAMINANT DISTRIBUTION AFTER 200 CYCLES (HIGH TIDE)

CALCULATIONAL RESULT OF CONTAMINANT DISTRIBUTION AFTER 150 CYCLES (HIGH TIDE)

CALCULATIONAL RESULT OF CONTAMINANT DISTRIBUTION AFTER 50 CYCLES (HIGH TIDE)

CALCULATIONAL RESULT OF CONTAMINANT DISTRIBUTION AFTER 100 CYCLES (HIGH TIDE)

CALCULATIONAL RESULT OF CONTAMINANT DISTRIBUTION AFTER 200 CYCLES (HIGH TIDE)

CALCULATIONAL RESULT OF CONTAMINANT DISTRIBUTION AFTER 150 CYCLES (HIGH TIDE)

TIME-SERIES OF REMAINING RATE OF CONTAMINANT IN THE WHOLE BAY

TIME-SERIES OF REMAINING RATE OF CONTAMINANT IN THE BAY

CASE-2

STREAM LINE
OF TIDAL RESIDUAL CURRENT (a) WHEN $V_{max}$ IS ATTAINED (b) WHEN $V_{res}$ IS OCCURED
(MAXIMUM EBB TIDE AFTER 1CYCLE)

(a) WHEN $V_{max}$ IS ATTAINED (b) WHEN $V_{res}$ IS OCCURED
(MAXIMUM EBB TIDE AFTER 1CYCLE)

(a) WHEN $V_{max}$ IS ATTAINED (b) WHEN $V_{res}$ IS OCCURED
(MAXIMUM EBB TIDE AFTER 1CYCLE)

(a) WHEN $V_{max}$ IS ATTAINED (b) WHEN $V_{res}$ IS OCCURED
(MAXIMUM EBB TIDE AFTER 1CYCLE)

(a) WHEN $V_{max}$ IS ATTAINED (b) WHEN $V_{res}$ IS OCCURED
(MAXIMUM EBB TIDE AFTER 1CYCLE)

(a) AFTER 15 CYCLES (b) AFTER 60 CYCLES (a) AFTER 15 CYCLES (b) AFTER 60 CYCLES (a) AFTER 15 CYCLES (b) AFTER 60 CYCLES (a) AFTER 15 CYCLES (b) AFTER 60 CYCLES (a) AFTER 15 CYCLES (b) AFTER 60 CYCLES

○ h/k=4 ◆ h/k=5 ⊞ h/k=6

METHOD OF FORMATION OF TIDAL RESIDUAL CURRENT IN WATER AREA

TECHNICAL FIELD

The present invention relates to a method for the formation of a tidal residual current in a water area and, more particularly, to a method for the formation of a new tidal residual current by controlling tidal oscillation flow in a water area or the like of a bay, port or the like or around an island.

BACKGROUND TECHNOLOGY

Heretofore, in a water area or the like of a bay, port or the like or around an island, a closed sea area is formed where new sea water no longer or little has been exchanged for old sea water. When contaminated or polluted water flows in such a closed water area from river or drainage or the like, such water remains still in the closed water area, thereby worsening a water quality in the closed sea area as time lapses.

There have been developed various methods for cleaning contaminated or polluted water, for example, as disclosed in Japanese Patent Unexamined Publication No. 6-146,249.

The method for cleaning the water quality of such contaminated or polluted water involves forming a flow path in the closed sea area by mounting both side walls with a plurality of artificial roughness formed at intervals extending in a flow direction and allowing the artificial roughness to create a tidal current flowin one direction within the closed sea area, thereby causing the polluted water flown in the closed sea area to outflow outside the closed sea area and cleaning the water within the closed sea area.

The above-mentioned water quality cleaning method still suffers from the defects as follows:

(1) Where the flow path of the closed sea area is wide, the artificial roughness formed on the side walls thereof can create no tidal oscillation flow.

(2) A mean flow of the tidal oscillation current formed is a one-way flow extending in the flow path of the closed sea area, however, the flow direction cannot be controlled freely in an optional direction.

(3) A mean flow of the one-way tidal oscillation flow formed in the flow path of the closed sea area is a two-dimensional change, not a three-dimensional change that can, for example, prevent the formation of a stratifying phenomenon in which a light surface layer having higher temperature and a heavy deep layer having lower temperature (a layer in a non-oxygen state or a poor-oxygen state) are formed, or destroying the layer.

DISCLOSURE OF INVENTION

The present invention relates to a method for the formation of a tidal residual current in a water area, characterized in that a plurality of bottom structure members for controlling the tidal oscillation flow are disposed on the bottom of the closed sea area to create a tidal residual current.

The present invention further relates to a method for the formation of a tidal residual current in a water area, characterized in that the bottom structure member is provided with an appropriate extent of roughness; a bottom structure member has a difference in directional roughness caused to arise between roughness on a forward direction side with respect to a tidal oscillation flow in a forward direction and roughness on a rearward direction side with respect to a tidal oscillation flow in a rearward direction; a bottom structure member has a surface arranged so as to provide the tidal oscillation flow with a momentum in a predetermined direction to allow the surface to act as a momentum-adding surface; the bottom structure members each having the difference in directional roughness are disposed on a bottom of the water area in the flow direction of the tidal oscillation flow and the bottom structure members each having the momentum-adding surface are disposed on the bottom thereof in a direction intersecting with the flow direction of the tidal oscillation flow, thereby creating a new tidal residual current having a curved flow pattern; and the bottom structure members are provided with the function of gathering fish and the function of providing fish with nests.

BRIEF DESCRIPTION OF THE DRAWINGS

FIG. 45 is a view showing a calculational result of a tidal current simulation (tidal residual current).

FIG. 121 is a view showing a calculational result of a particle-tracking simulation in accordance with model case (3) of the present invention (when Vmax is attained).

FIG. 122 is a view showing a calculational result of a particle-tracking simulation in accordance with model case (3) of the present invention (when Vres occurred in a maximum ebb tide after 1 cycle).

FIG. 123 is a view showing a calculational result of a particle-tracking simulation in accordance with model case (4) of the present invention (when Vmax is attained).

FIG. 124 is a view showing a calculational result of a particle-tracking simulation in accordance with model case (4) of the present invention (when Vres occurred in a maximum ebb tide after 1 cycle).

FIG. 125 is a view showing a calculational result of a particle-tracking simulation in accordance with model case (0) of the present invention (after 15 cycles).

FIG. 126 is a view showing a calculational result of a particle-tracking simulation in accordance with model case (0) of the present invention (after 60 cycles).

FIG. 127 is a view showing a calculational result of a particle-tracking simulation in accordance with model case (1) of the present invention (after 15 cycles).

FIG. 128 is a view showing a calculational result of a particle-tracking simulation in accordance with model case (1) of the present invention (after 60 cycles).

FIG. 129 is a view showing a calculational result of a particle-tracking simulation in accordance with model case (2) of the present invention (after 15 cycles).

FIG. 130 is a view showing a calculational result of a particle-tracking simulation in accordance with model case (2) of the present invention (after 60 cycles).

FIG. 131 is a view showing a calculational result of a particle-tracking simulation in accordance with model case (3) of the present invention (after 15 cycles).

FIG. 132 is a view showing a calculational result of a particle-tracking simulation in accordance with model case (3) of the present invention (after 60 cycles).

Figure 133:
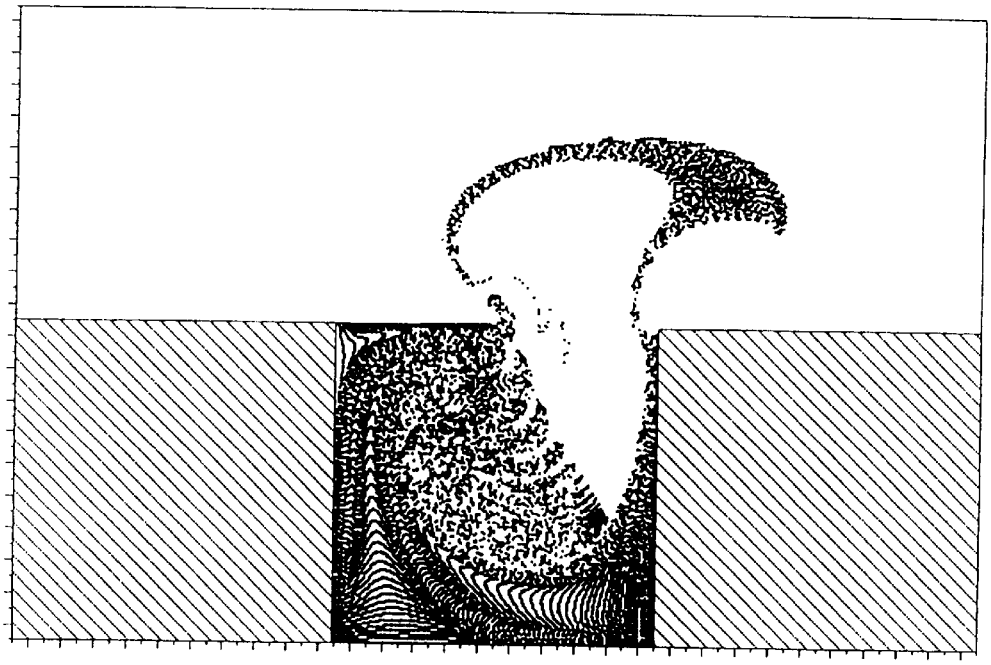

FIG. 133 is a view showing a calculational result of a particle-tracking simulation in accordance with model case (4) of the present invention (after 15 cycles).

Figure 134:
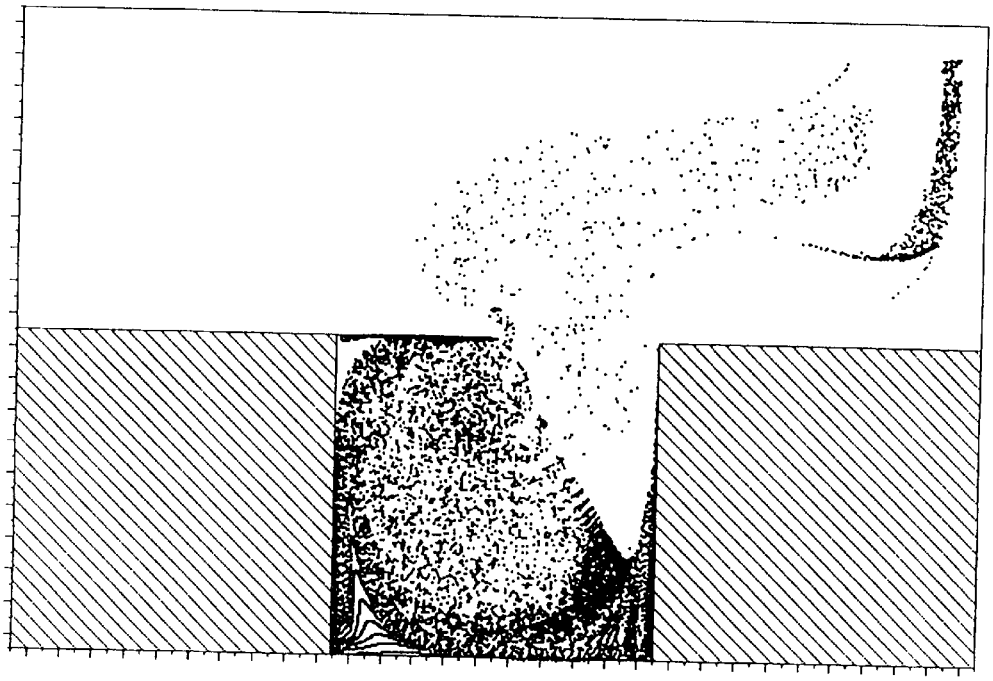

FIG. 134 is a view showing a calculational result of a particle-tracking simulation in accordance with model case (4) of the present invention (after 60 cycles).

Figure 135:
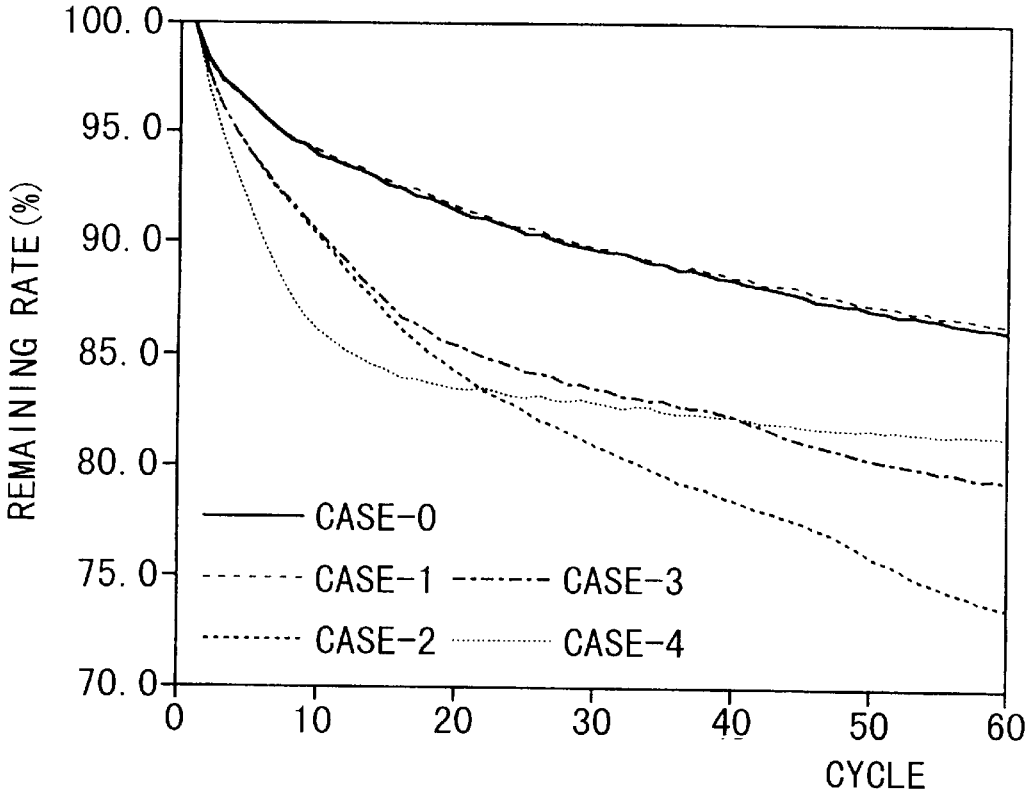

FIG. 135 is a graph showing a time series of a remaining rate of contaminants in the whole bay.

Figure 136:
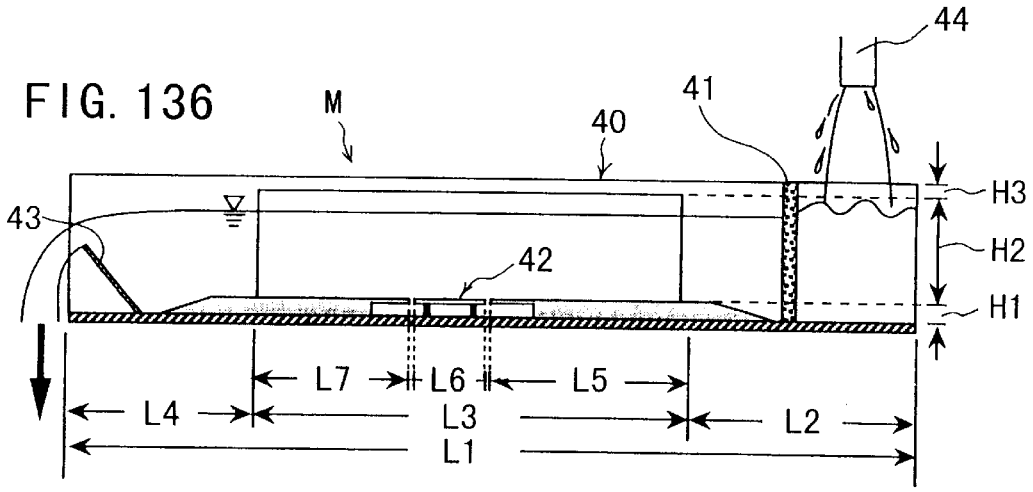

FIG. 136 is a side view showing an experimental apparatus.

Figure 137:
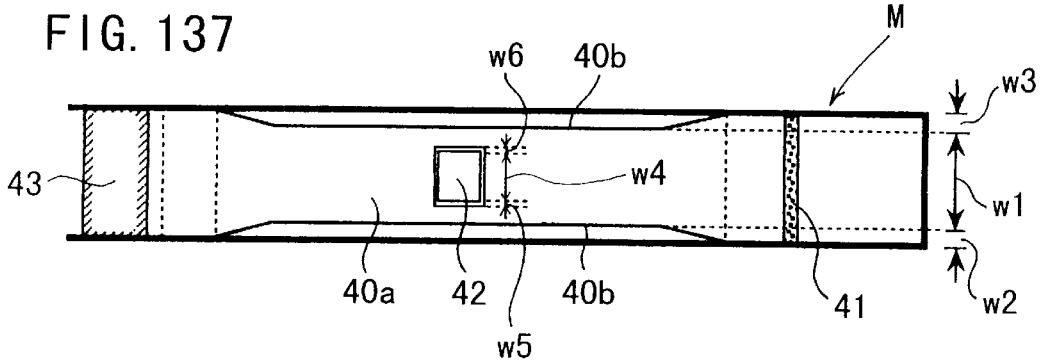

FIG. 137 is a plan view showing the experimental apparatus.

Figure 138:
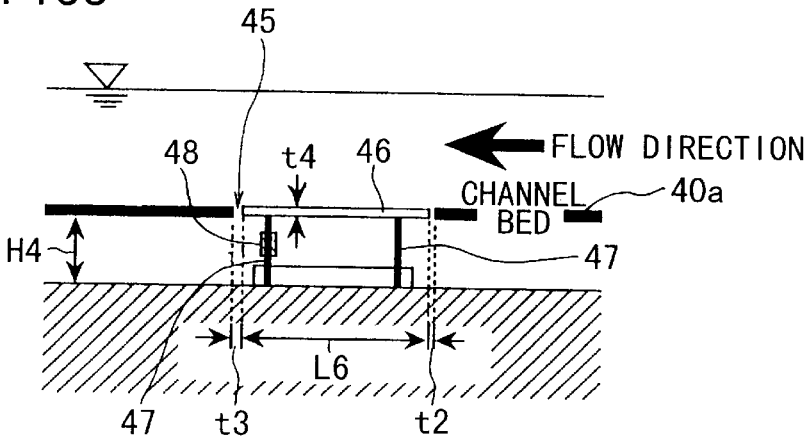

FIG. 138 is an enlarged side view showing a stress measuring device.

Figure 139:
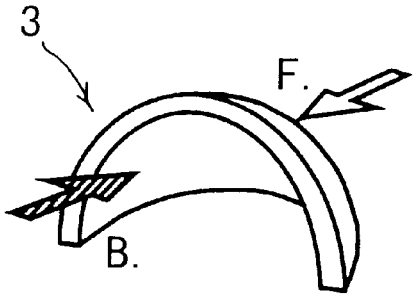

FIG. 139 is a perspective view showing a bottom structure member in a quarterly-cut spherical shape.

Figure 140:
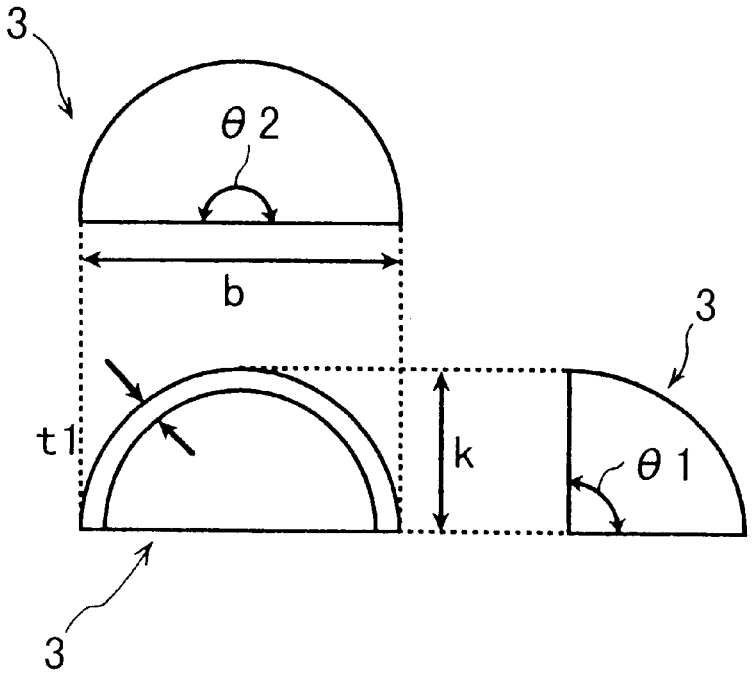

FIG. 140 is a view describing the bottom structure member of FIG. 139.

Figure 141:
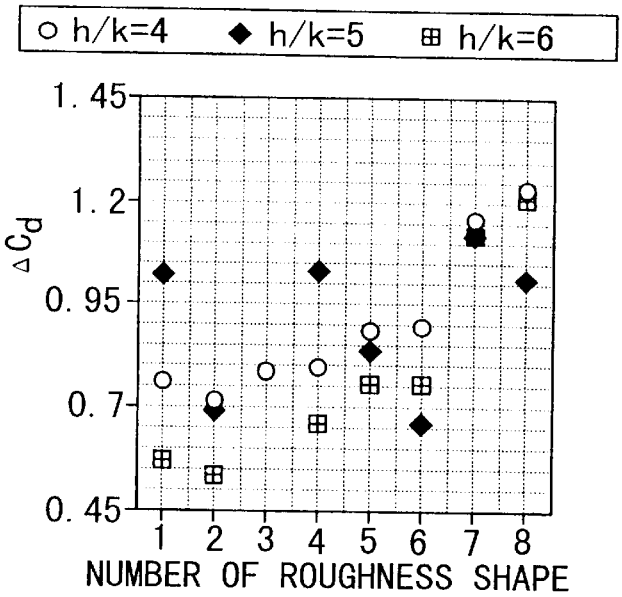

FIG. 141 is a graph showing a comparison of a difference in stress coefficients under condition 1.

Figure 142:
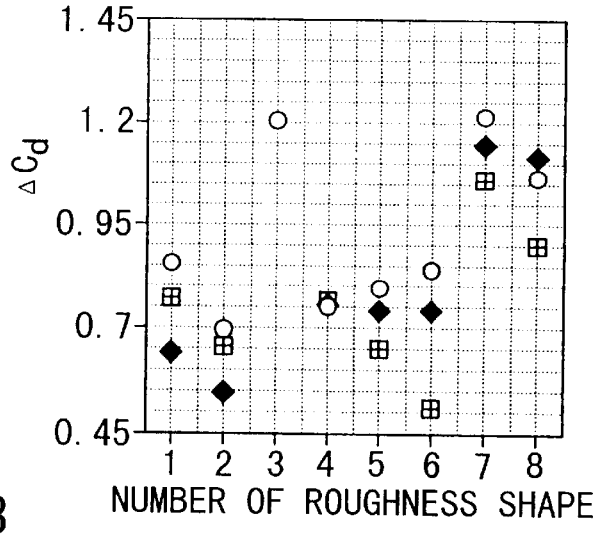

FIG. 142 is a graph showing a comparison of a difference in stress coefficients under condition 2.

Figure 143:
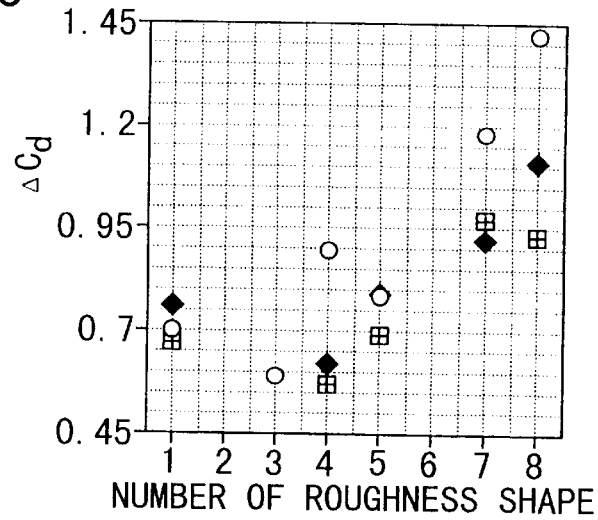

FIG. 143 is a graph showing a comparison of a difference in stress coefficients under condition 3.

Figure 144:
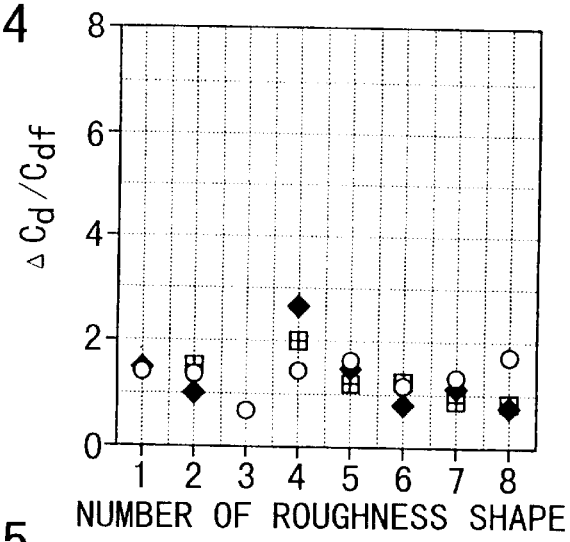

FIG. 144 is a graph showing a comparison of efficiency under condition 1.

Figure 145:
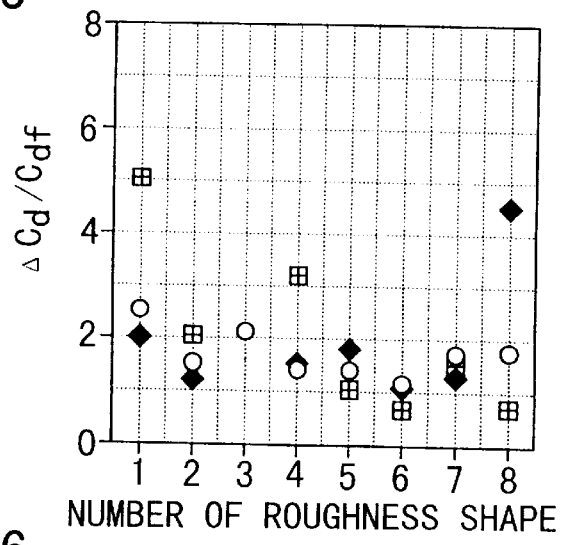

FIG. 145 is a graph showing a comparison of efficiency under condition 2.

Figure 146:
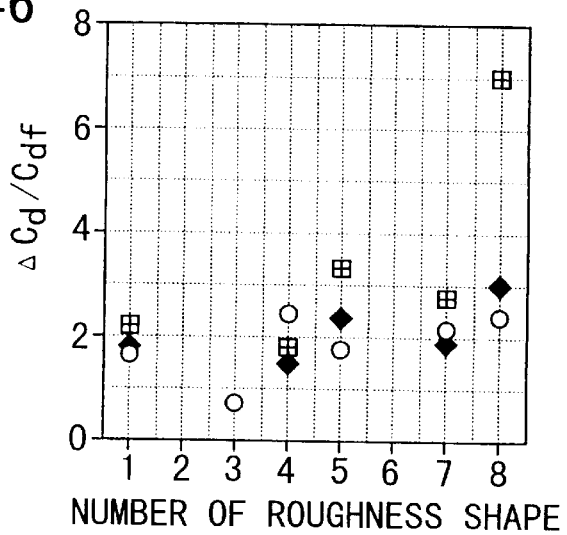

FIG. 146 is a graph showing a comparison of efficiency under condition 3.

BEST MODES FOR CARRYING OUT THE INVENTION

Figure 1:
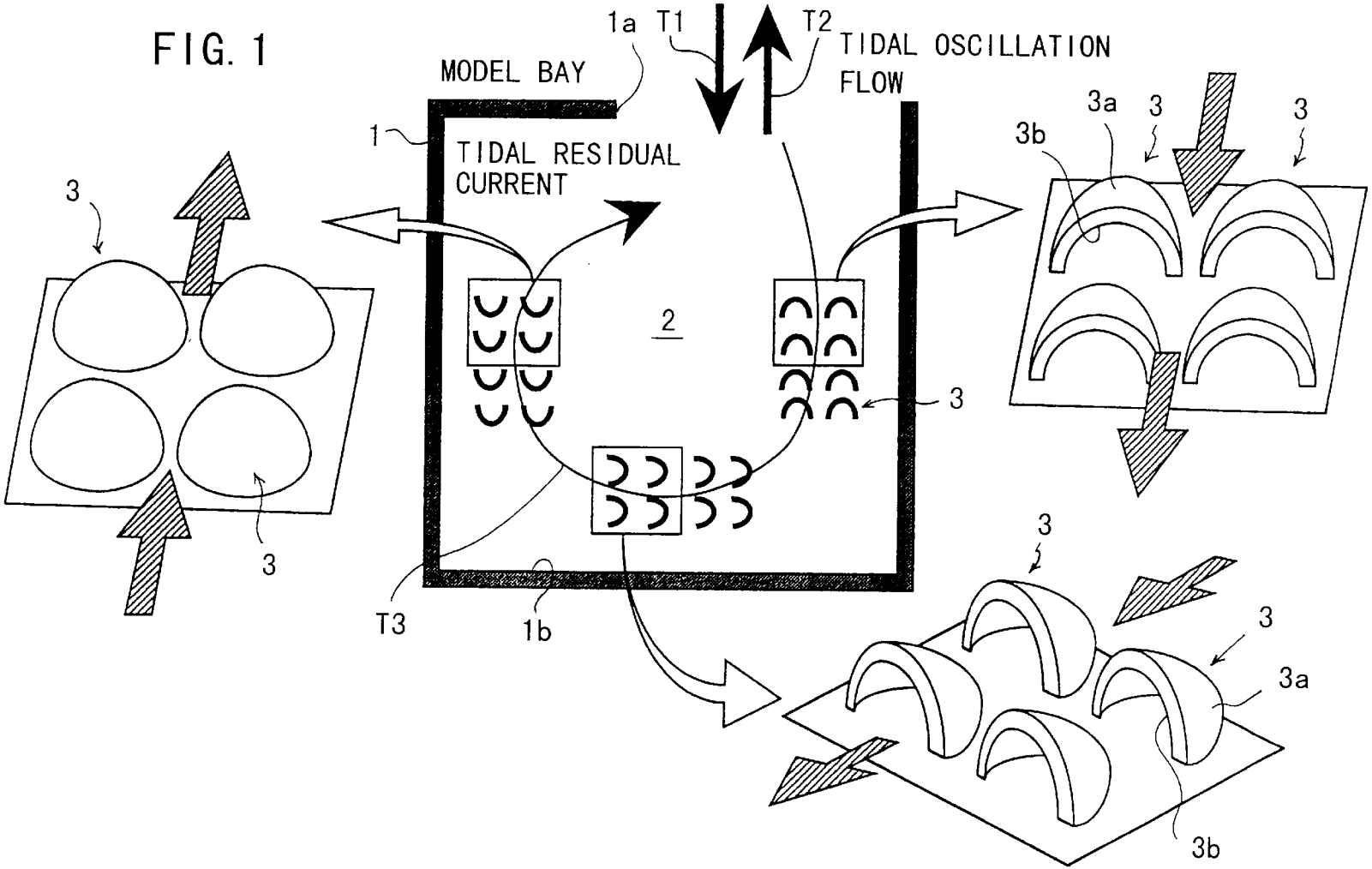
FIG. 1 is a view for describing the concept of a method for the formation of a tidal residual current in accordance with the present invention.

The embodiments of the present invention will be described more in detail with reference to the accompanying drawings. As shown in FIG. 1, a model bay 1 is formed in a rectangular shape as a closed water area is with a plurality of bottom structure members 3 for controlling tidal oscillation flow disposed on a bottom 2 thereof.

Figure 2:
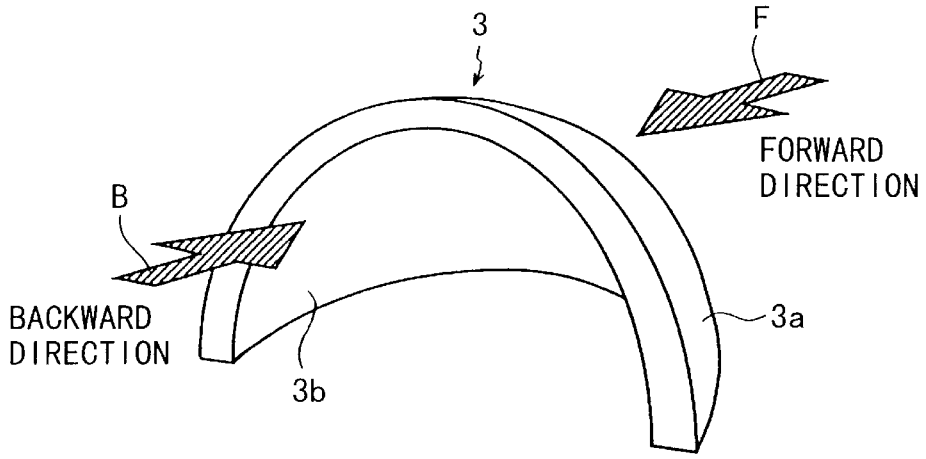
FIG. 2 is a perspective view showing a bottom structure member for use in the formation of a tidal residual current in accordance with the present invention.

As shown in FIG. 2, the bottom structure member 3 comprises a quarterly-cut spherical section 3*a* and an open section 3*b* with its front side open and concave toward the rear side of the quarterly-cut spherical section 3*a*. When a tidal oscillation flow strikes the quarterly-cut spherical section 3*a*, i.e. when roughness on the forward current side is provided for a forward current, and a tidal oscillation flow strikes the open section 3*b*, i.e. when roughness on the backward current side is provided for a backward current, a difference in directional roughness can be caused to occur between the roughness on the forward current side and the roughness on the backward current side by making the roughness on the backward current side greater than the roughness onthe forward current side. In the drawing, reference symbol F denotes a direction of a forward current and B denotes a direction of a backward current.

The bottom structure members 3 are disposed on the bottom surface 2 in the bay 1 as shown in FIG. 1 in a manner as described hereinafter.

In the water area on the right side of the model bay 1, the plural bottom structure members 3 are each disposed at a predetermined interval one by one from the bay entrance side 1*a* to the rear bay side 1*b* so as for the quarterly-cut spherical section 3*a* to be directed in a direction facing the flood tide of the tidal oscillation flow. In the rear bay area 1*b* of the model bay 1, the plural bottom structure members 3 are each disposed at a predetermined interval one by one from the right side to the left side so as for the quarterly-cut spherical section 3*a* to be directed toward the right side. Further, in the water area on the left side of the model bay 1, the plural bottom structure members 3 are each disposed at a predetermined interval one by one from the rear bay side 1*b* to the bay entrance side 1*a* so as for the quarterly-cut spherical section 3*a* to be directed in a direction facing the ebb tide of the tidal oscillation flow.

With the arrangement as described hereinabove, the water area on the right side of the model bay 1 is disposed with the bottom structure members 3 having the roughness on the backward current side for the ebb tide T2 flowing from the rear bay side 1*b* to the bay entrance side 1*a,* which is greater than the roughness on the forward current side thereof for the flood tide T1 flowing from the bay entrance side 1*a* to the rear bay side 1*b,* the flood tide becomes more likely to flow than the ebb tide in the water area on the right side when the tide oscillation movement is caused to occur. Likewise, the sea water becomes likely to flow toward the left side from the right side in the water area on the rear bay 1*b*. Further, likewise, the ebb tide becomes more likely to flow than the flood tide in the water area on the left side of the model bay 1. Eventually, the sea water outside the model bay 1 flows into the bay from the bay entrance 1*a,* thereby circulating the sea water within the bay in a clockwise direction and forming a circulating current flowing from the bay entrance 1*a* toward the outside of the bay as a tide residual current T3.

It is to be noted herein that the flow direction of the tide residual flow T3 can be designed with high freedom by appropriately setting the disposition of the bottom structure members 3 and the roughness thereof.

Further, it is possible to create one large circulating current by creating the tidal residual currents T3 among the plural circulating circuits formed in the model bay 1 and connecting the plural connecting currents to each other. On the other hand, plural circulating currents can be created from one circulating circuit by creating the tidal residual current T3 so as to intersect with one circulating circuit.

Figure 3:
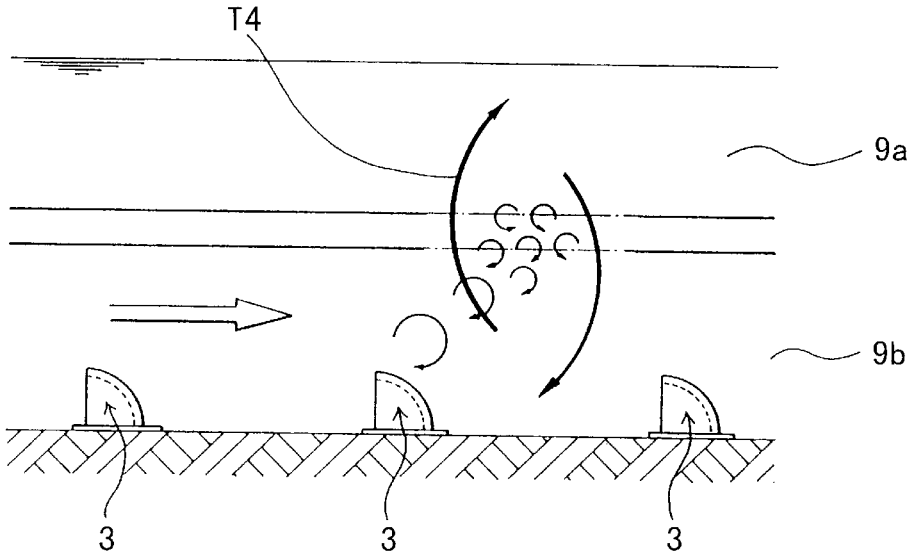
FIG. 3 is a view showing a mechanism for preventing the formation of a stationary layer by the bottom structure members in accordance with the present invention.

Moreover, in instances where sea water flows toward the opening sections 3*b* of the bottom structure members 3 as shown in FIG. 3, a rising current T4 is caused to occur so that a stratified water layer can be destroyed by the rising current T4 to control the formation of the stratified water layer in the water area, thereby enabling a supply of deep layer water rich in nutritious materials to a water layer 9*a* poor in nutritious materials, exisitng nearby the water surface, and at the same time enabling a supply of a surface layer water nearby the water surface, rich in soluble oxygen, to a deep layer 9*b* in a state in which no oxygen exists or oxygen is poor. This can serve as constructing a system for feeding plankton in a stable manner, providing a stable fish field and preserving an ocean environment.

Figure 4:
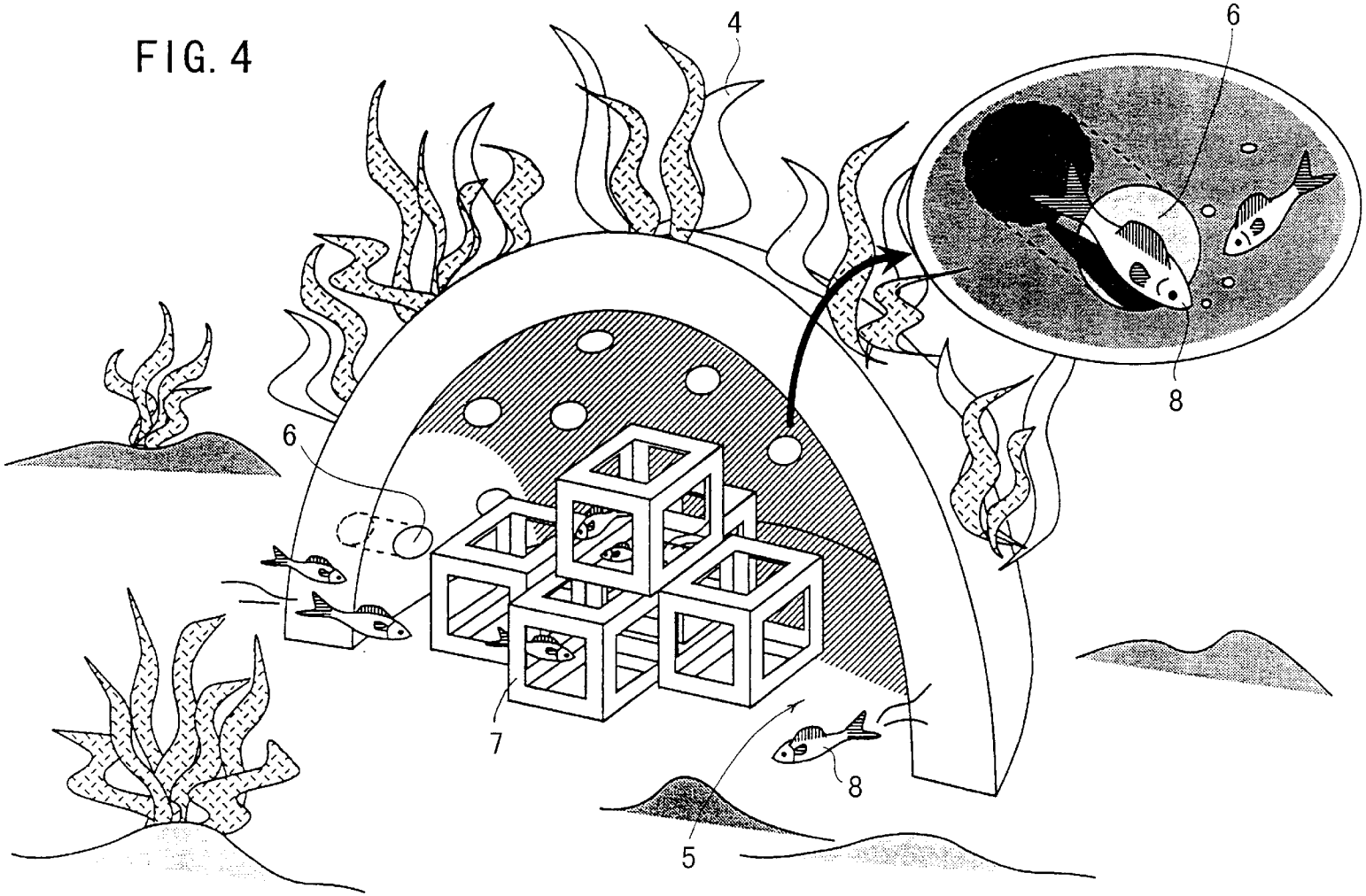
FIG. 4 is a view showing the use of the bottom structure members in accordance with the present invention.

As shown in FIG. 4, the quarterly-cut spherical section 3*a* of the bottom structure member 3 may be further formed of such a material or in such a shape that allows sea plant 4, such as seaweeds, to attach readily to its surfaces, thereby serving as raising a seaweed field.

As shown in FIG. 4, the bottom structure member 3 may be further provided in its inside with a space 5 so as for a fish shelf or a fish net to be disposed forming an artificial fish field within the bay 1. In the drawing, reference numeral 6 denotes a opening hole formed in the bottom structure member 3, reference numeral 7 a fish nest block, and reference numeral 8 denotes fish.

Then, a description will be made of the shape of the bottom structure member 3. The shape of the bottom structure member 3 is basically preferred such that there is formed a difference in directional roughness between the roughness on the forward current side and the roughness on the backward current side and further that the difference in directional roughness is greater.

In designing a flow direction, a desired design of the flow direction can be made by combining the bottom structure member 3 having a difference in directional roughness with a bottom structure member having roughness yet no difference in directional roughness or by combining the bottom structure members 3 having different magnitudes of differences in directional roughness or other properties.

FIGS. 5–25 show examples of variants of the basic shape or structure of the bottom structure members 3 as described herein-above.

Figure 5:
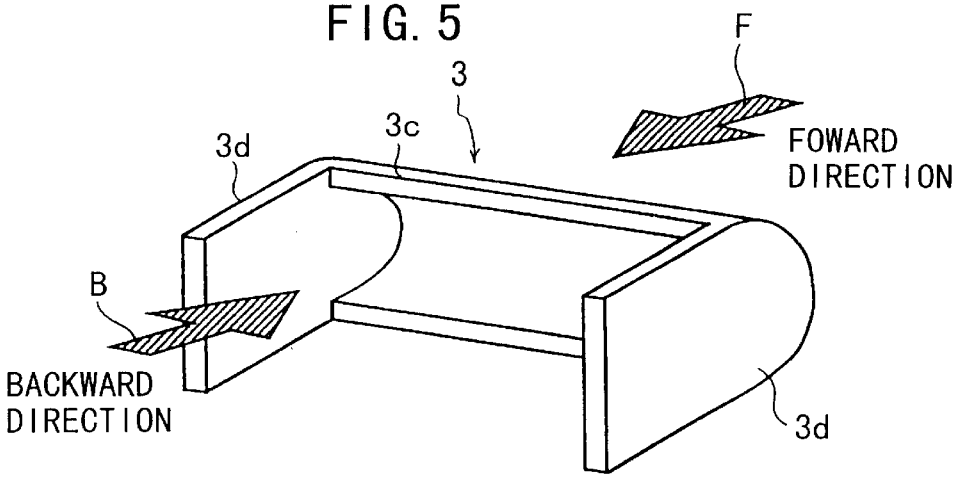
FIG. 5 is a perspective view showing a first variant of the bottom structure member in accordance with the present invention.

FIG. 5 shows the bottom structure member 3 as the first variant, which is of a generally square-C shaped form, when looked on a plane, and which comprises a half-cut cylindrical member 3*c* with an elongated half portion cut away from the cylindrical body, extending to the left and right in a widthwise direction, and a pair of plate members 3*d* and 3*d*, each extending toward the side opposite to the side on which the half-cut cylindrical member 3*c* projects in an arc-shaped form from the both end sides of the half-cut cylindrical member 3*c*.

With this arrangement, the bottom structure member 3 is so disposed as to allow the flow striking the arc-shaped and convex surface of the half-cut cylindrical member 3*c* to create a forward current, thereby forming a great difference in directional roughness.

Figure 6:
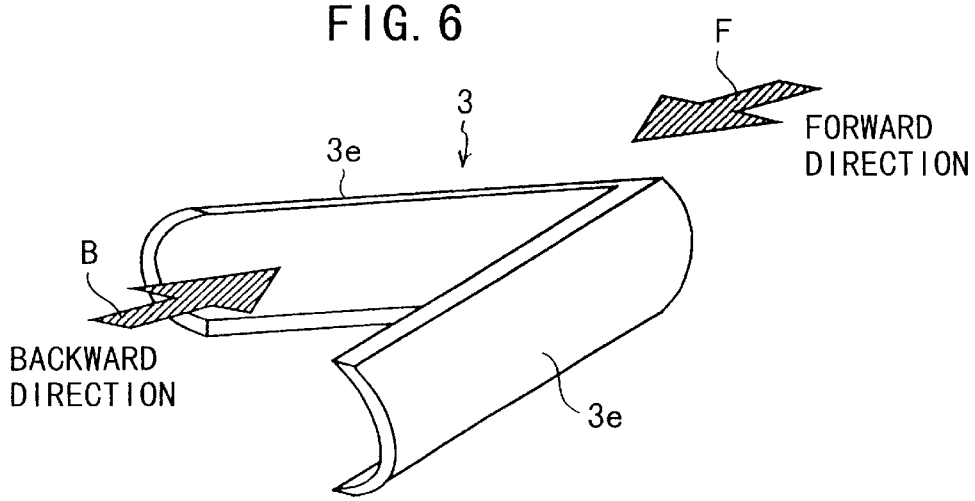
FIG. 6 is a perspective view showing a second variant of the bottom structure member in accordance with the present invention.

In the second variant as shown in FIG. 6, the bottom structure member 3 is configured in that a pair of half-cut cylindrical members 3*e* and 3*e*, each with a half cylindrical portion cut out from the cylindrical body, are disposed with their arc-shaped and convex surfaces directed toward the outside and with their top edge portions connected to each other, thereby forming a V-shaped configuration when looked on a plane.

The such bottom structure members 3 can convert the flow striking the projecting sides of the sectionally V-shaped configuration into a forward current, thereby enabling the formation of a great difference in directional roughness.

Figure 7:
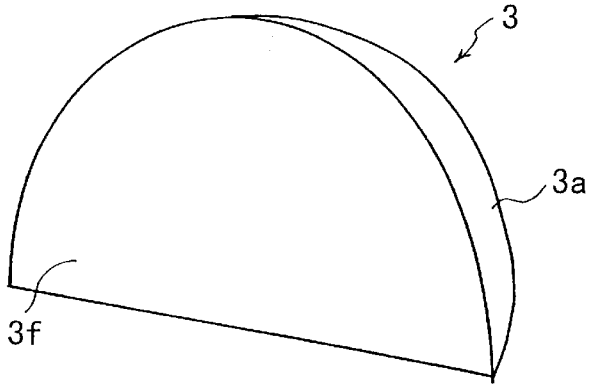
FIG. 7 is a perspective view showing a third variant of the bottom structure member in accordance with the present invention.

In the third variant as shown in FIG. 7, the bottom structure member 3 comprises a quarterly-cut spherical section 3*a* with the three quarters of the spherical body cut out therefrom, and a rear wall surface section 3*f* formed on the rear side of the quarterly-cut spherical section 3*a* and extending generally perpendicularly.

The such bottom structure member 3 can convert the flow striking the spherical section 3*a* into a forward current and the flow striking the generally perpendicularly extending rear wall surface section 3*f* into a backward current, thereby providing a great difference in directional roughness.

Moreover, the generally perpendicularly extending rear wall surface section 3*f* is so disposed as to cause the flow to rise along the wall surface section 3*f* upon striking the wall surface section 3*f*, thereby creating a rising flow in a smooth manner.

Figure 8:
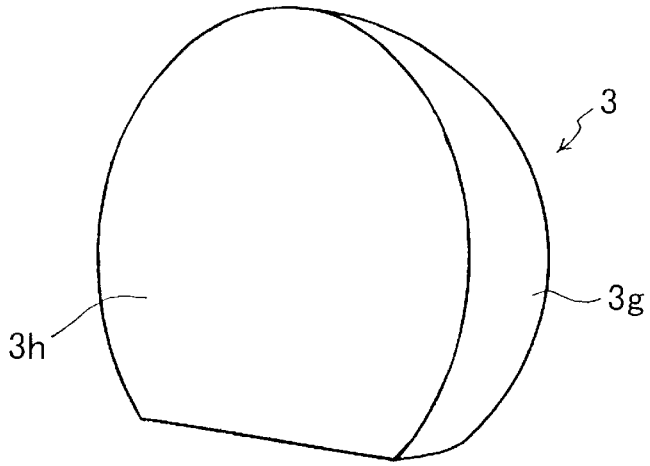
FIG. 8 is a perspective view showing a fourth variant of the bottom structure member in accordance with the present invention.

The bottom structure member 3 as the fourth variant as shown in FIG. 8 comprises a spherical section 3*g* in a transformed half-cut spherical shape and a wall surface section 3*h* disposed on the back surface side of the spherical section 3*g* and extending generally perpendicularly.

The such bottom structure member 3 can make the radius of curvature of each of the spherical sections 3*a* and 3*g* equal to that of the bottom structure member 3 of FIG. 7 and the height thereof to be higher than that of the bottom structure member 3 thereof, when used in substantially the same manner as the bottom structure member 3 of FIG. 7, thereby making the roughness greater and allowing the arising current to occur readily.

Figure 9:
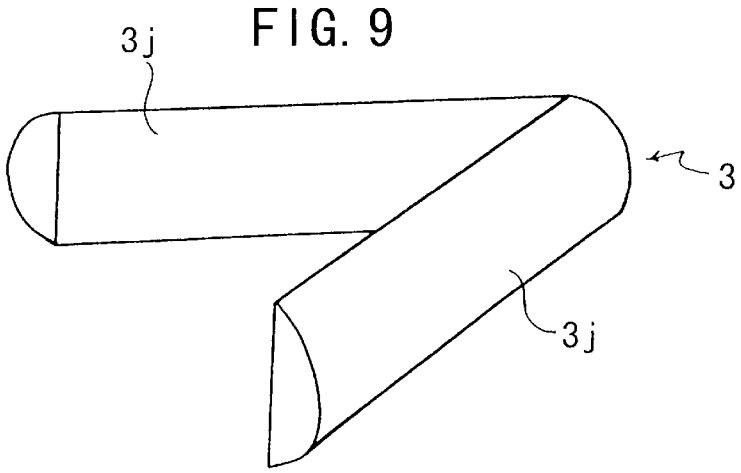
FIG. 9 is a perspective view showing a fifth variant of the bottom structure member in accordance with the present invention.

In the fifth variant as shown in FIG. 9, the bottom structure member 3 has a pair of half-cut columnar members 3*j* and 3*j* disposed with their arc-shaped and convex surface sections directed toward the outside and with their generally perpendicularly extending wall surface sections toward the inside, thereby connecting their top ends thereof to each other and forming a V-shaped configuration when looked on a plane.

The bottom structure member 3 in this fifth variant can provide a great difference in directional roughness and allows the sea water flowing in a backward direction to rise along the wall surface, when used in substantially the same manner as the bottom structure member 3 of FIG. 6, thereby forming a rising flow in a smooth way.

Figure 10:
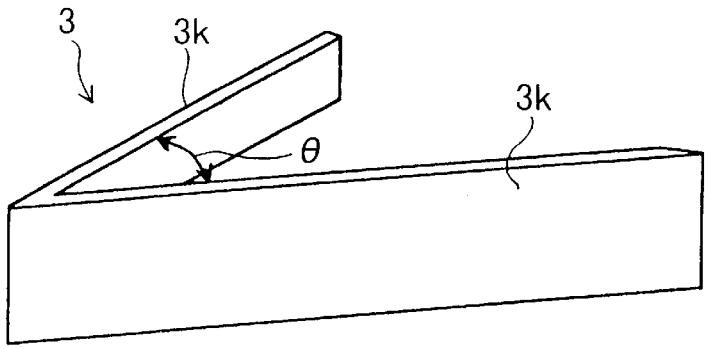
FIG. 10 is a perspective view showing a sixth variant of the bottom structure member in accordance with the present invention.

In the sixth variant as shown in FIG. 10, the bottom structure member 3 has a pair of plate members 3*k* and 3*k*, each of a rectangular shape having an elongated width extending in forward and backward directions, and their top ends are connected to each other, thereby forming a generally V-shaped configuration when looked on a plane.

The bottom structure member 3 in this sixth variant can make the difference in directional roughness smaller than that of the bottom structure member 3 of FIG. 9 above, when used in substantially the same manner as the bottom structure member 3 of FIG. 9 above, thereby enabling the formation of a rising current in a smooth way.

The bottom structure members 3, 3 and 3 of a generally V-shaped configuration in planar section, as shown in FIGS. 6, 9 and 10, respectively, can appropriately adjust a degree of roughness and a difference in directional roughness by setting an inner angle θ, at which to form each of the V-shapes thereof, to become optionally an acute angle.

Figure 11:
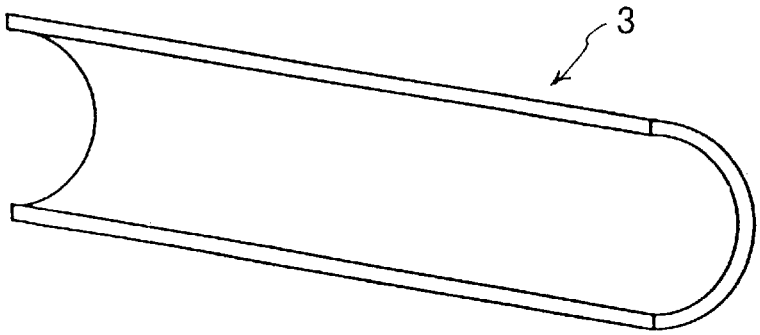
FIG. 11 is a perspective view showing a seventh variant of the bottom structure member in accordance with the present invention.

In the seventh variant as shown in FIG. 11, the bottom structure member 3 is of a simplified half-cut cylindrical shape with an elongated half portion cut away from the wholy cylindrical body.

The bottom structure member 3 in the seventh variant allows the flow striking the arc-shaped and convex surface thereof to form a forward current, thereby enabling the formation of a great difference in directional roughness.

Figure 12:
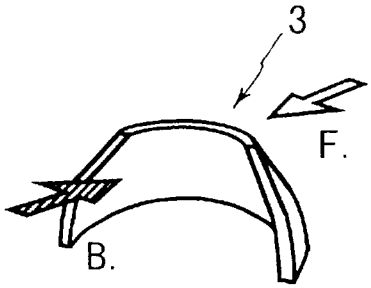
FIG. 12 is a perspective view showing an eighth variant of the bottom structure member in accordance with the present invention.
Figure 13:
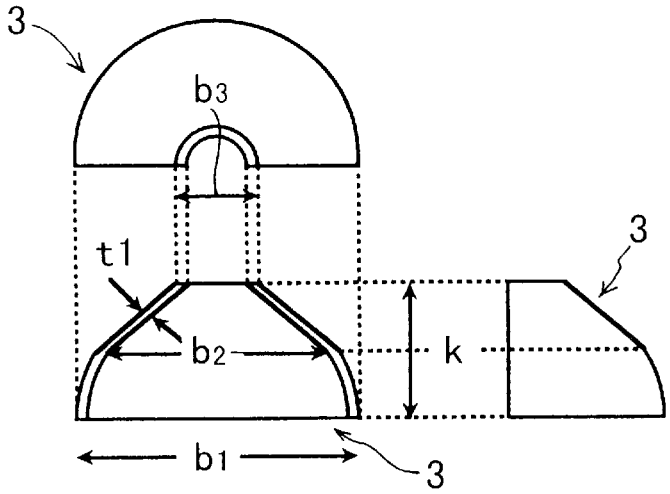
FIG. 13 is a view for describing the eighth variant thereof.

In the eighth variant as shown in FIGS. 12 and 13, the bottom structure member 3 is of such a shape that a half-cut cylinder-shaped member with its longitudinally elongated half portion cut out, which is gradually converged from the wide bottom to the narrow top. In the drawing, reference symbol k denotes a degree of roughness, reference symbol b1 an outer diameter of the bottom end, reference symbol b2 an inner diameter of the middle portion, reference symbol b3 an outer diameter of the top end, and reference symbol t1 a thickness.

The such bottom structure members 3 in this variant can create a rising current readily because the top portion is open and ensures a desired difference in directional roughness.

Figure 14:
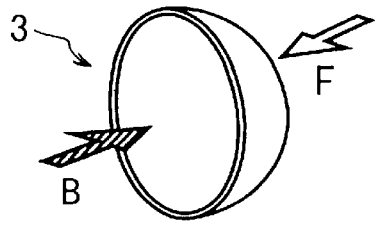
FIG. 14 is a perspective view showing a ninth variant of the bottom structure member in accordance with the present invention.
Figure 15:
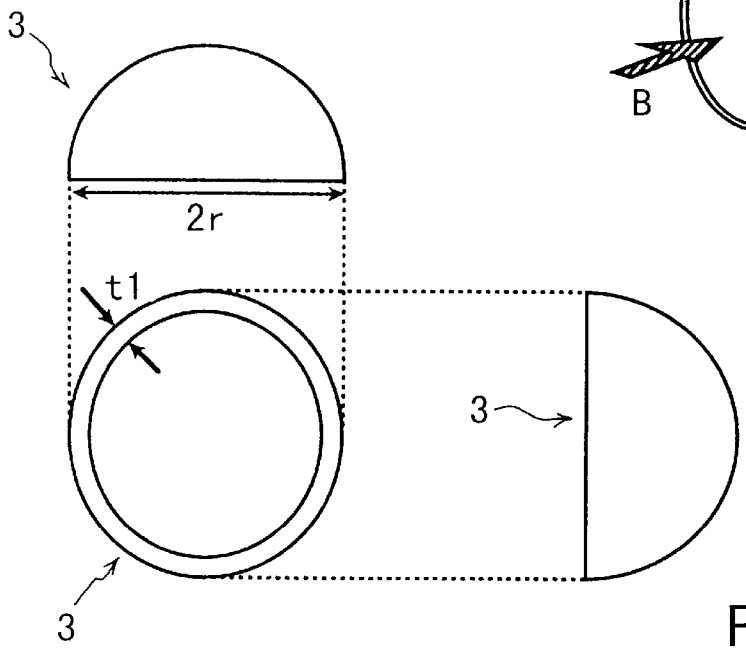
FIG. 15 is a view for describing the ninth variant thereof.

In the ninth variant as shown in FIGS. 14 and 15, the bottom structure member 3 is of a half-cut spherical shape. In the drawing, reference symbol 2*r* denotes an outer diameter.

The bottom structure member 3 in this variant can make a degree of its roughness higher, thereby gaining a great difference in directional roughness and creating a rising current with certainty.

Figure 16:
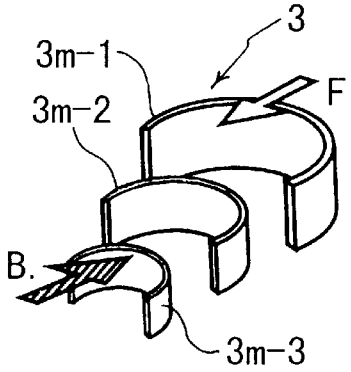
FIG. 16 is a perspective view showing a tenth variant of the bottom structure member in accordance with the present invention.
Figure 17:
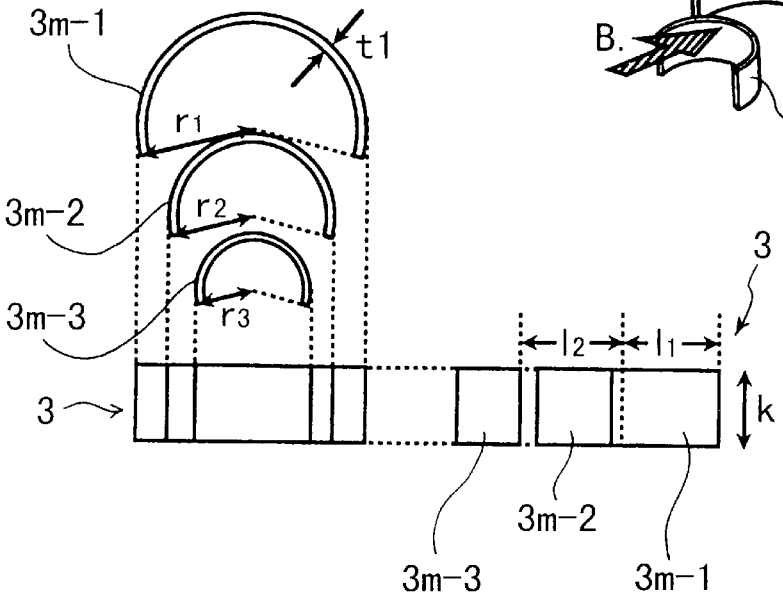
FIG. 17 is a view for describing the tenth variant thereof.

In the tenth variant as shown in FIGS. 16 and 17, the bottom structure member 3 is configured such that a rear portion of a cylinder-shaped member with its axis extending perpendicularly is partially cut away. Three of the such partially cutaway, perpendicuarly extending cylinder-shaped members 3*m*-1, 3*m*-2 and 3*m*-3, each having an equal height of roughness, are disposed at predetermined intervals 11 and 12 on the equal straight line.

The three such partially cutaway, perpendicuarly extending cylinder-shaped members 3*m*-1, 3*m*-2 and 3*m*-3 are further disposed in such a manner that their radii of roughness r1, r2 and r3, respectively, become smaller one by one in this order, thereby allowing a layout of the partially cutaway, perpendicuarly extending cylinder-shaped members to form a streamlined shape in a forward current direction.

The such bottom structure members 3 can make their boundary layers unlikely to be separated from the bottom of the bay.

Figure 18:
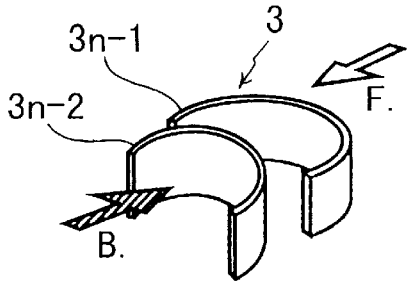
FIG. 18 is a perspective view showing an eleventh variant of the bottom structure member in accordance with the present invention.
Figure 19:
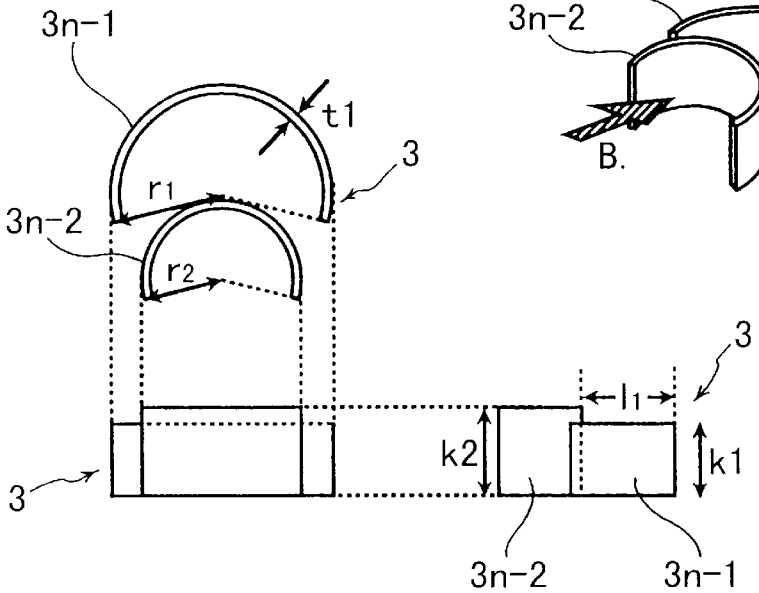
FIG. 19 is a view for describing the eleventh variant thereof.

The bottom structure member 3 in the eleventh variant as shown in FIGS. 18 and 19 is of a shape having substantially the same basic structure of the bottom structure member 3 in the tenth variant, with the exception that the degree of roughness k2 of the partially cutaway, perpendicularly extending cylinder-shaped member 3*n*-2 with its rear portion partially cut away, disposed on the downstream side in the forward current direction is set to become higher than the degree of roughness of the partially cutaway, perpendicularly extending cylinder-shaped member 3*n*-1 with its portion partially cut away, disposed on the upstream side in the forward current direction.

The such bottom structure member 3 is so structured as to minimize the separation of a boundary layer by applying the concept as adopted in the bottom structure member 3 in the tenth variant to the height direction, which makes a layout of the such bottom structure member 3 a streamlined shape in the forward current direction.

Figure 20:
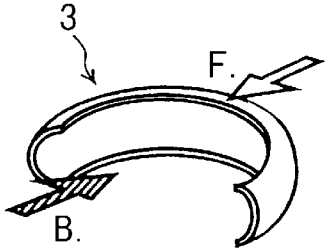
FIG. 20 is a perspective view showing a twelfth variant of the bottom structure member in accordance with the present invention.
Figure 21:
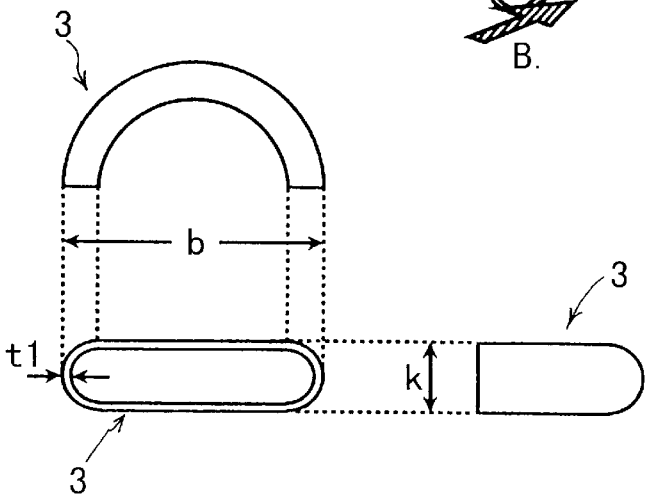
FIG. 21 is a view for describing the twelfth variant thereof.

In the twelfth variant as shown in FIGS. 20 and 21, the bottom structure member 3 is of such a half-cut U-shaped cylindrical member that the bottom structure member 3 in the seventh variant is curved in a generally U-letter shape. In the drawing, reference symbol b denotes an outer diameter.

The bottom structure members 3 in the twelfth variant can make a difference in directional roughness greater than the bottom structure member 3 in the seventh variant.

Figure 22:
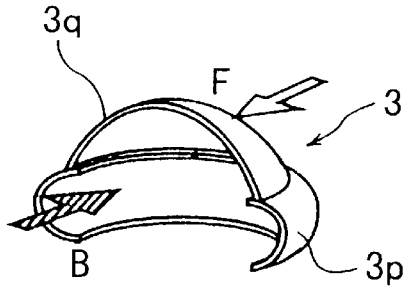
FIG. 22 is a perspective view showing a thirteenth variant of the bottom structure member in accordance with the present invention.
Figure 23:
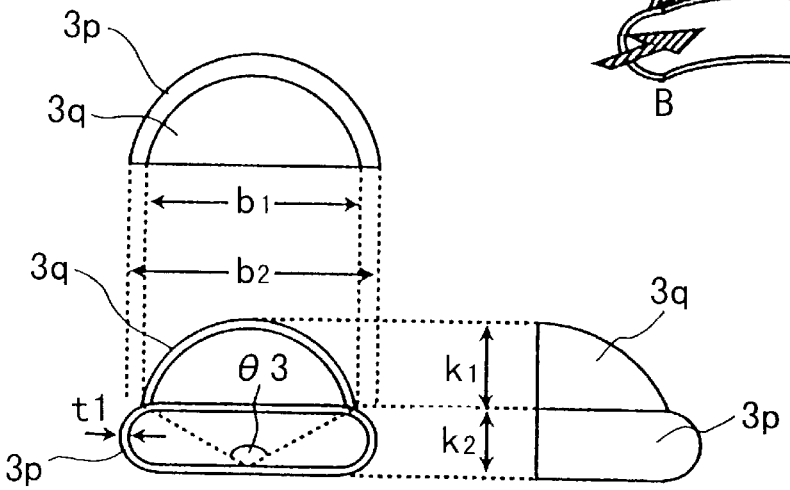
FIG. 23 is a view for describing the thirteenth variant thereof.

The bottom structure member 3 in the thirteenth variant as shown in FIGS. 22 and 23 has a quarterly-cut spherical member 3*q* disposed on a half-cut U-shaped cylindrical member 3*p*, the quarterly-cut spherical member 3*q* being formed in substantially the same manner as the bottom structure member 3 in the above-mentioned basic configuration and the half-cut U-shaped cylindrical member 3*p* formed in substantially the same manner as the bottom structure member 3 in the twelfth variant. In the drawings, reference symbol θ3 denotes an open angle of the quarterly-cut spherical member.

The bottom structure member 3 in this structure can provide a degree of roughness further greater than the bottom structure member 3 in the twelfth variant as a single member and than the bottom structure member 3 in the basic structure. Further, it can create a rising flow with certainty.

Figure 24:
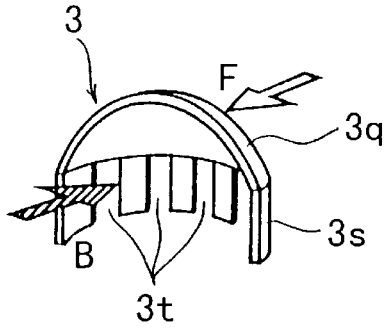
FIG. 24 is a perspective view showing a fourteenth variant of the bottom, structure member in accordance with the present invention.
Figure 25:
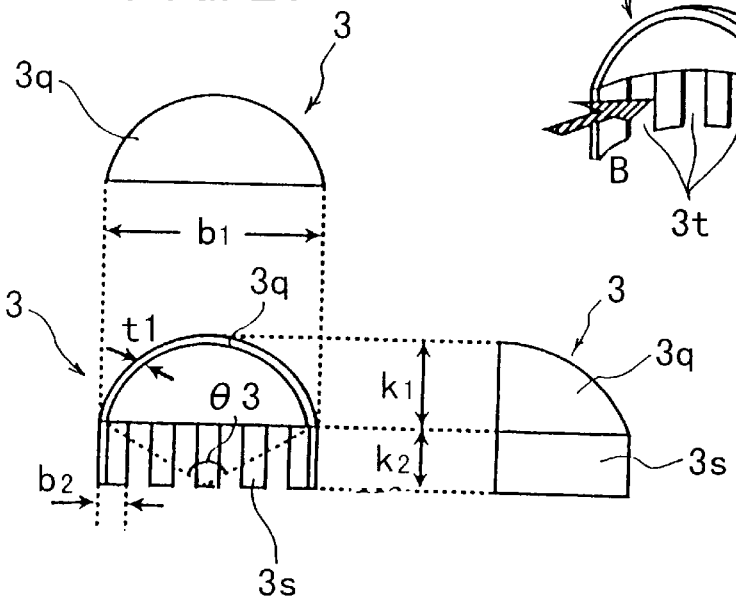
FIG. 25 is a view for describing the fourteenth variant thereof.

In the fourteenth variant as shown in FIGS. 24 and 25, the bottom structure member 3 has a quarterly-cut spherical member 3*q* disposed on a partially cutaway, perpendicularly extending cylindrical member 3*s*.

The partially cutaway, perpendicularly extending cylindrical member 3*s* is provided with a plurality of holes 3*t* at circumferential intervals, each passing over the entire thickness of the body in the forward current direction.

Although the bottom structure member 3 has the partially cutaway, perpendicularly extending cylindrical member 3*s* provided with the plural through-holes 3*t*, it can provide a great difference in directional roughness and prevent the deposition of earth and sand within the bottom structure member 3, thereby forming a rising current.

Figure 26:
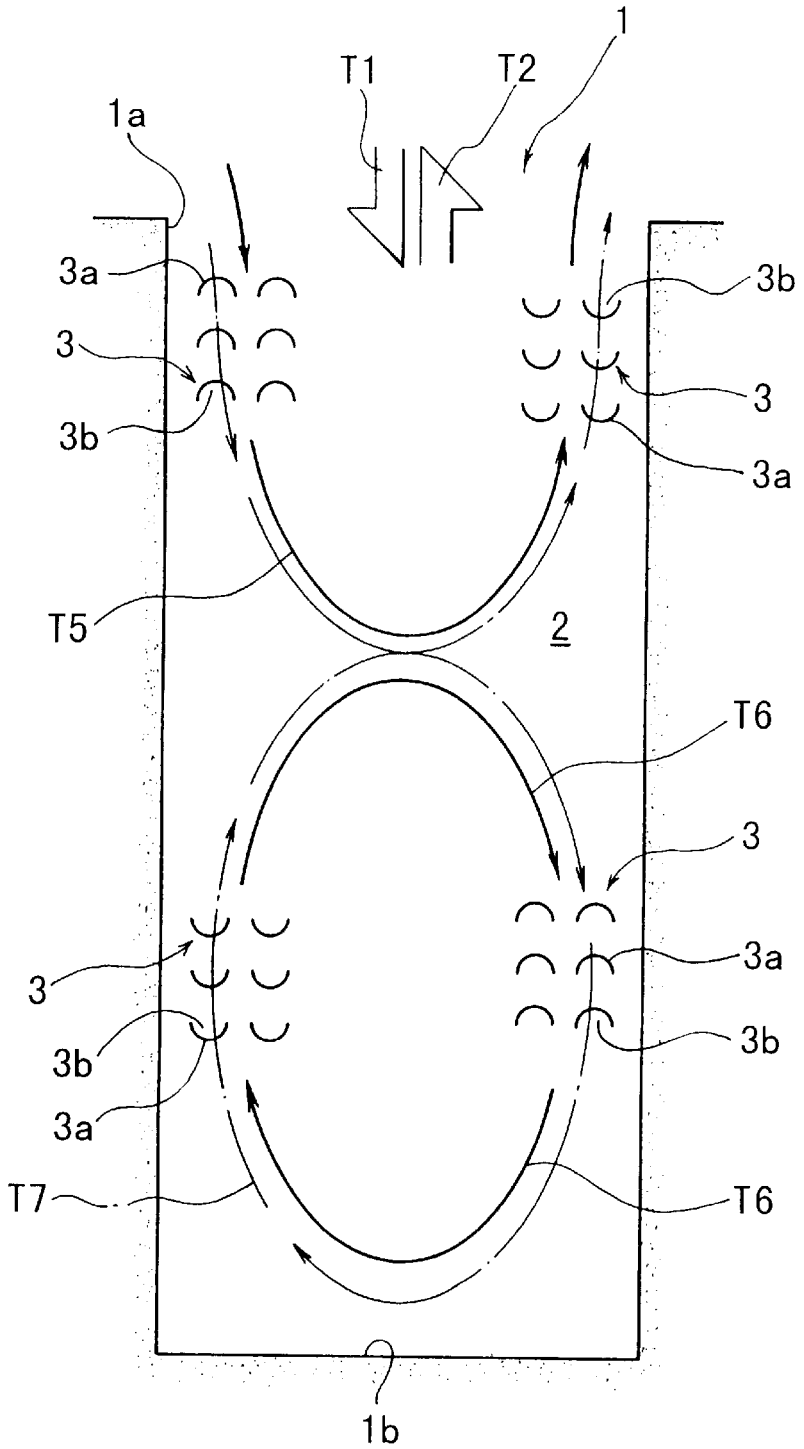
FIG. 26 is a view for describing a method for the formation of tidal residual current in accordance with the present invention.

FIG. 26 is an example in which the bottom structure members 3 are disposed in a model bay 1 having a depth to the rear end 1*b* longer than the width of the bay entrance 1*a*.

More specifically, a group of the plural bottom structure members 3 is disposed with their spherical sections 3*a* directed towards the bay entrance 1*a* in the position nearby the bay entrance 1*a* and on the left side of the bay area and another group of the plural bottom structure members 3 is disposed with their open sections 3*b* directed towards the bay entrance 1*a* in the position nearby the bay entrance 1*a* and on the right side of the bay area. On the other hand, a further group of the plural bottom structure members 3 is disposed with their open sections 3*b* directed towards the bay entrance 1*a* in the position nearby the rear bay 1*b* and on the left side of the bay area and. Likewise, a still further group of the plural bottom structure members 3 is disposed with their spherical sections 3*a* directed towards the bay entrance 1*a* in the position nearby the rear bay 1*b* and on the right side of the bay area.

With the arrangement of the bottom structure members 3, sea water outside the bay 1 flows into the bay from the left side of the bay entrance 1*a* and circulates in a half portion of the bay 1 on the bay entrance side in a counterclockwise direction, thereby forming a tidal residual current T5 on the bay entrance side, which outflows into the outside sea from the right side portion of the bay entrance 1*a*. Further, the sea water flown into the bay forms a tidal residual current T6 on the rear bay side, which circulates in a clockwise direction in the remaining half portion on the rear bay side within the model bay 1.

Thereafter, the tidal residual current T5 on the bay entrance side and the tidal residual current T6 on the rear bay side are connected with each other in the nearly middle portion of the bay 1 in time series, thereby forming a tidal residual current T7 on the entire bay area scale in a generally 8-letter shape.

Therefore, contaminants or pollutants within the rear bay 1*b* can be outflown into the outside sea from the right side of the bay entrance side by the aid of the tidal residual current T7 on the entire bay area scale, thereby prevventing the residence of contaminants or pollutants within the bay 1.

Figure 27:
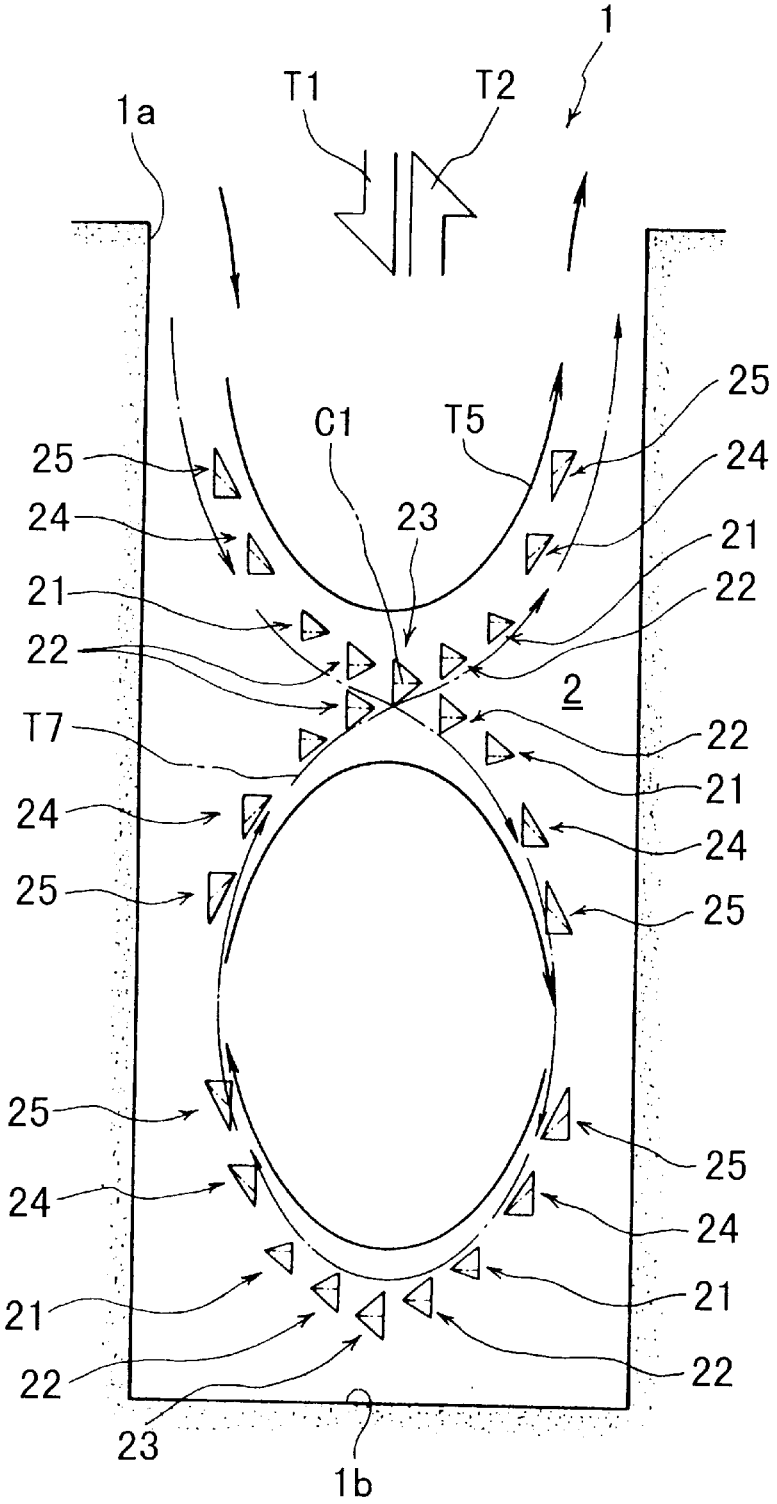
FIG. 27 is a view for describing a method for the formation of tidal residual current in accordance with another embodiment of the present invention.

FIG. 27 shows another example in which the bottom structure members 21, 22, 23, 24 and 25 are disposed in the same model bay 1 as in FIG. 26.

It is to be noted herein that FIGS. 28 to 31 indicate a first bottom structure member 20 in the basic structure. The first bottom structure member 20 is of a square-shaped column in section and the rectangular-shaped side surfaces 27 and 28 are so structured as to act as momentum-adding surfaces that can provide momentum to the tidal oscillation flow striking each of the surfaces in a desired direction.

Figure 28:
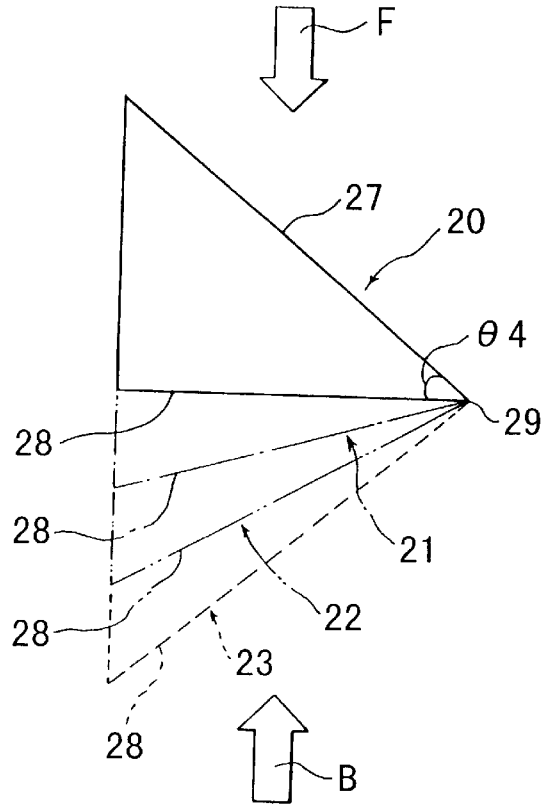
FIG. 28 is a plan view showing a bottom structure member in accordance with another embodiment of the present invention.
Figure 29:
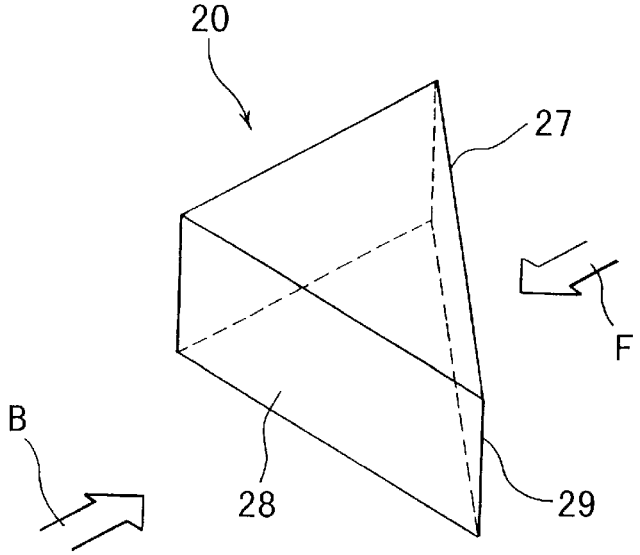
FIG. 29 is a perspective view showing the bottom structure member in accordance with the another embodiment of the present invention.

As shown in FIG. 28, the first bottom structure member 20 can be modified to second, third and fourth bottom structure members 21, 22 and 23 as variants, respectively, by making its shape a right-angled triangle, when looked on a plane, and gradually enlarging an angle θ4 of a top portion 29 on the basis of the one momentum-adding surface 27. The fourth bottom structure member 23 is of a quilateral triangular shape, when looked on a plane.

Figure 30:
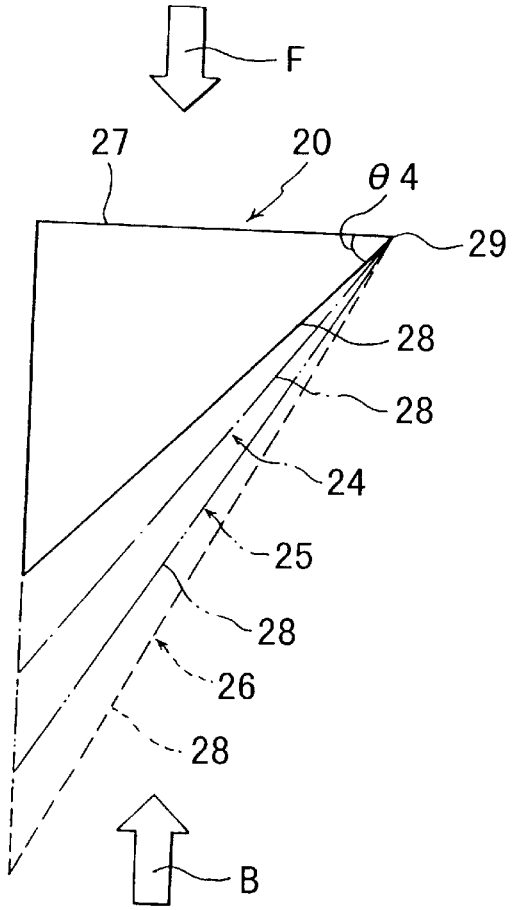
FIG. 30 is a plan view showing a bottom structure member in accordance with a further embodiment of the present invention.
Figure 31:
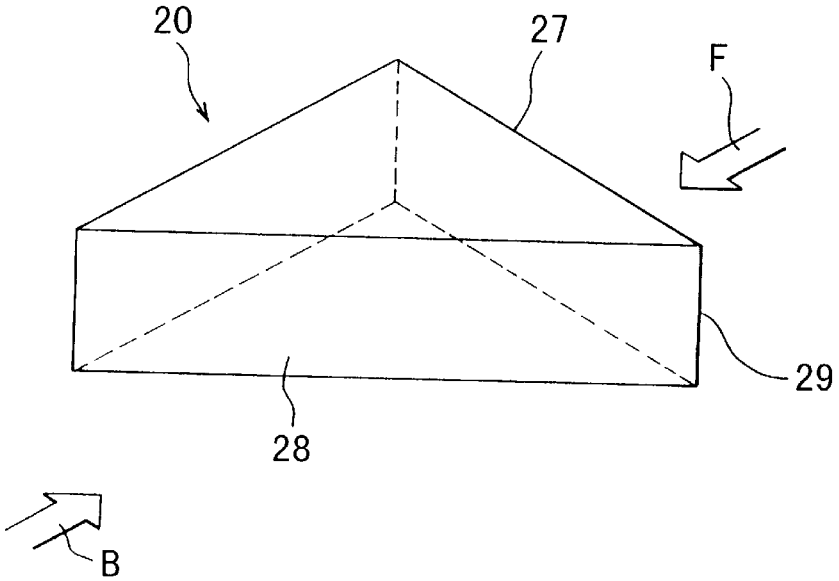
FIG. 31 is a perspective view showing the bottom structure member in accordance with the further embodiment of the present invention.
Figure 32:
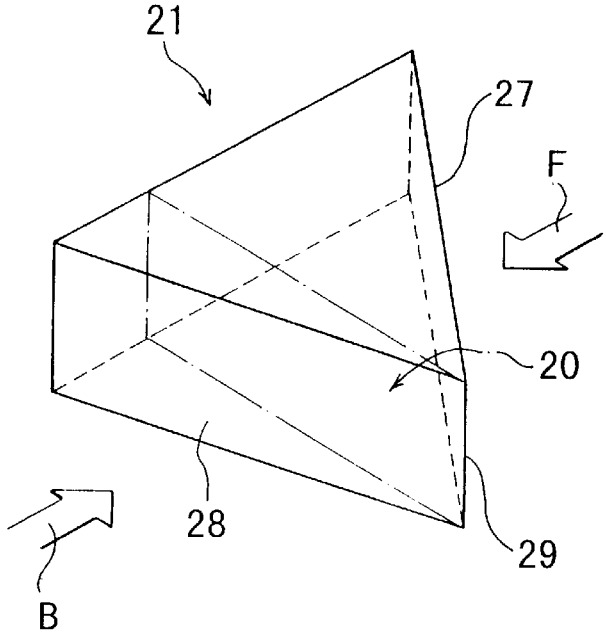
FIG. 32 is a perspective view showing the bottom structure member in accordance with the further embodiment of the present invention.
Figure 33:
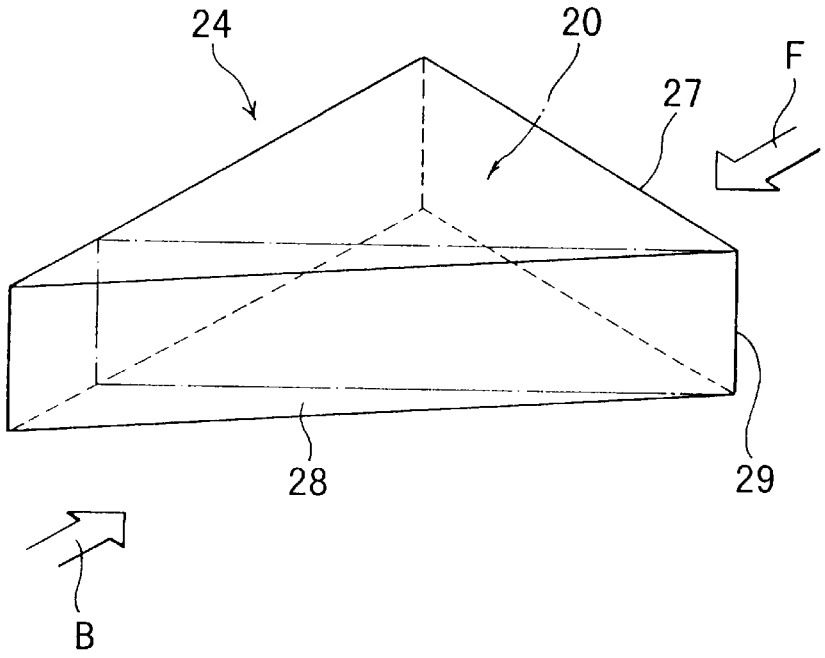
FIG. 33 is a perspective view showing the bottom structure member in accordance with the further embodiment of the present invention.

As shown in FIG. 30, the first bottom structure member 20 can be modified to fifth, sixth and seventh bottom structure members 24, 25 and 26 as variants, respectively, by gradually enlarging an angle θ4 of the top portion 29 on the basis of the other momentum-adding surface 28.

The first to seventh bottom structure members 20, 21, 22, 23, 24, 25 and 26, respectively, so structured in the manner as described hereinabove, are so disposed as to add the momentum to the tidal oscillation flow in the direction of creating the tidal residual current as designed upon designing the tidal residual current, so as to allow the tidal residual current to be formed basically in a direction intersecting with the tidal oscillation flow.

Figure 34:
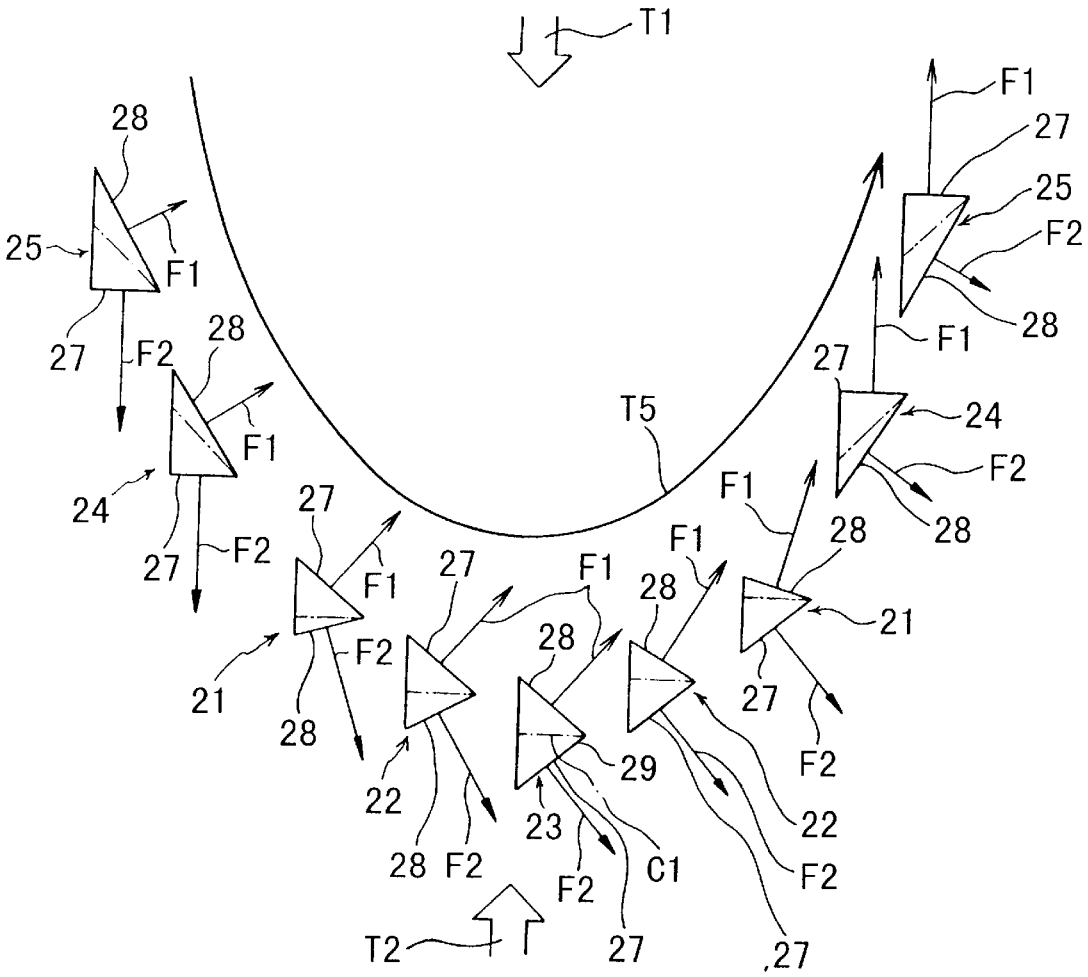
FIG. 34 is a view for describing the formation of tidal residual current.

More specifically, as shown in FIGS. 27 and 34, the fourth bottom structure members 23 in an equilateral triangular shape, when looked on a plane, are disposed in a nearly middle portion of the model bay 1 and the fourth bottom structure members 23 are disposed so as for their top portions 29 to be located on the right side and for a virtual symmetrical line C1 passing through the top portions 29 to be directed to the left and right directions.

Further, the third bottom structure members 22, the second bottom structure members 21, the fifth bottom structure members 24 and the sixth bottom structure members 25 are disposed one after another toward the right side of the fourth bottom structure members 23 and toward the bay entrance 1*a*.

Moreover, the third bottom structure members 22, the second bottom structure members 21, the fifth bottom structure members 24 and the sixth bottom structure members 25 are disposed one after another toward the left side of the fourth bottom structure members 23 and toward the bay entrance 1*a* in the manner opposite to and inverted from the disposition of each of the respective bottom structure members on the right side.

Furthermore, the sixth, fifth, second, third, fourth, third, second, fifth and sixth bottom structure members are disposed in the positions linearly symmetrical with respect to the virtual symmetrical line C1 and these bottom structure members are disposed in the position symmetrical at 180 degree toward the rear bay side.

With the arrangement of the bottom structure members, as shown in FIG. 34, as flood tide T1 strikes each of the momentum-adding surfaces 27 and 28 of the sixth, fifth, second, third, fourth, third, second, fifth and sixth bottom structure members 25, 24, 21, 22, 23, 22, 21, 24 and 25, respectively, a new momentum component F1 is added to the flood tide T1 from each of the momentum-adding surfaces 27 and 28 thereof. Likewise, as ebb tide T2 strikes each of the momentum-adding surfaces 27 and 28 thereof, a new momentum component F2 is added to the ebb tide T2 from each of the momentum-adding surfaces 27 and 28 thereof. Then, a residual momentum is caused to occur in the direction in which the vectors of these momentum components F1 and F2 are synthesized by a 1-cycle average of the tidal oscillation flow, thereby causing the residual momentum to create a tidal residual current T5 on the bay entrance side in time series. Likewise, the tidal residual current T6 on the rear bay side circulating clockwise in the half portion of the rear bay within the bay 1 is created by the sixth, fifth, second, third, fourth, third, second, fifth and sixth bottom structure members 25, 24, 21, 22, 23, 22, 21, 24 and 25, respectively, disposed in the half portion of the rear bay side within the bay 1.

Then, the tidal residual current T5 on the bay entrance side and the tidal residual current T6 on the rear bay side are connected with each other in time series in a nearly middle portion of the bay 1, thereby forming a tidal residual current T7 on the scale of the entire bay area in a nearly 8-letter shape.

Therefore, contaminants or pollutants in the rear bay area 1*b* can be outflown into the outside sea from the right side portion of the bay entrance 1*a* by the aid of the tidal residual current T7 on the scale of the entire bay area in time series, thereby enabling a prevention of the contaminants or pollutants with certainty from being remained in the bay 1.

Figure 35:
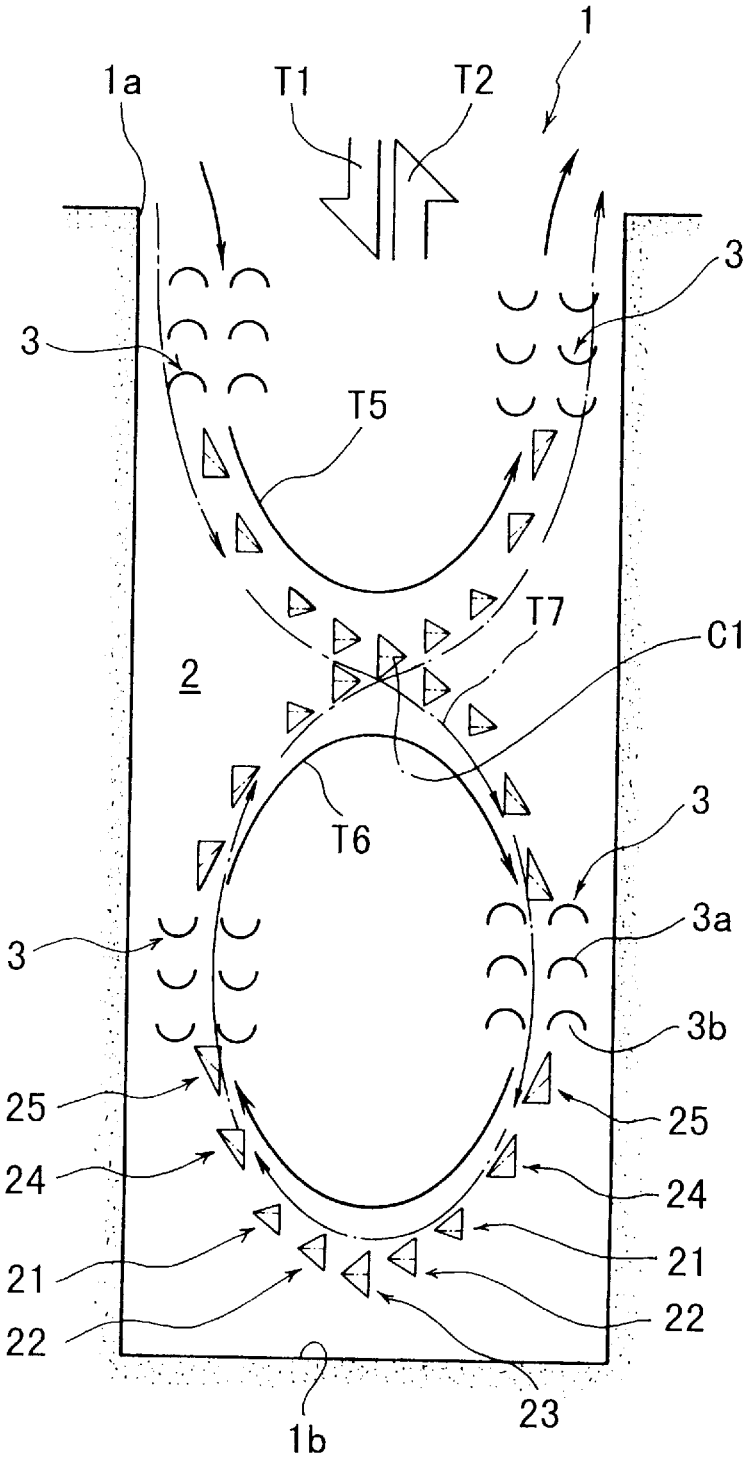
FIG. 35 is a view for describing a method for the formation of tidal residual current in accordance with a further embodiment of the present invention.

FIG. 35 shows a state of the disposition of the bottom structure members, in which the bottom structure members 3 as shown in FIG. 26 are disposed in combination with the first to fifth bottom structure members 20, 21, 22, 23 and 24, respectively, as shown in FIG. 27.

With the arrangement of the bottom structure members as described hereinabove, the tidal residual current in the flow direction of the tidal oscillation flow flows and the tidal residual current in the direction intersecting with the tidal oscillation flow can be created with high efficiency.

Therefore, the tidal residual current T5 on the bay entrance side and the tidal residual current T6 on the rear bay side are formed in a smooth way and with high certainty, thereby consequently creating the tidal residual current T7 on the scale of the entire bay area that can actively exchange sea water in the bay 1 for the sea water outside the bay.

Figure 36:
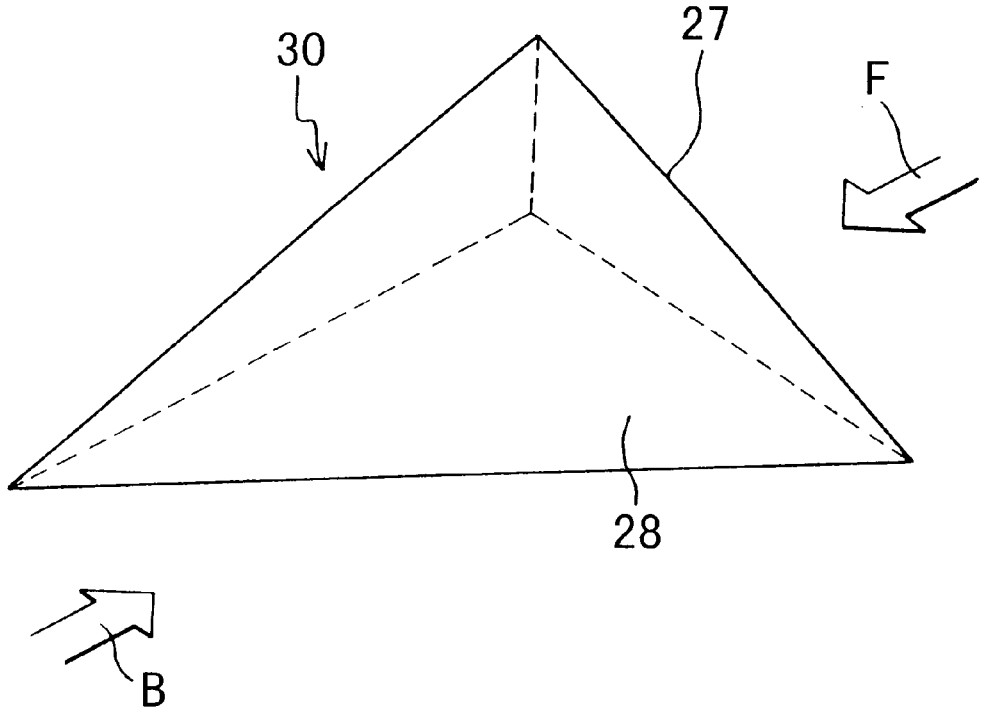
FIG. 36 is a perspective view showing a bottom structure member in accordance with a further embodiment of the present invention.

FIG. 36 shows a bottom structure member 30 in another embodiment and the bottom structure member 30 is of a trigonal pyramid shape with the triangular side surfaces of the bottom structure member 30 configured so as to act as momentum-adding surfaces 27 and 28, thereby allowing the tidal oscillation flow striking each of the momentum-adding surfaces 27 and 28 to provide a momentum in a desired direction.

With the arrangement of the bottom structure member as described hereinabove, the bottom structure members 20, 21, 22, 23, 24, 25, 26 and 30 as described hereinabove can make the sides facing the top portions 29 open and form a space inside them, hereby providing each of the bottom structure members with the functions of gathering fish and forming nests for fish.

EXAMPLES (First embodiment)

An evaluation was made using an actual model in respect to a tidal residual current to be created by the method for the formation of a tidal residual current in a sea area in accordance with the present invention and to a variation in a distribution of contaminants and pollutants by the action of the tidal residual current.

Figure 37:
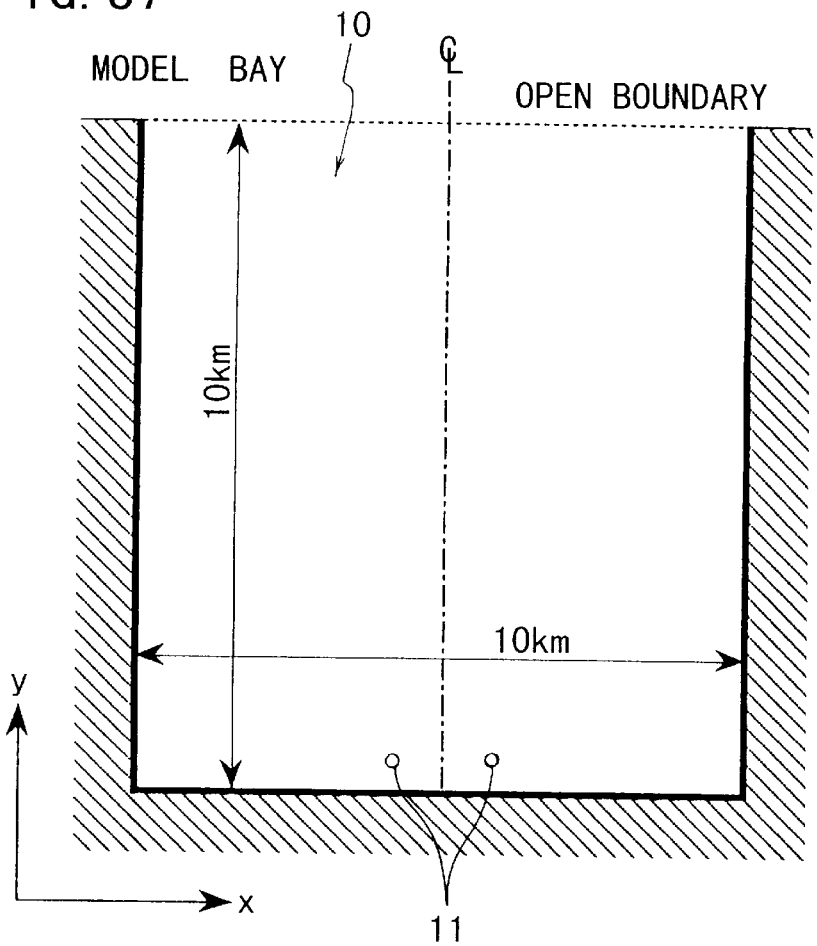
FIG. 37 is a view describing a model bay.

More specifically, as shown in FIG. 37, in the rear area of a model bay 10 in a square shape, when looked on a plan view, and having an open boundary, there are provided two locations 11, 11 into which the contaminants are caused to flow. Numerical analyses are made of the tidal residual current caused to be created in the model bay 10 and the distribution of concentrations of contaminants caused to be dispersed by the tidal residual current, when the contaminants are forced to flow from the two contaminant-flowing locations 11, 11.

The analyses were made using, as basic formulas for a two-dimensional diffusion of a tidal flow on a plane, a formula of continuation, an equation of motion in the x-direction, an equation of motion in the y-direction, and an equation of advection and diffusion as follows:

Formula of continuation:

$$\frac{\partial \zeta}{\partial t} + \frac{\partial}{\partial x}[U(h+\zeta)] + \frac{\partial}{\partial y}[V(h+\zeta)] = q \tag{1}$$

Equation of motion in x-direction:

$$\frac{\partial U(h+\zeta)}{\partial t} + \frac{\partial U^2(h+\zeta)}{\partial x} + \frac{\partial UV(h+\zeta)}{\partial y} - fV(h+\zeta) = -g(h+\zeta)\frac{\partial \zeta}{\partial x} + \frac{\partial}{\partial x}\left[V_t\frac{\partial U(h+\zeta)}{\partial x}\right] + \frac{\partial}{\partial y}\left[V_t\frac{\partial U(h+\zeta)}{\partial y}\right] - \gamma_b^2 U\sqrt{U^2+V^2} \tag{2}$$

Equation of motion in y-direction:

$$\frac{\partial V(h+\zeta)}{\partial t} + \frac{\partial UV(h+\zeta)}{\partial x} + \frac{\partial V^2(h+\zeta)}{\partial y} + fU(h+\zeta) = -g(h+\zeta)\frac{\partial \zeta}{\partial y} + \frac{\partial}{\partial x}\left[V_t\frac{\partial V(h+\zeta)}{\partial x}\right] + \frac{\partial}{\partial y}\left[V_t\frac{\partial V(h+\zeta)}{\partial y}\right] - \gamma_b^2 V\sqrt{U^2+V^2} \tag{3}$$

Equation of advection and diffusion:

$$\frac{\partial}{\partial t}[(h+\zeta)C] + \frac{\partial}{\partial x}[(h+\zeta)UC] + \square\frac{\partial}{\partial y}[(h+\zeta)VC] = \frac{\partial}{\partial x}\left[(h+\zeta)D\frac{\partial C}{\partial x}\right] + \frac{\partial}{\partial y}\left[(h+\zeta)D\frac{\partial C}{\partial y}\right] + S \tag{4}$$

In the formulas above, reference symbols "x" and "y" denote each a coordinate in the horizontal direction; reference symbol "t" denotes time; reference symbols "U" and "V" a water depth-averaged flow velocity in x- and y-direction, respectively; reference C a water depth-averaged concentration of diffused materials; reference symbol "ζ" a rise of a water level (a tidal level); reference symbol "h" an average water depth; reference symbol "vt" an apparent eddy viscosity coefficient; reference symbol "D" a diffusion coefficient; reference symbol "S" an amount of contaminants and pollutants incoming in a unit area and time; reference symbol "q" an amount of water incoming in a unit area and time; reference symbol "$\gamma^2_b$" a bottom friction coefficient (=0.0026); reference symbol "g" gravitational acceleration; and reference symbol "f" a Coriolis coefficient.

Figure 38:
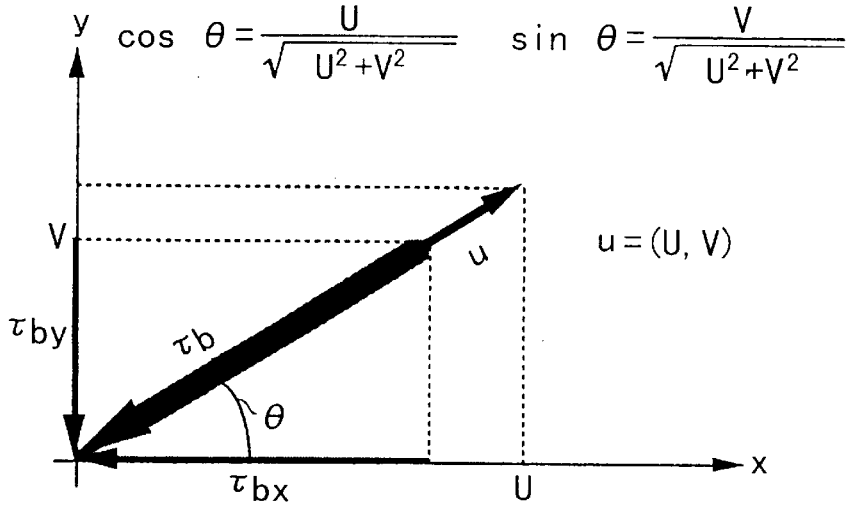
FIG. 38 is a view describing a method for modeling shear stress on a bottom surface of the model bay.

Further, there will be shown an evaluation formulation of bottom stress (refer to FIG. 38), Manning's equation, and a relation formula between reference symbol "$\gamma^2_b$" and n, as follows:

Evaluation formulation of bottom stress:

$$\frac{\tau_b}{\rho} = \gamma_b^2 u|u|\ \frac{1}{\rho}(\tau_{bz}, \tau_{by}) = \gamma_b^2\sqrt{U^2+V^2}\ (U, V) \tag{5}$$

where $\gamma^2_b$ denotes a bottom friction coefficient; and

ρ denotes a density.

Manning's formulation:

$$V = \frac{R^{1/6}}{n\sqrt{g}}u* \tag{6}$$

where g denotes gravitational acceleration;

n denotes a Manning's roughness coefficient; and

R denotes hydraulic radius.

Relation formula between reference symbol "$\gamma^2_b$" and n:

$$\gamma_b^2 = \frac{n^2 g}{R^{1/3}} \tag{7}$$

From the above formulas, in the case if h=20 m, n is 0.0268 when $\gamma^2_b$ is 0.0026; and n is 0.0368 when $\gamma^2_b$ is 0.0049.

Table 1 shows the conditions for computation.

Figure 39:
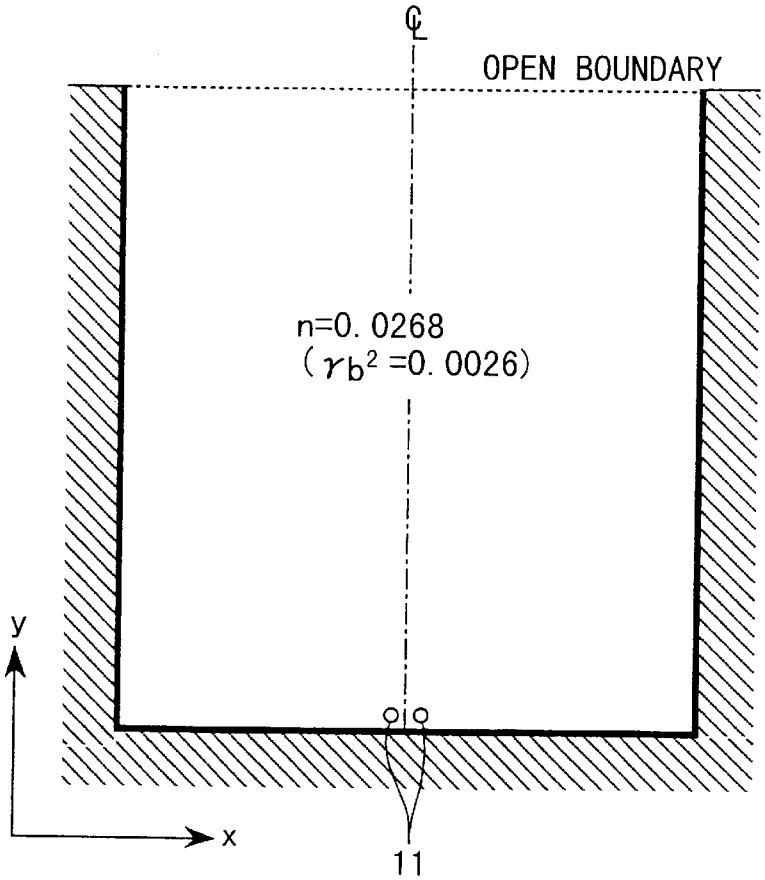
FIG. 39 is a view describing a model bay in accordance with model case 1.

FIG. 39 shows Case (1) as a comparative example, in which the computation is made under the conditions over the entire bottom area where the Manning's roughness coefficient is set to be n=0.0268 and the bottom friction coefficient $\gamma^2_b$ is set to be 0.0026.

Figure 40:
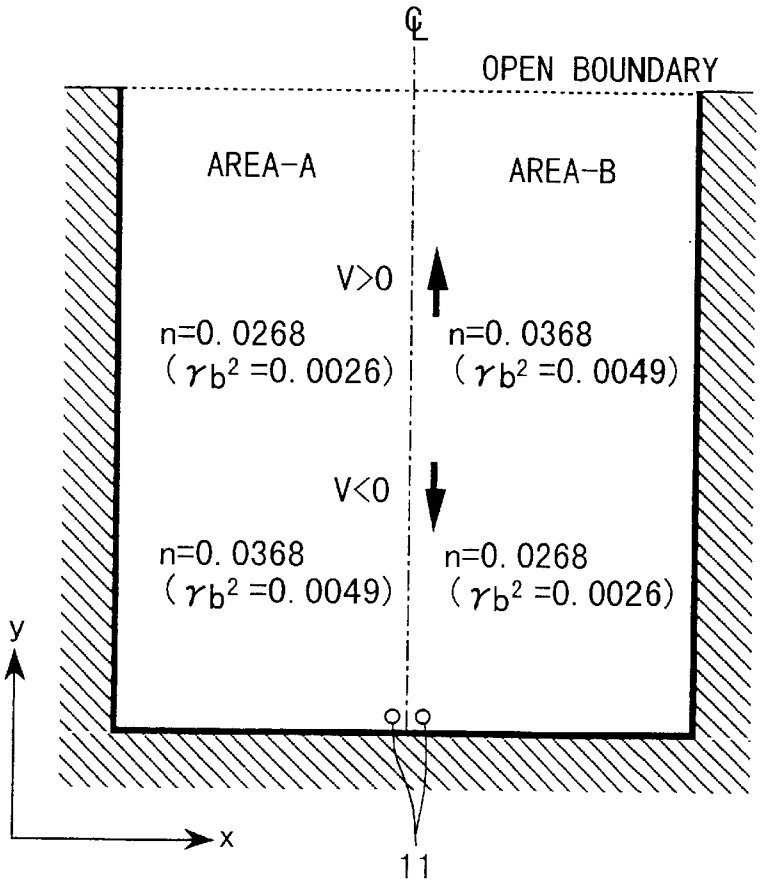
FIG. 40 is a view describing a model bay in accordance with model case 2.

FIG. 40 shows Case (2), where the model bay 10 is divided into half sections, that is, water area A on the left half section and water area B on the right half section. The conditions for computation of the roughness coefficient of the roughness on the forward current side and the backward current side and for the sea bottom friction coefficient in the water areas A and B are set as shown in Table 2 below. Further, in the water areas A and B, there is provided a difference in directional roughness in the direction opposite to each other.

Figure 41:
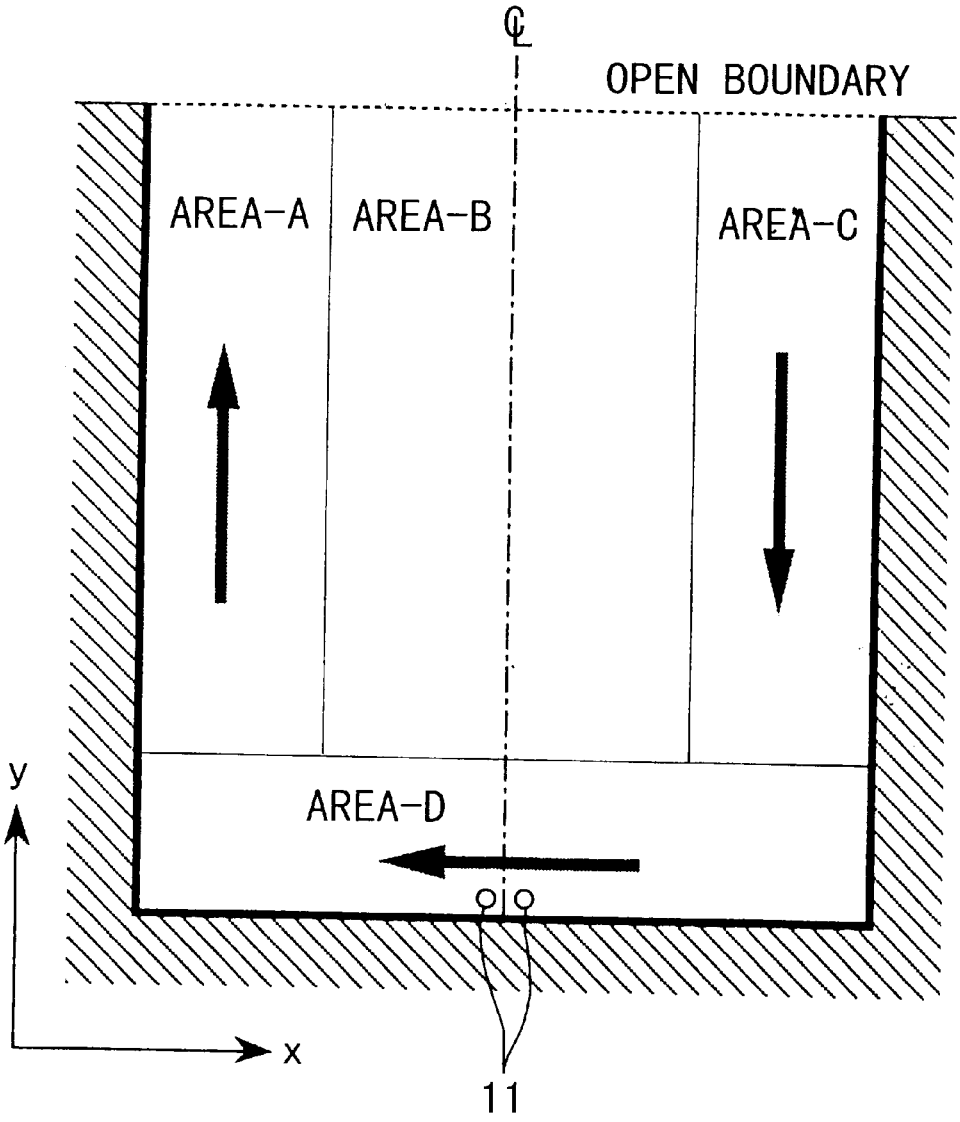
FIG. 41 is a view describing a model bay in accordance with model case 3.

FIG. 41 shows Case (3), in which the model bay 10 is divided into four sea areas, that is, a left-sided water area A, a central water area B, a right-sided water area C, and a rear-sided water area D. The computation conditions for the Mannings's roughness coefficients of the roughness on the forward current side and the backward current side and the bottom friction coefficients in the water areas A, B, C and D are set as shown in Table 3 below. Further, in the water areas A, B, C and D, there is provided each a difference in directional roughness.

It is to be noted herein that in the water area D the water flow (U<0) from the right side to the left side is referred to as 'forward current direction' and the water flow (U>0) in the opposite direction is referred to as 'backward current direction'.

In each of the Cases (1), (2) and (3), the amount of the contaminants to be flown from the two contaminant-flowing locations 11, 11 is set to amount to 500 grams.

The computation results in the Cases (1), (2) and (3) obtained under the conditions as described hereinabove are shown below.

Figure 42:
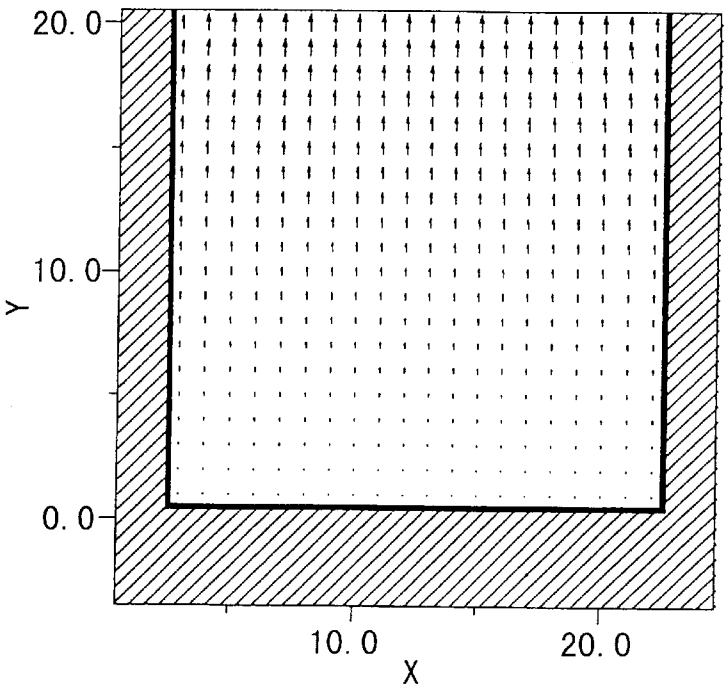
FIG. 42 is a view showing a calculational result of a tidal current simulation (maximum ebb tide).
Figure 43:
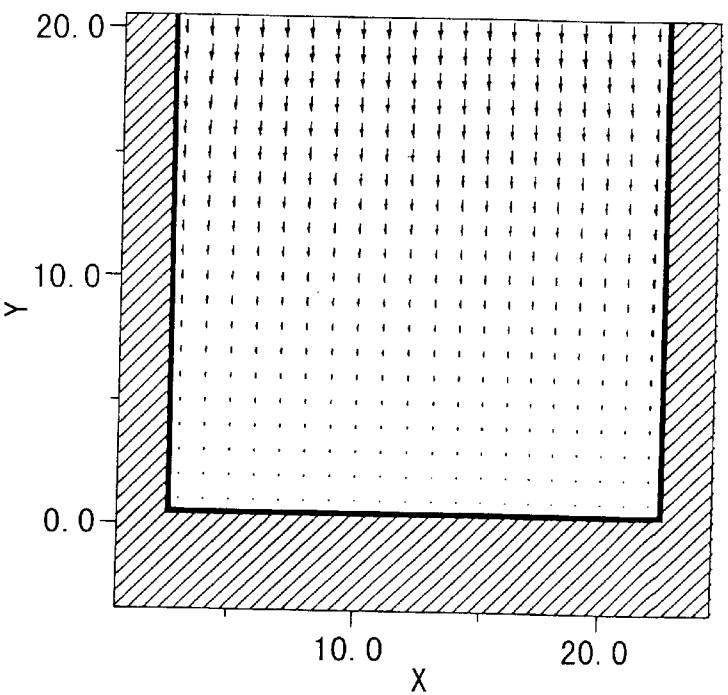
FIG. 43 is a view showing a calculational result of a tidal current simulation (maximum flood tide).

More specifically, the results of computation of a tide flow in the Case (1) are shown in FIGS. 42 and 43, in which FIG. 42 indicates the case of maximum ebb tide and FIG. 43 indicates the case of maximum flood tide.

Figure 45:
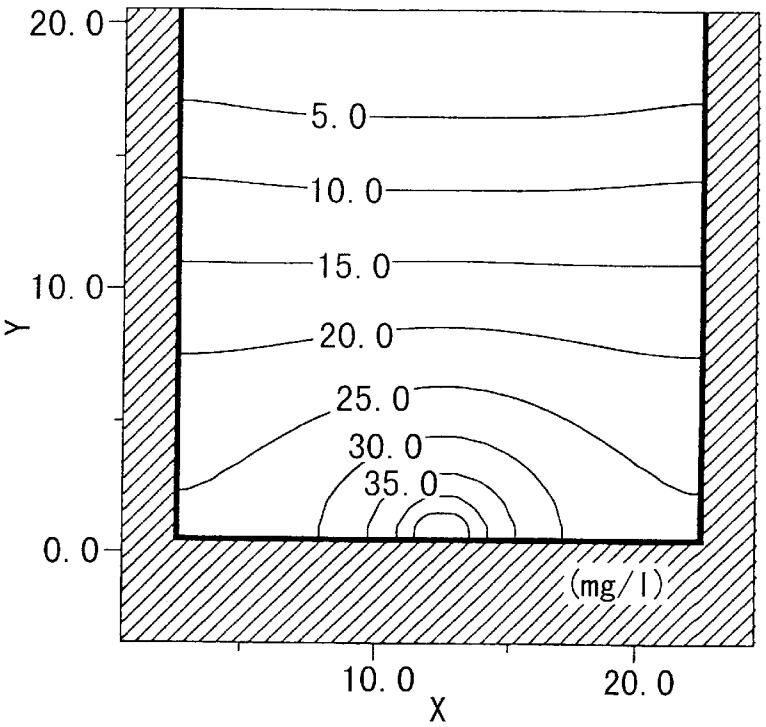
FIG. 45 is a view showing a calculational result of a tidal current simulation.
Figure 44:
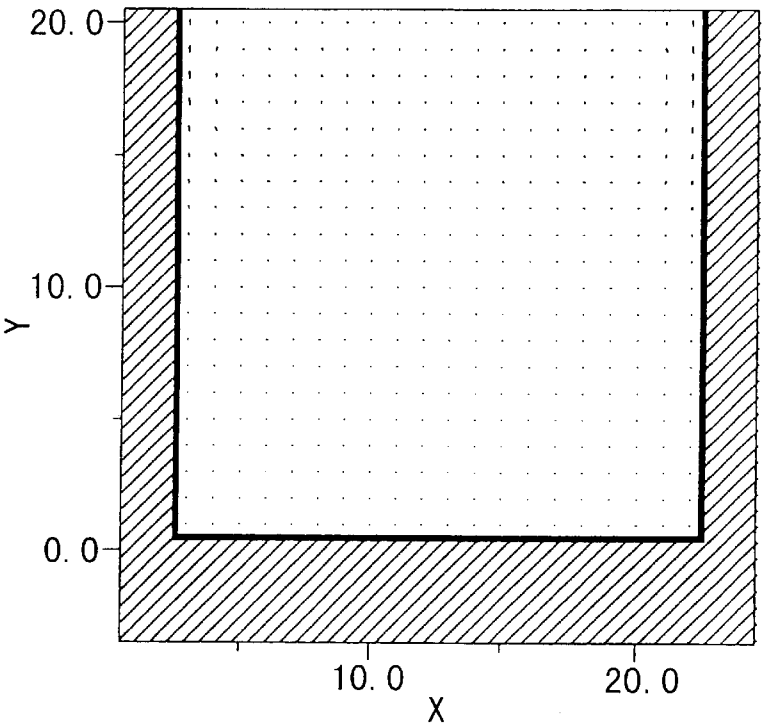

Further, FIG. 44 shows the result of computation of a tidal residual current and FIG. 45 shows the result of computation of a distribution of the concentration of the contaminants in a stationary state.

In the Case (1), as shown in FIG. 44, a strong tidal residual current is little created. Further, as shown in FIG. 45, it is found that a majority of the contaminants flown from the contaminant-flowing locations 11, 11 is retained in the position nearby the contaminant-flowing locations 11, 11.

Figure 47:
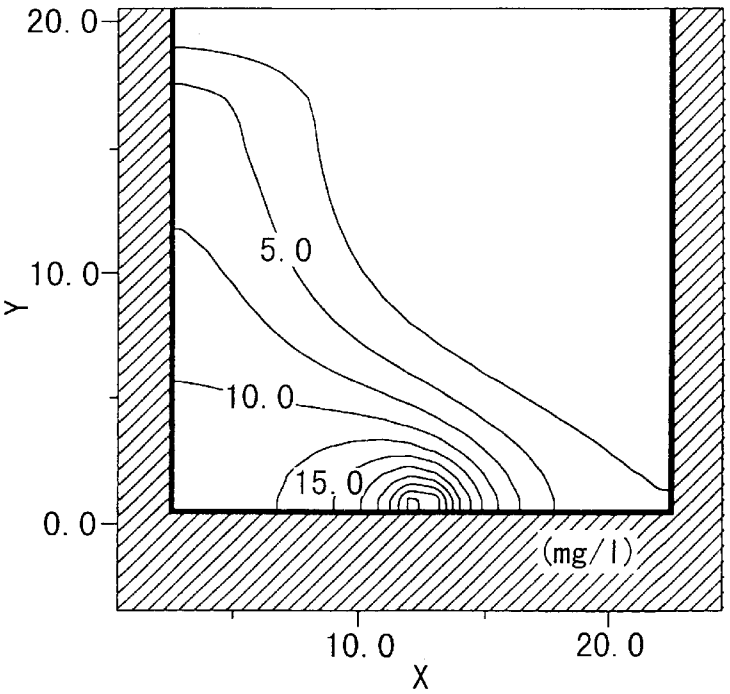
FIG. 47 is a view showing a calculational result of a contaminant distribution (in a stationary state).
Figure 46:
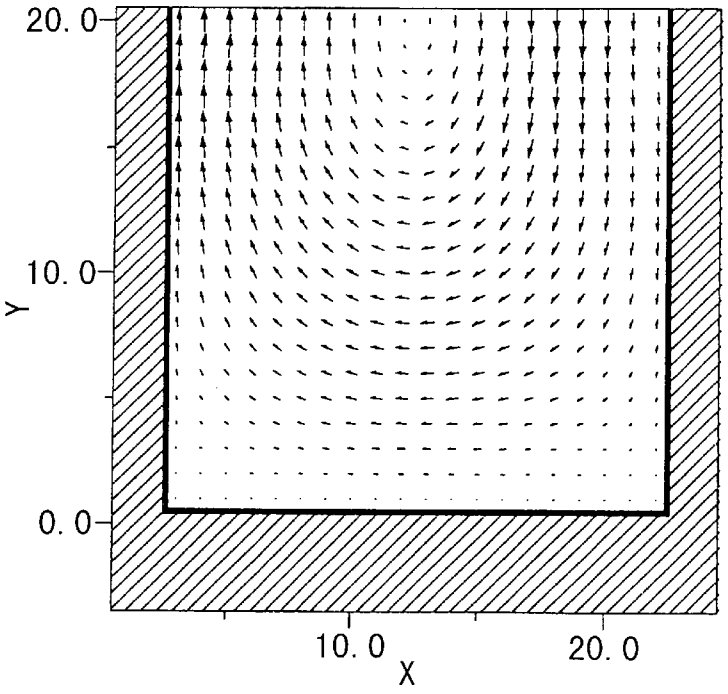
FIG. 46 is a view showing a calculational result of a contaminant distribution (in a stationary state).

Then, for the Case (2), FIG. 46 shows the result of computation of a tidal residual current and FIG. 47 shows the result of computation of a distribution of the concentration of the contaminants in a stationary state.

In the Case (2), as shown in FIG. 46, it is found that a tidal residual current is created in a generally U-letter shape, which flows from the right side of the bay entrance area through the right side of the rear bay area and the left side of the rear bay area to the left side of the bay entrance area.

Further, as shown in FIG. 47, it is found that the contaminants are outflown from the bay into the outside of the bay efficiently by the tidal residual current because the concentration of the contaminants flown at the contaminant-flowing locations 11, 11 was made lower over the area in the water areas A and B on the rear bay sides than the water area nearby the contaminant-flowing locations 11, 11.

Figure 49:
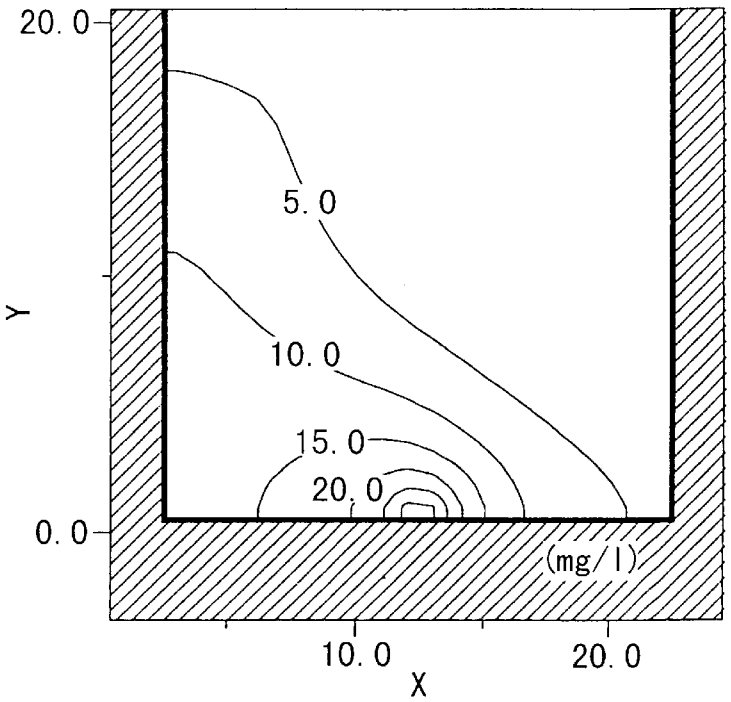
FIG. 49 is a view showing a calculational result of a contaminant distribution (in a stationary state).
Figure 48:
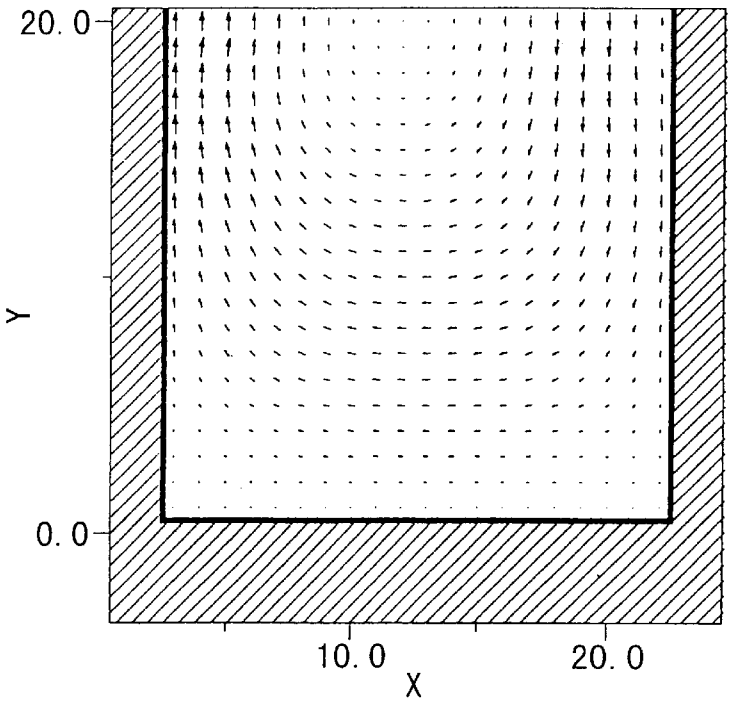
FIG. 48 is a view showing a calculational result of a tidal current simulation (tidal residual current).
Figure 51:
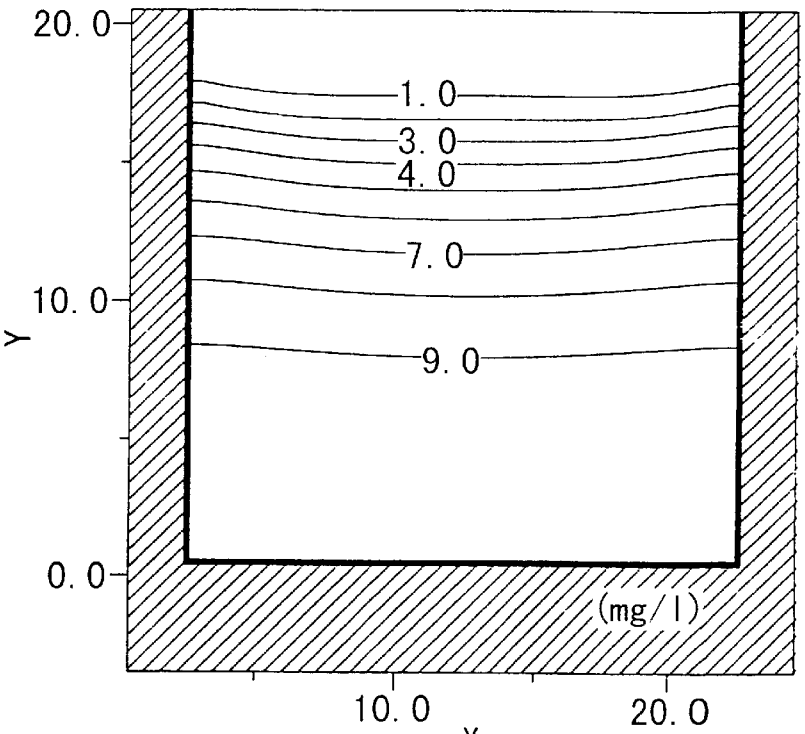
FIG. 51 is a view showing a calculational result of a contaminant distribution after 100 cycles (high tide).
Figure 50:
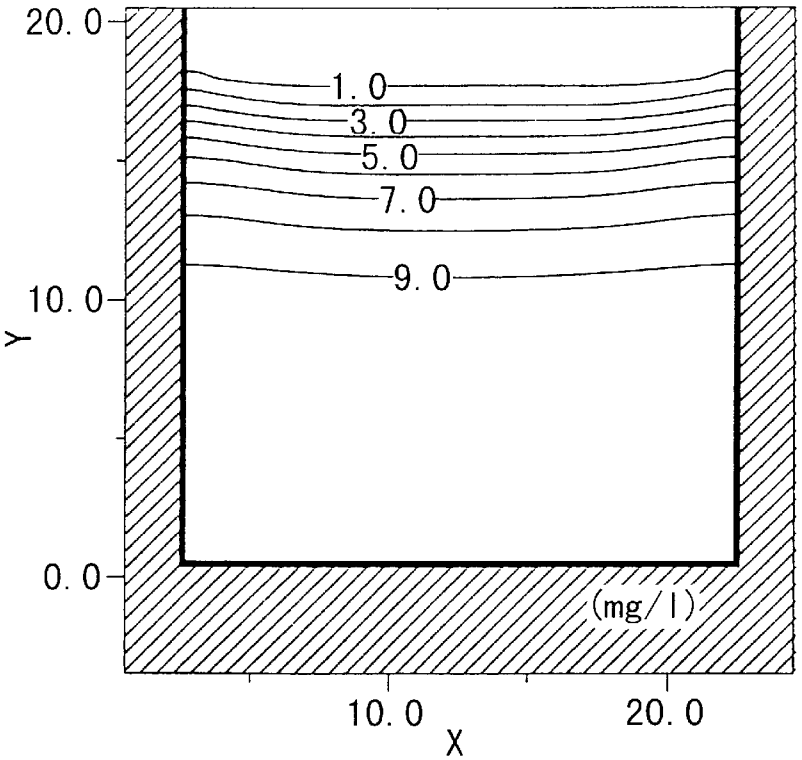
FIG. 50 is a view showing a calculational result of a contaminant distribution after 50 cycles (high tide).
Figure 53:
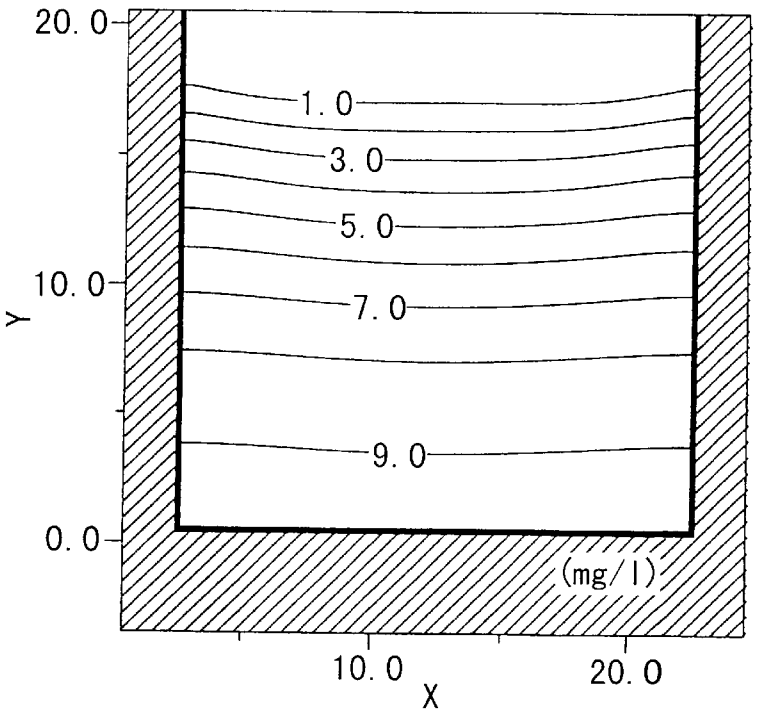
FIG. 53 is a view showing a calculational result of a contaminant distribution after 200 cycles (high tide).
Figure 52:
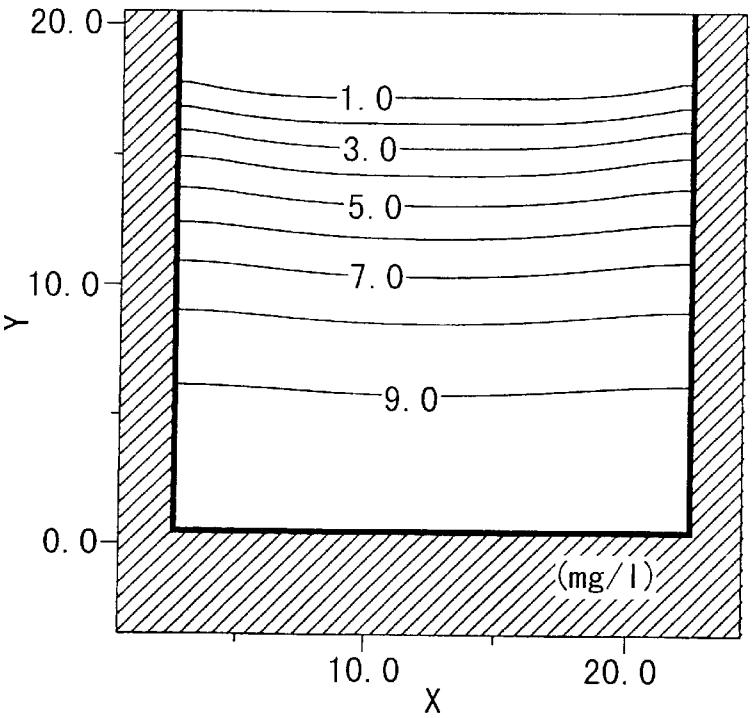
FIG. 52 is a view showing a calculational result of a contaminant distribution after 150 cycles (high tide).
Figure 54:
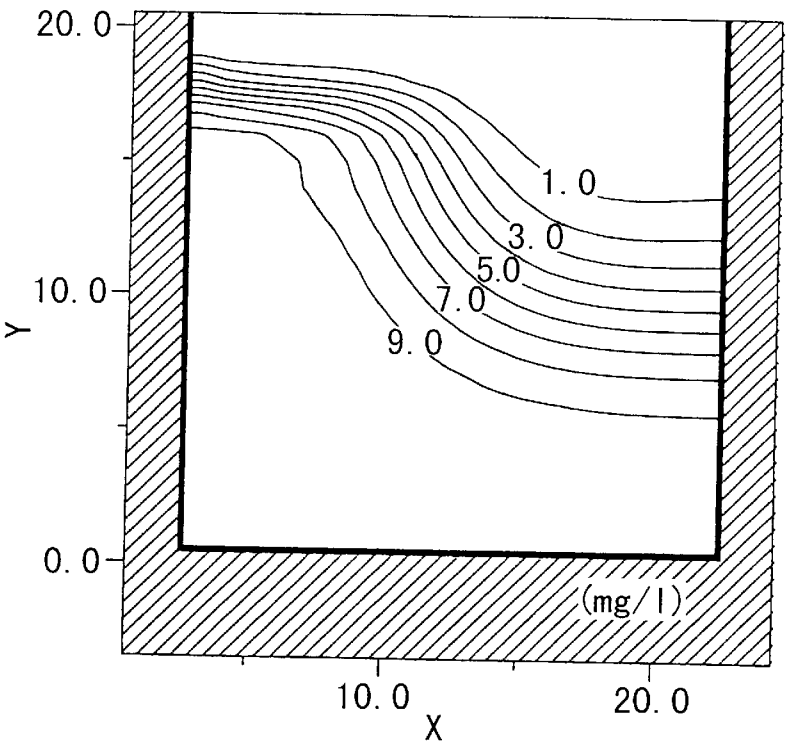
FIG. 54 is a view showing a calculational result of a contaminant distribution after 50 cycles (high tide).
Figure 55:
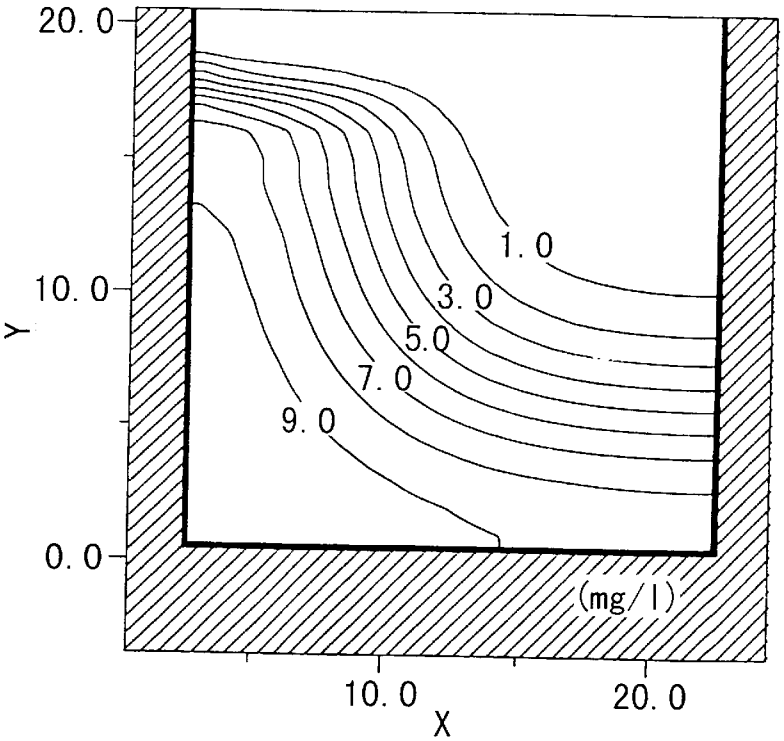
FIG. 55 is a view showing a calculational result of a contaminant distribution after 100 cycles (high tide).
Figure 56:
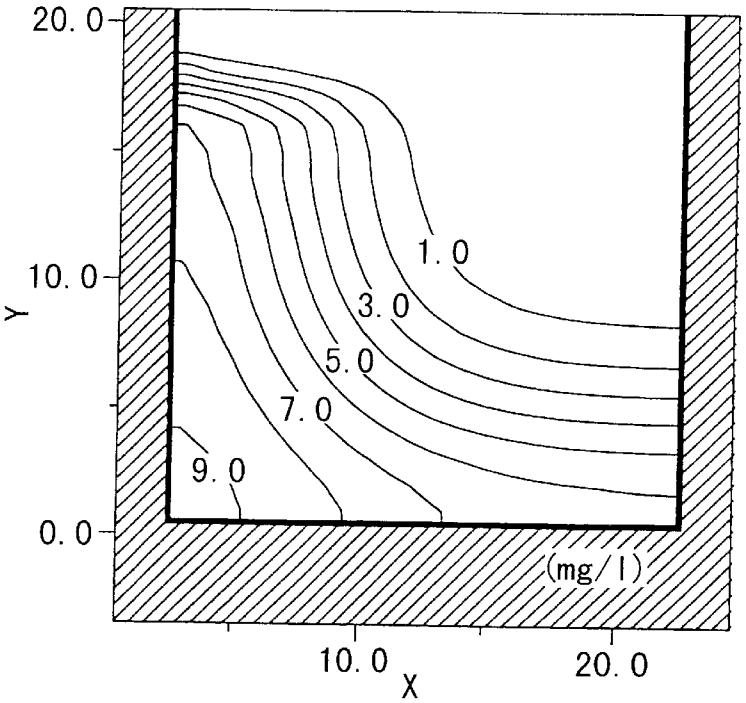
FIG. 56 is a view showing a calculational result of a contaminant distribution after 150 cycles (high tide).
Figure 57:
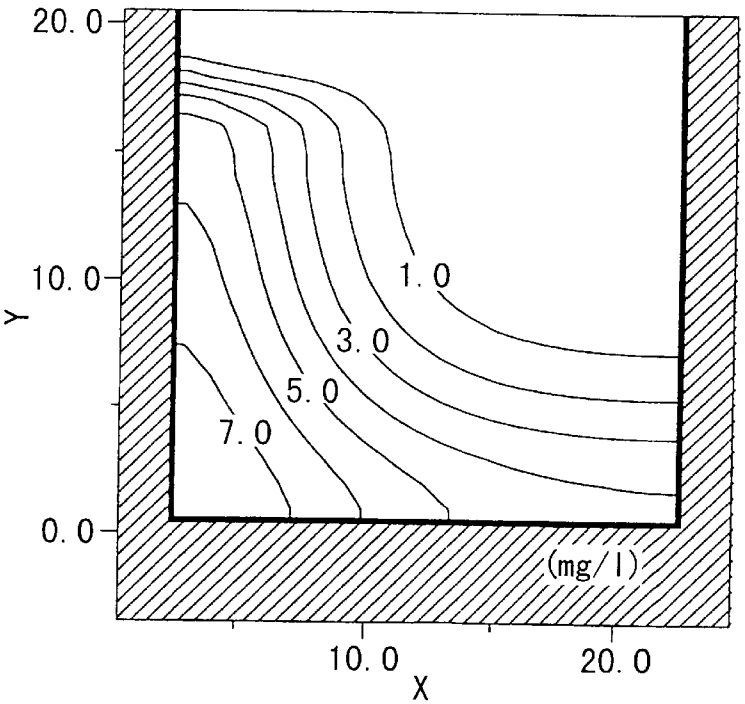
FIG. 57 is a view showing a calculational result of a contaminant distribution after 200 cycles (high tide). lo
Figure 58:
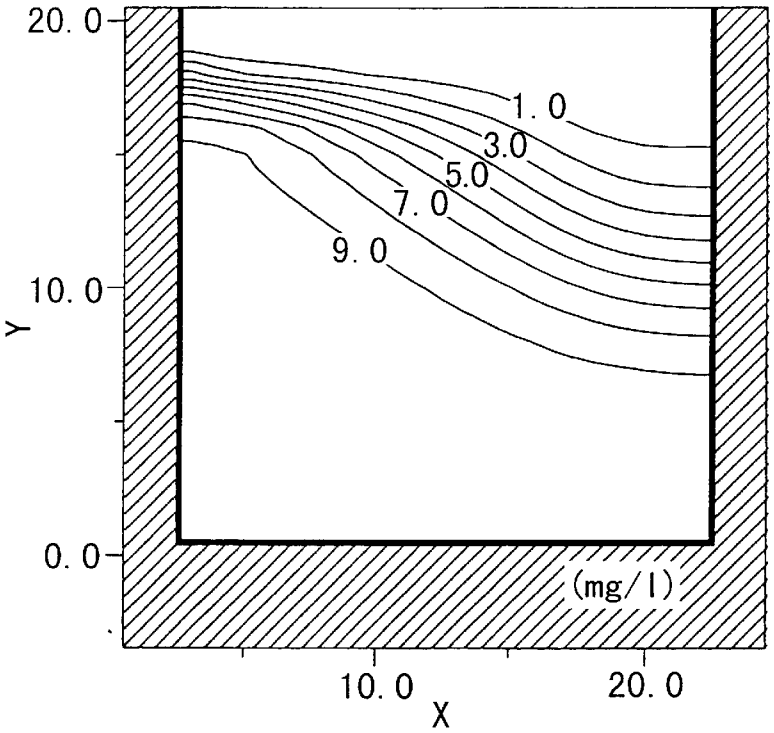
FIG. 58 is a view showing a calculational result of a contaminant distribution after 50 cycles (high tide).
Figure 59:
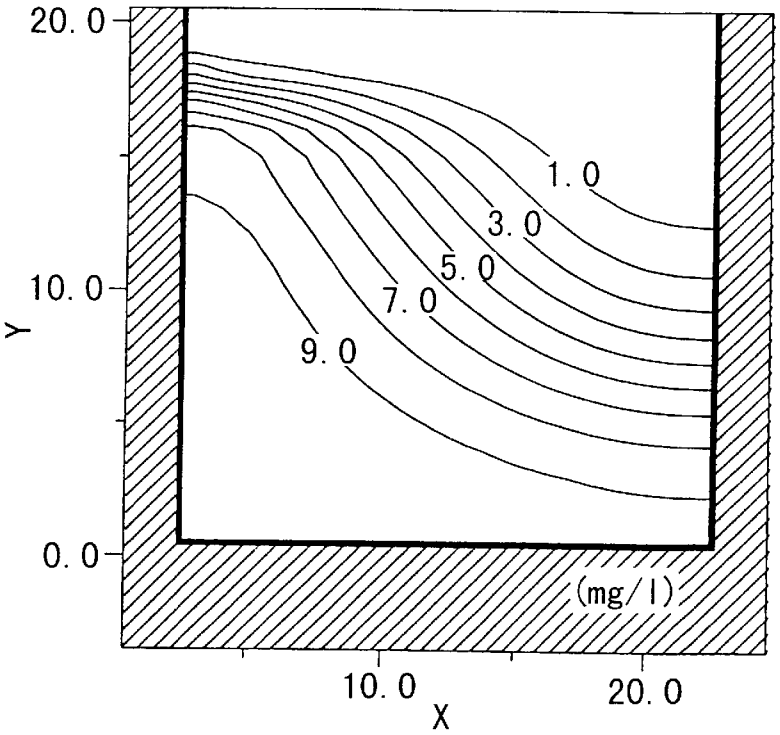
FIG. 59 is a view showing a calculational result of a contaminant distribution after 100 cycles (high tide).
Figure 60:
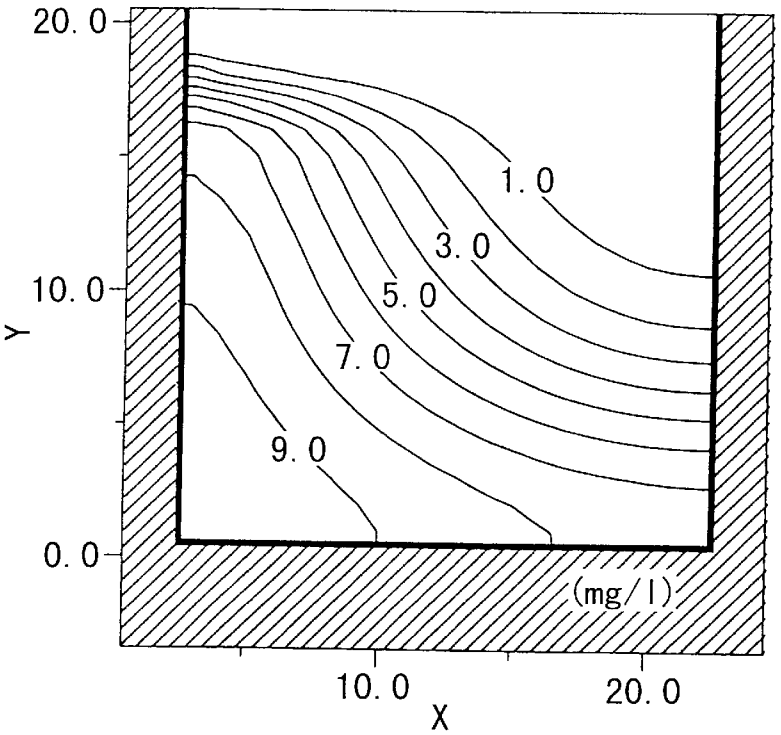
FIG. 60 is a view showing a calculational result of a contaminant distribution after 150 cycles (high tide).
Figure 61:
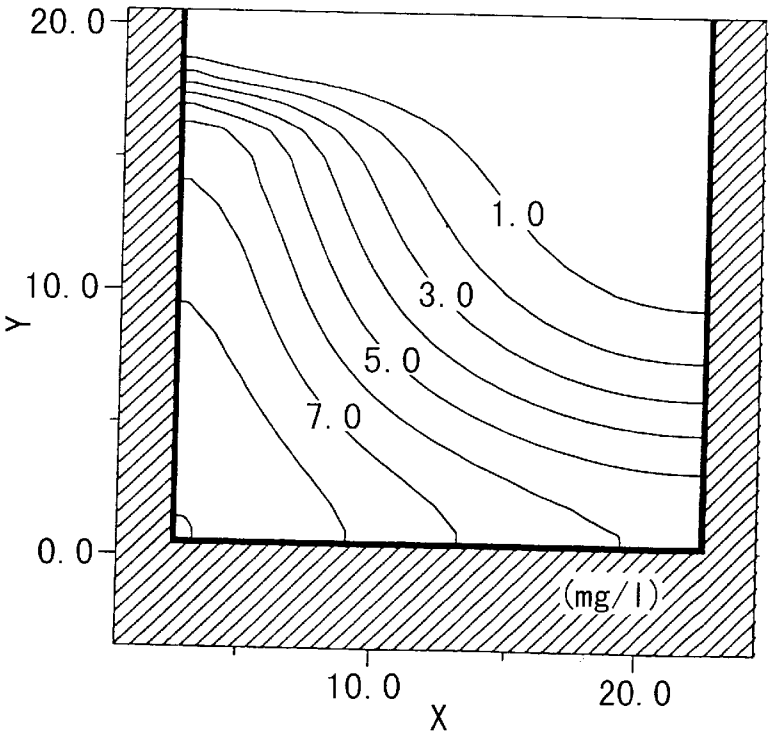
FIG. 61 is a view showing a calculational result of a contaminant distribution after 200 cycles (high tide).

Moreover, in the Case (3), FIG. 48 shows the result of computation of a tidal residual current and FIG. 49 shows the result of computation of a distribution of the concentration of the contaminants in a stationary state.

In the Case (3), as shown in FIG. 48, it is found that the tidal residual current is created in the manner as in the Case (2) as described hereinabove.

Further, as shown in FIG. 49, it is found that the contaminants flown into the bay from the contaminant-flowing locations 11, 11 is flown away from the bay into the outside of the bay by the tidal residual current in substantially the same manner as in the Case (2).

For each of the Cases (1), (2) and (3), a comparison of exchanges of sea water is made under the conditions as shown in Table 4 below.

FIGS. 50 to 53, inclusive, show each the result of computation of a distribution of the concentration of the contaminants in the Case (1) at the time of a high tide and they indicate each the result after 50 cycles, 100 cycles, 150 cycles and 200 cycles. In this case, one cycle is set to be a time duration from a high tide of tide oscillation movement to the next coming high tide.

As in the Case (1), FIGS. 54 to 57 show the results in the Case (2) and FIGS. 58 to 61 show the results in the Case (3).

Figure 62:
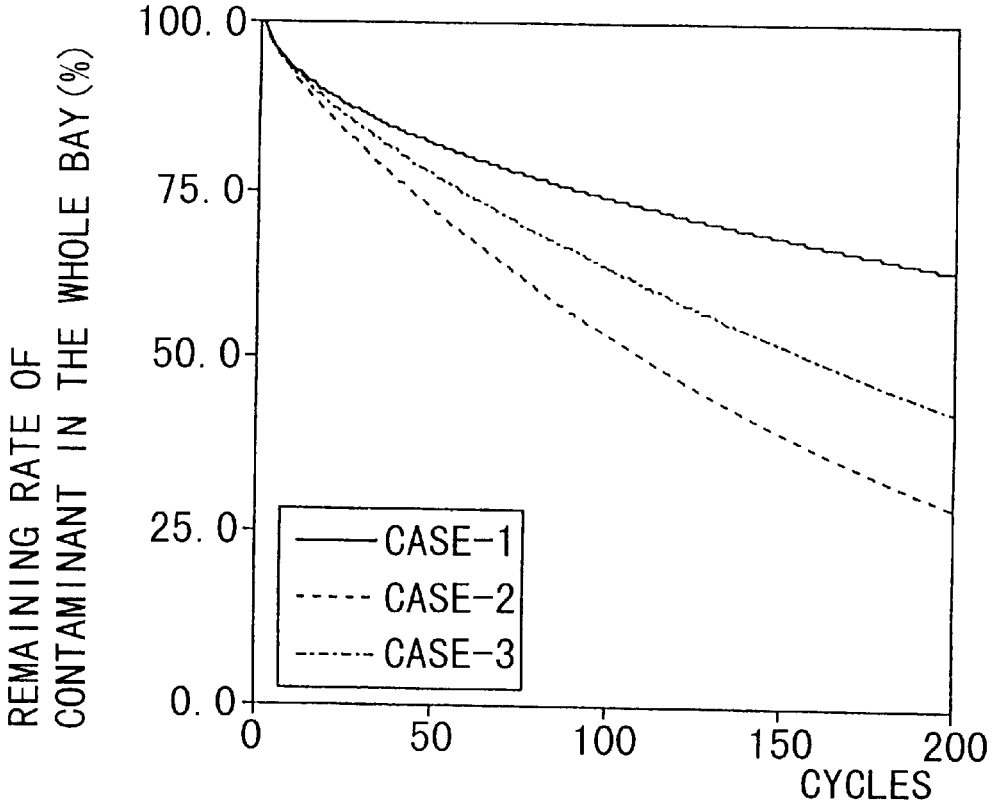
FIG. 62 is a graph showing a time series of a remaining rate of contaminants in the whole bay.

FIG. 62 indicates a variation in rates of residues of the contaminants retained in the bay. The results reveal that the Case (2) exhibited the lowest rate of the residues of the contaminants left in the bay and produced the highest efficiency of cleaning water quality.

(Second Embodiment)

In the second embodiment of the present invention, Cases (1') and (2') are set, respectively, such that the conditions of the Cases (1) and (2) in the first embodiment are modified and a model is evaluated for tide flow, tidal residual current and a distribution of the concentration of contaminants and pollutants in the Cases (1') and (2').

The conditions for computation are modified such that, while the depth of water is set constant to h=10 meter, the bottom surface friction coefficient is set to be $\gamma^2_b$=0.0026 and the Manning's roughness coefficient is set to be n=0.0239, in the Case (1').

Further, in the Case (2'), the bottom surface friction coefficient and the Manning's roughness coefficient are set as will be indicated in Table 5.

In each of the Cases (1') and (2'), the results of computation obtained on the basis of the computation conditions as described hereinabove will be described hereinafter.

Figure 63:
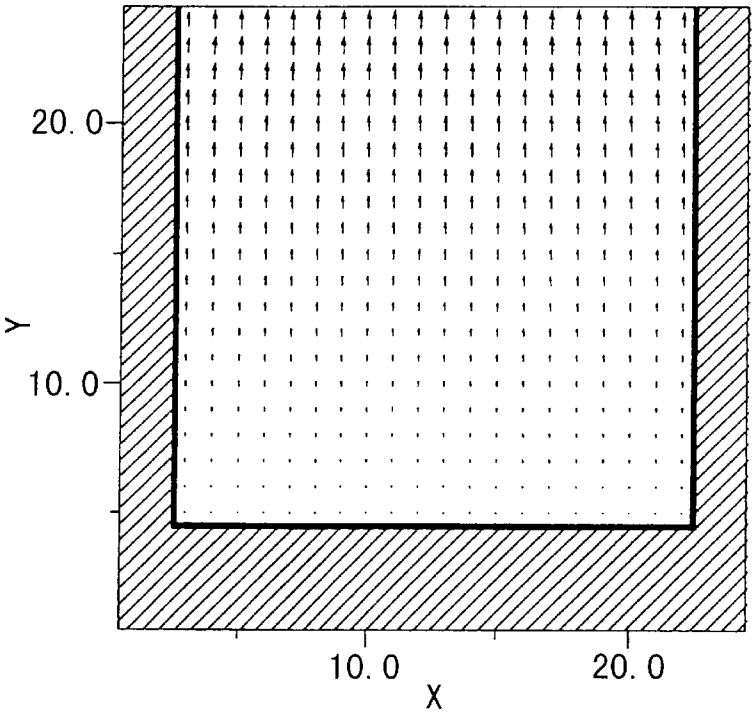
FIG. 63 is a view showing a calculational result of a tidal current simulation (maximum ebb tide).
Figure 64:
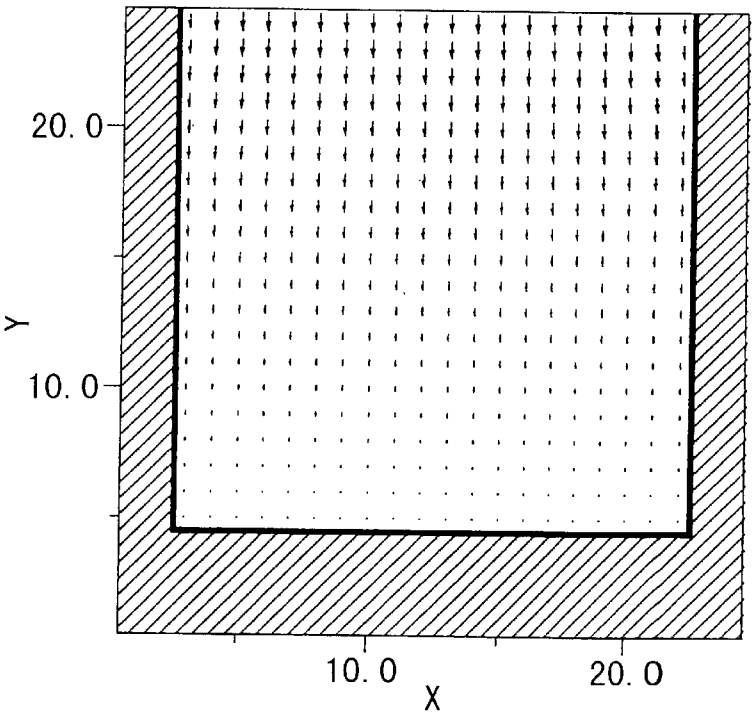
FIG. 64 is a view showing a calculational result of a tidal current simulation (maximum flood tide).

More specifically, the results of computation of the tide current in the Case (2') are shown in FIGS. 63 and 64, in which FIG. 63 indicates the time of maximum ebb tide and FIG. 64 indicates the time of maximum flood tide.

Figure 66:
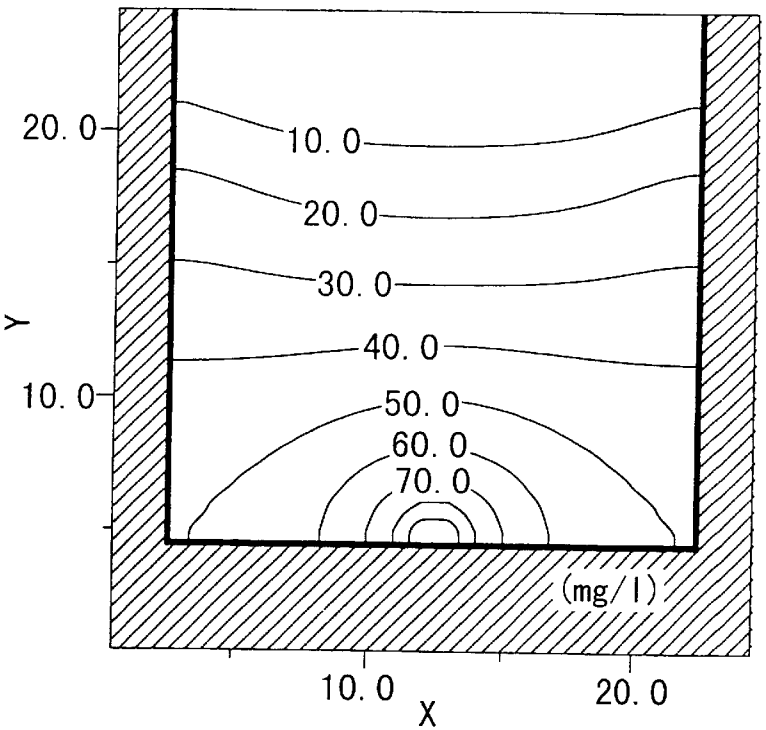
FIG. 66 is a view showing a calculational result of a contaminant distribution (in a stationary state).
Figure 65:
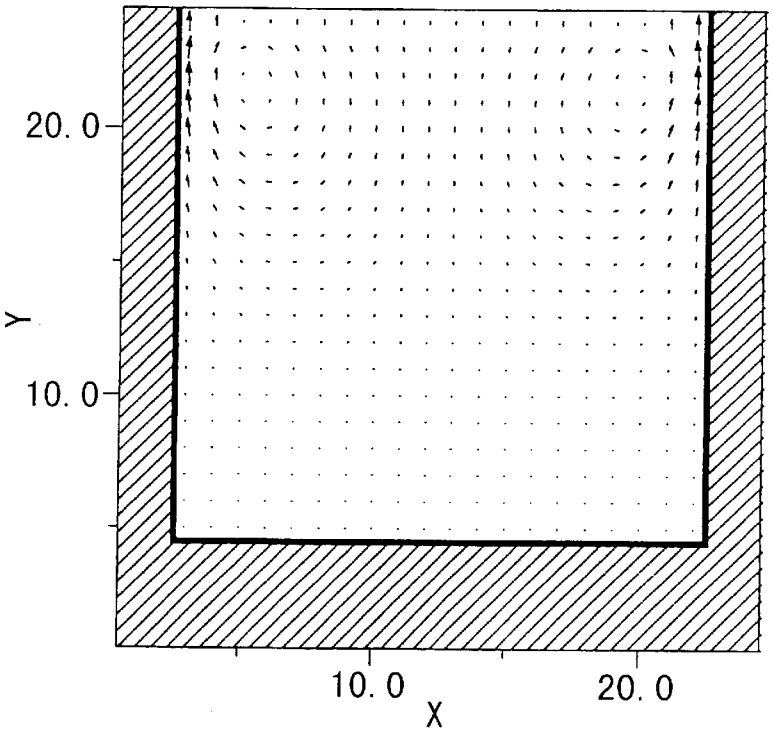
FIG. 65 is a view showing a calculational result of a tidal current simulation.

Further, FIG. 65 shows the result of computation of tidal residual current and FIG. 66 shows the result of computation of a distribution of the concentration of the contaminants in a stationary state.

The conditions for computation of the roughness coefficient of the roughness on the forward current side and the backward current side and for the sea bottom friction coefficient in the water areas A and B are set as shown in Table 2 below. Further, in the water areas A and B. there is provided a difference in directional roughness in the direction opposite to each other.

FIG. 41 shows Case (3), in which the model bay 10 is divided into four sea areas, that is, a left-sided water area A, a central water area B, a right-sided water area C, and a rear-sided water area D. The conditions for the computation of the roughness coefficient of the roughness on the forward current side and the backward current side and for the sea bottom friction coefficient in the water areas A, B, C and D are set as shown in Table 3 below. Further, in the water areas A, B, C and D, there is provided a difference in directional roughness in the direction opposite to each other.

It is to be noted herein that in the water area D the water flow (U<0) from the right side to the left side is referred to as 'forward current' and the water flow (U>0) in the opposite direction is referred to as 'backward current'.

In each of the Cases (1), (2) and (3), the amount of the contaminants to be added at the two locations 11, 11 is set to amount to 500 grams. The computation results in the Cases (1), (2) and (3) obtained under the conditions as described hereinabove are shown below.

More specifically, the results of computation of a tide flow in the Case (1) are shown in FIGS. 42 and 43, in which FIG. 42 indicates the case of maximum ebb tide and FIG. 43 indicates the case of maximum flood tide. Further, FIG. 44 shows the result of computation of a tidal residual current and FIG. 45 shows the result of computation of a distribution of the concentration of the contaminants in a stationary state.

In the Case (1), as shown in FIG. 44, a strong tidal residual current is little created. Further, as shown in FIG. 45, it is found that a majority of the contaminants flown from the contaminant-flowing locations 11, 11 is caused to be retained in the position nearby the contaminant-flowing locations 11, 11 from which they are flown. Then, FIG. 46 shows the result of computation of a tidal residual current and FIG. 47 shows the result of computation of a distribution of the concentration of the contaminants in a stationary state.

In the Case (2), as shown in FIG. 46, it is found that a tidal residual current is created in a generally U-letter shape flowing from the right side of the bay entrance through the right side of the rear bay portion and the left side of the rear bay portion to the left side of the bay entrance.

Further, as shown in FIG. 47, it is found that the contaminants is flown from the bay into the outside of the bay efficiently by the tidal residual current because the concentration of the contaminants flown at the contaminant-flowing locations 11, 11 from which they were flown in was made lower in the water areas A and B on the rear bay sides than the water area nearby the contaminant-flowing locations 11, 11.

Moreover, in the Case (3), FIG. 48 shows the result of computation of a tidal residual current and FIG. 49 shows the result of computation of a distribution of the concentration of the contaminants in a stationary state.

In the Case (3), as shown in FIG. 48, it is found that the tidal residual current is created in the manner as in the Case (2) as described hereinabove.

Further, as shown in FIG. 49, it is found that the contaminants flown into the bay from the contaminant-flowing locations 11, 11 are flown away from the bay into the outside of the bay by the tidal residual current in substantially the same manner as in the Case (2).

Then, for each of the Cases (1), (2) and (3), a comparison of exchanges of sea water is made under the conditions as shown in Table 4 below.

FIGS. 50 to 53, inclusive, show each the result of computation of a distribution of the concentration of the contaminants in the Case (1) at the time of a high tide and they indicate each the result after 50 cycles, 100 cycles, 150 cycles and 200 cycles. In this case, one cycle is set to be a time duration from a high tide of a tidal oscillation movement to the next coming high tide.

As in the Case (1), FIGS. 54 to 57 show the results for the Case (2) and FIGS. 58 to 61 show the results for the Case (3).

FIG. 62 indicates a variation in remaining rates of residues of the contaminants retained in the bay. The results reveal that the Case (2) exhibited the lowest remaining rate of the residues of the contaminants retained in the bay and attained the highest efficiency in cleaning water quality.

(Second Embodiment)

In the second embodiment of the present invention, Cases (1') and (2') are set, respectively, such that the conditions of the Cases (1) and (2) in the first embodiment are modified and a model is evaluated for a tidal flow, a tidal residual current and a distribution of the concentration of contaminants and pollutants in the Cases (1') and (2').

The conditions for computation are modified such that, while the depth of water is set constant to h=10 meter, the bottom surface friction coefficient is set to be $\gamma^2_b$=0.0026 and the Manning's roughness coefficient is set to be n=0.0239, in the Case (1'). Further, in the Case (2'), the bottom surface friction coefficient and the Manning's roughness coefficient are set as will be indicated in Table 5 below.

In each of the Cases (1') and (2'), the results of computation obtained on the basis of the computation conditions as described hereinabove will be described hereinafter.

More specifically, the results of computation of the tidal current in the Case (2') are shown in FIGS. 63 and 64, in which FIG. 63 indicates the time of maximum ebb tide and FIG. 64 indicates the time of maximum flood tide.

Further, FIG. 65 shows the result of computation of the tidal residual current and FIG. 66 shows the result of computation of the distribution of the concentration of the contaminants in a stationary state.

In the Case (1'), it is found from FIG. 65 that the tidal residual current is created to a slight extent on the left and right sides of the bay and further from FIG. 66 that a majority of the contaminants flown from the contaminant-flowing locations 11, 11 is retained near the contaminant-flowing locations 11, 11.

Figure 68:
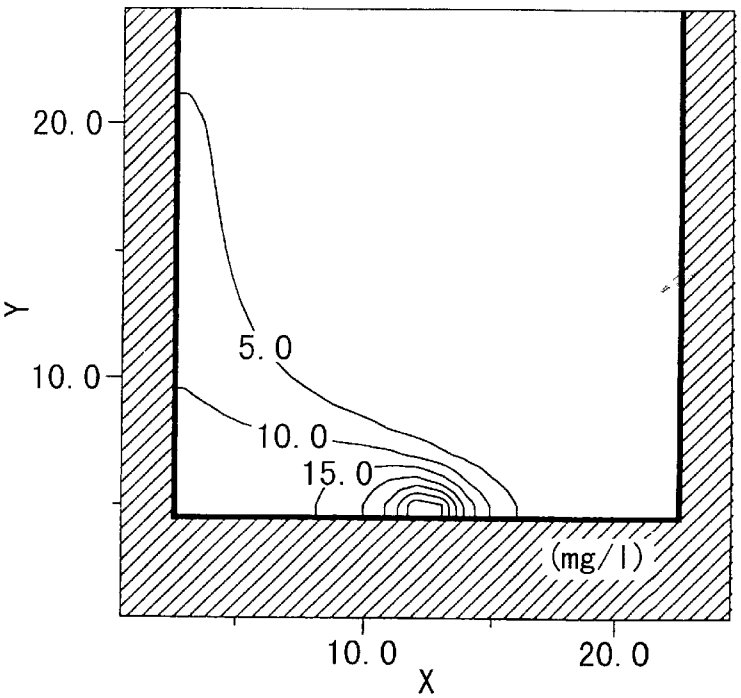
FIG. 68 is a view showing a calculational result of a contaminant distribution (in a stationary state).
Figure 67:
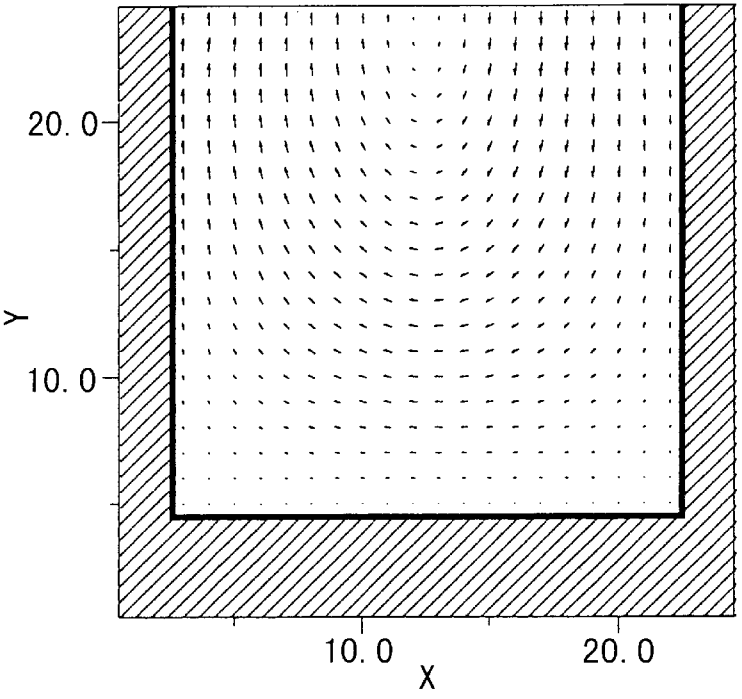
FIG. 67 is a view showing a calculational result of a tidal current simulation (tidal residual current).
Figure 69:
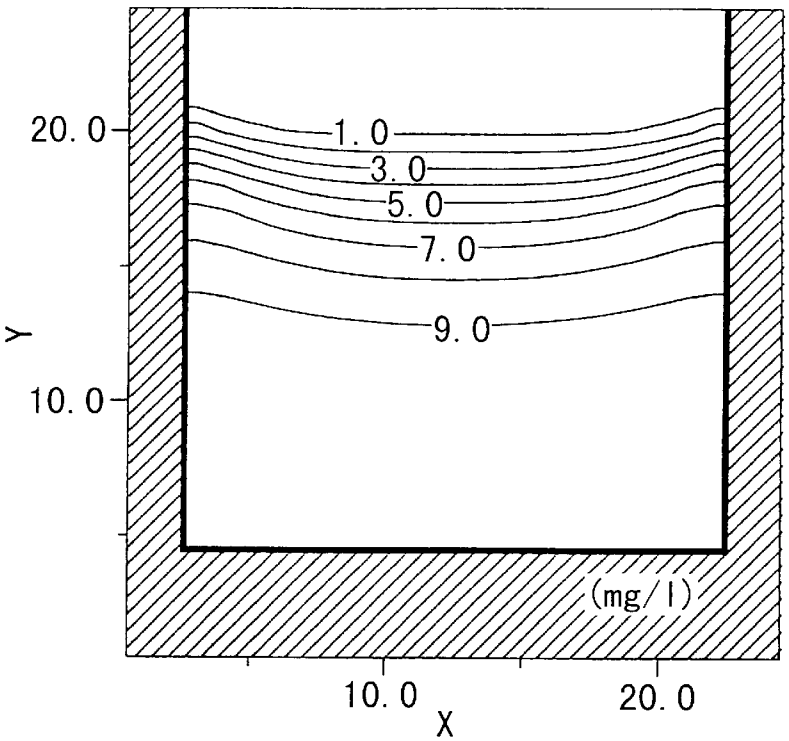
FIG. 69 is a view showing a calculational result of a contaminant distribution after 50 cycles (high tide).
Figure 70:
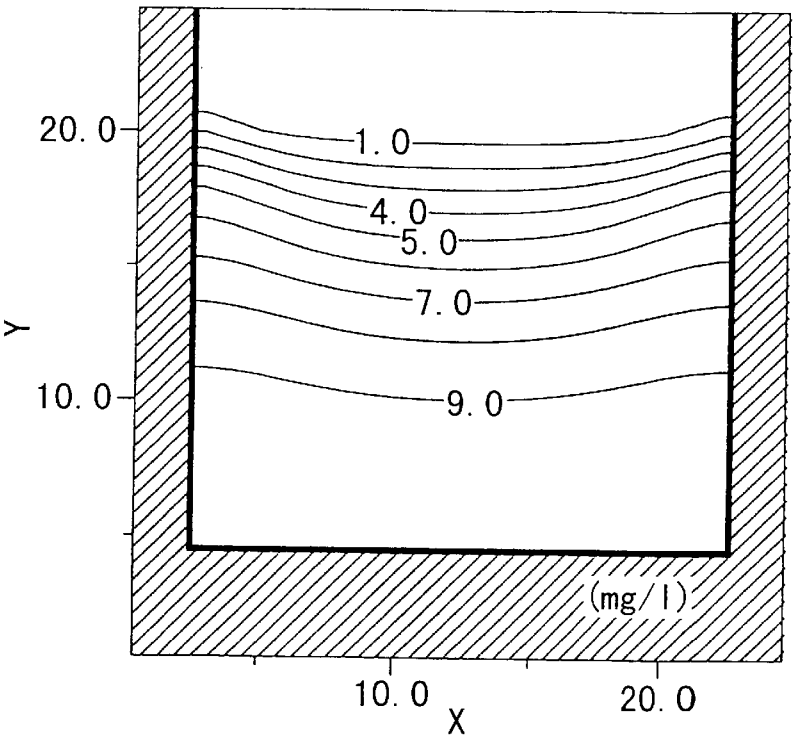
FIG. 70 is a view showing a calculational result of a contaminant distribution after 100 cycles (high tide).
Figure 72:
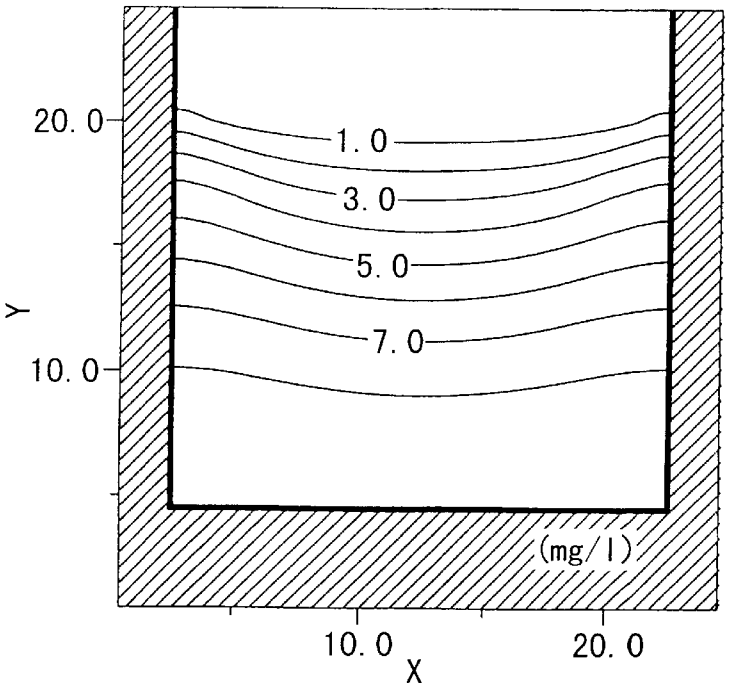
FIG. 72 is a view showing a calculational result of a contaminant distribution after 200 cycles (high tide).
Figure 71:
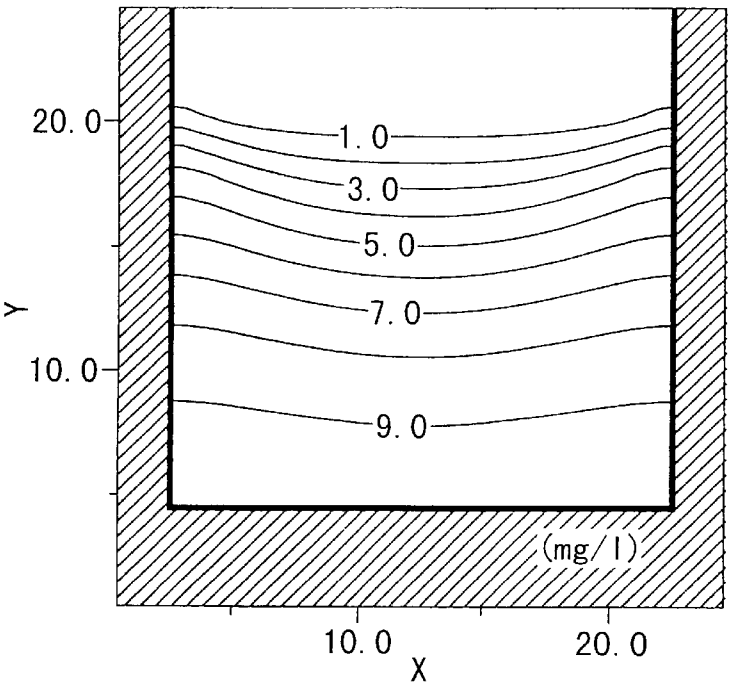
FIG. 71 is a view showing a calculational result of a contaminant distribution after 150 cycles (high tide).
Figure 73:
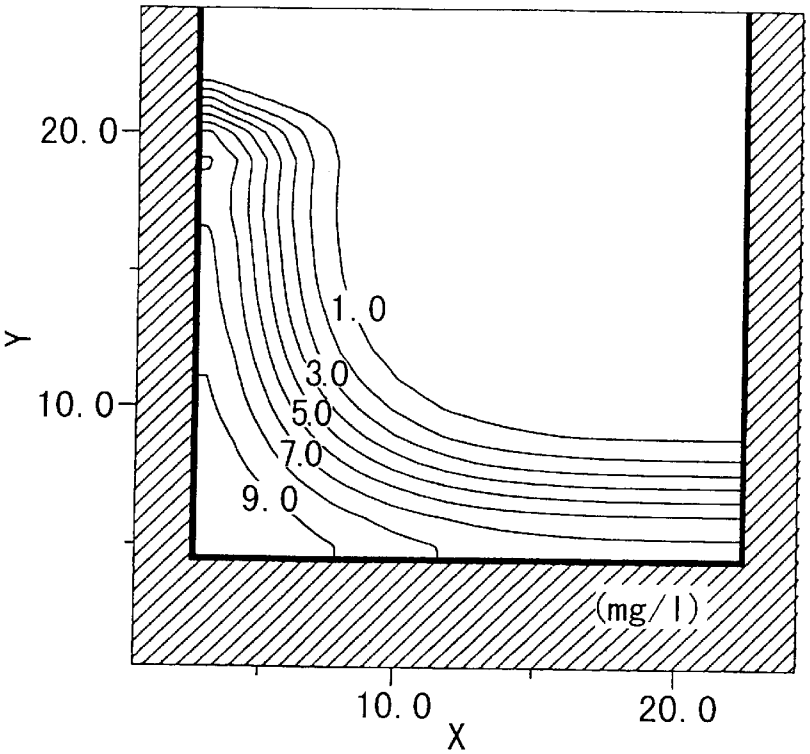
FIG. 73 is a view showing a calculational result of a contaminant distribution after 50 cycles (high tide).
Figure 74:
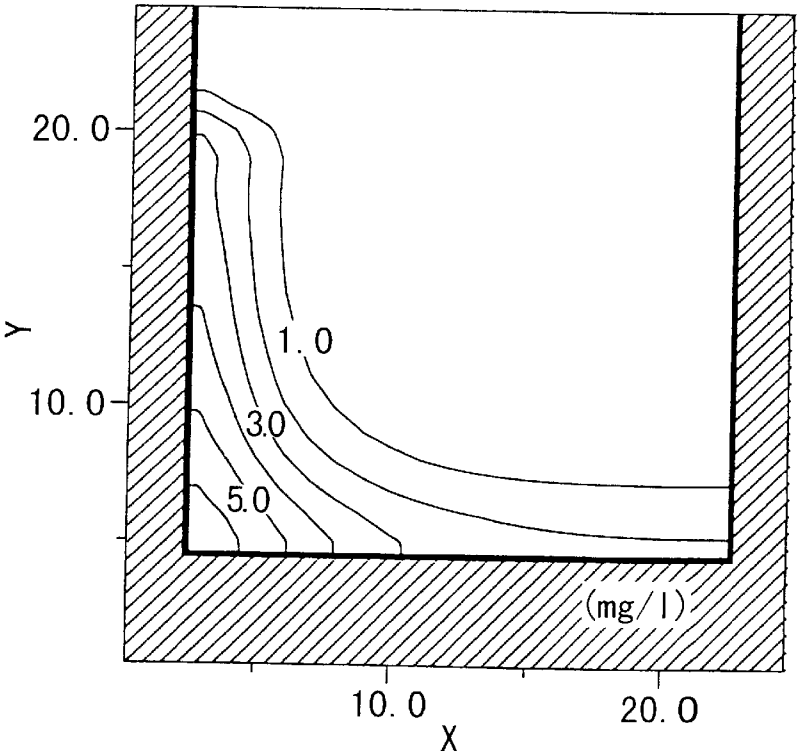
FIG. 74 is a view showing a calculational result of a contaminant distribution after 100 cycles (high tide).
Figure 76:
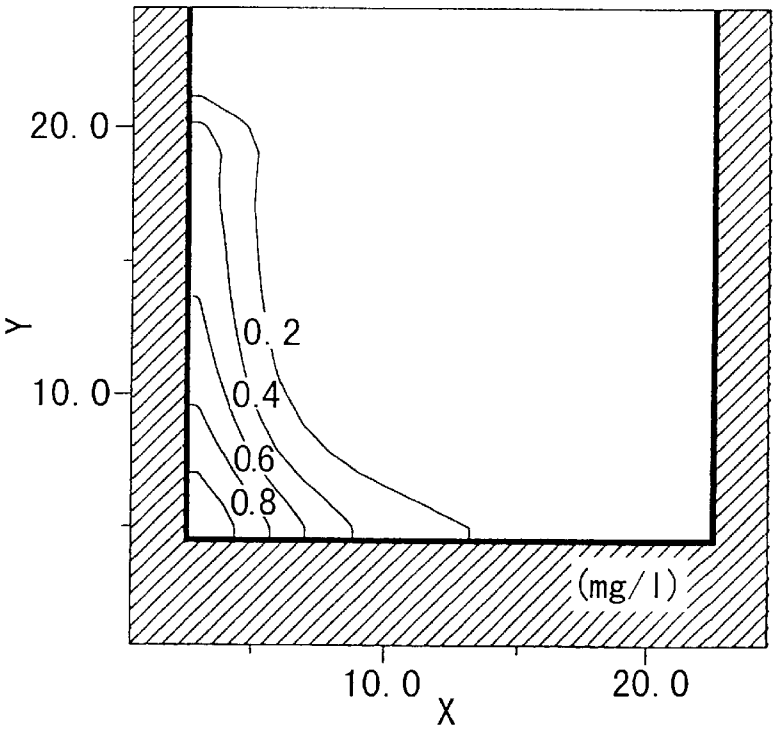
FIG. 76 is a view showing a calculational result of a contaminant distribution after 200 cycles (high tide).
Figure 75:
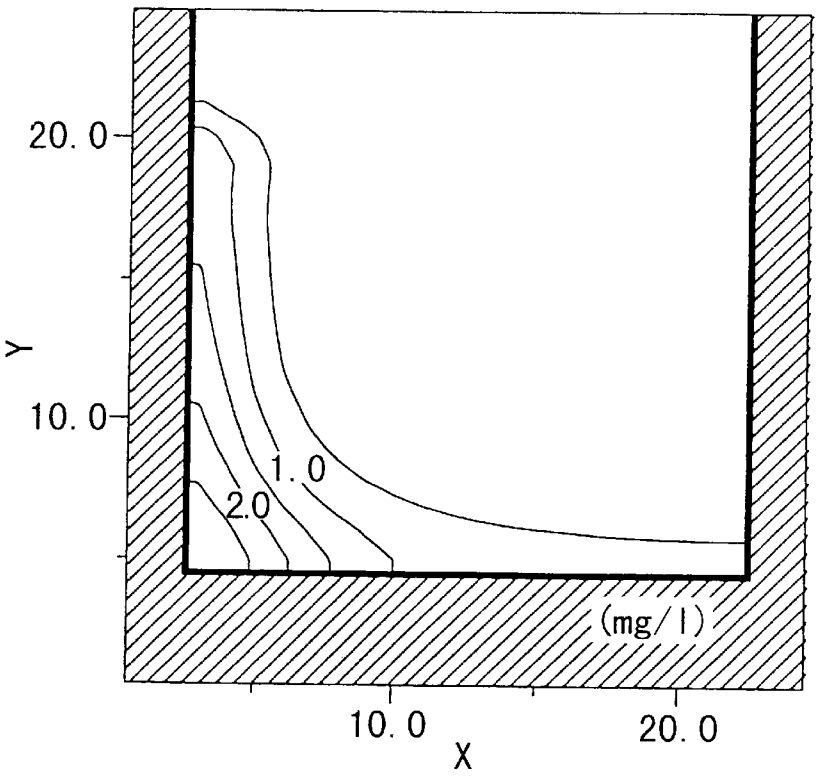
FIG. 75 is a view showing a calculational result of a contaminant distribution after 150 cycles (high tide).

Furthermore, for the Case (2'), FIG. 67 shows the result of computation of the tidal residual current and FIG. 68 shows the result of computation of the distribution of the concentration of the contaminants in a stationary state.

In the Case (2'), it is found from FIG. 67 that the tidal residual current is created in a generally U-letter shape in substantially the same manner as in the Case (2) above.

Moreover, as shown in FIG. 68, it is found that the contaminants flown from the contaminants-flowing locations 11, 11 can be removed in an efficient way outside from the bay by the action of the tidal residual current because the contaminants flown from the contaminant-flowing locations 11, 11 are distributed in a lower concentration over the rear bay portion in the water area A than at the contaminant-flowing locations 11, 11.

It is to be noted herein that the Cases (1') and (2') are subjected to the experiments for exchanges for sea water using a model bay under the conditions as shown in Table 4 in substantially the same as in the first embodiment.

FIGS. 69 to 72, inclusive, show each the result of computation of the distribution of the concentration of the contaminants in the Case (1') at the time of a high tide and they indicate each the result after 50 cycles, 100 cycles, 150 cycles and 200 cycles.

Like for the Case (1'), the results for the Case (2') are shown in FIGS. 73 to 76.

Figure 77:
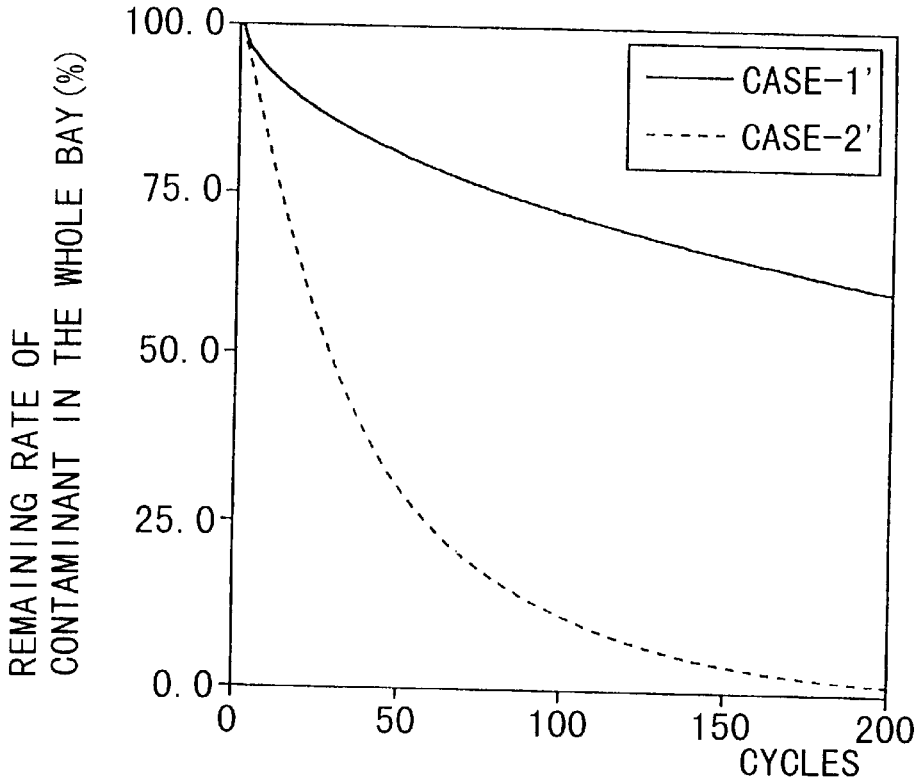
FIG. 77 is a graph showing a time series of a remaining rate of contaminants in the whole bay.

FIG. 77 indicates a periodical variation in remaining rates of residues of the contaminants retained in the bay. The results reveal that for the Case (2') the remaining rate of the residues of the contaminants left in the bay can be made substantially zero, thereby enabling the marked efficiency in cleaning water quality.

(Third Embodiment)

Figure 78:
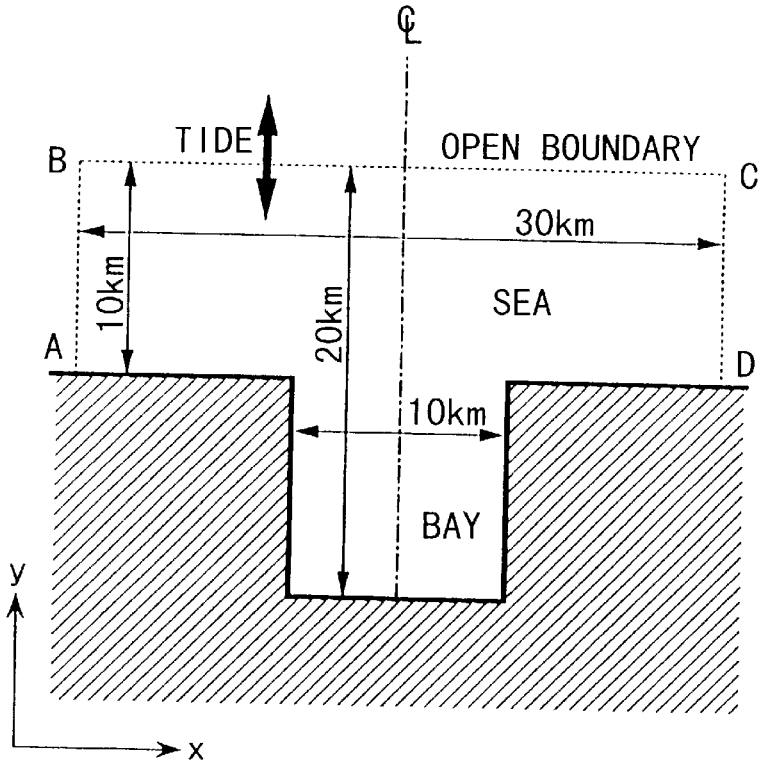
FIG. 78 is a view describing a model bay in accordance with a third embodiment of the present invention.

In the third embodiment, as shown in FIG. 78, a model bay is set for its open boundary to be expanded to the outside sea and a numerical analysis has been made under conditions as shown in Table 6 below.

Figure 79:
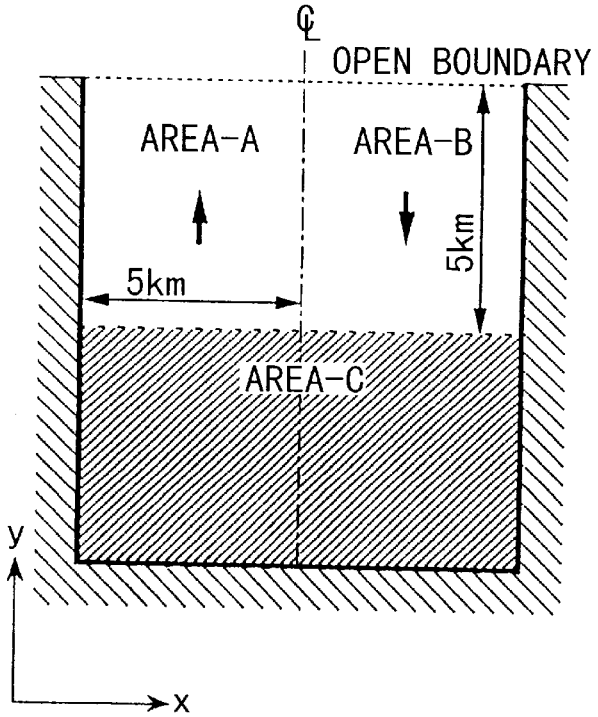
FIG. 79 is a view describing a model bay in accordance with model case 3' of the present invention.

FIG. 79 indicates Case (3') in which the model bay 10 is divided into two equal sections, that is, a bay entrance section and a rear bay section. Further, the bay entrance section is divided into a left half portion as referred to as water area A and a right half portion as referred to as water area B. The rear bay section is referred to as water area C.

Figure 80:
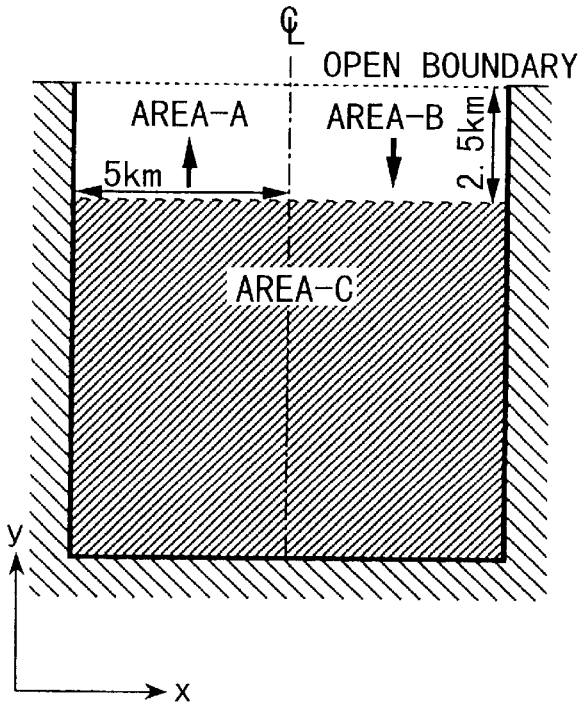
FIG. 80 is a view describing a model bay in accordance with model case 4' of the present invention.

FIG. 80 indicates Case (4'). In this Case (4'), the model bay 10 is divided into two sections, that is, a near bay entrance section close to the bay entrance (a ¼ width of the bay from the bay entrance to the rear of the bay) and a rear bay section. The near bay entrance section is further divided into a left half portion as referred to as water area A and a right half portion as referred to as water area B. The rear bay section is referred to as water area C.

Figure 81:
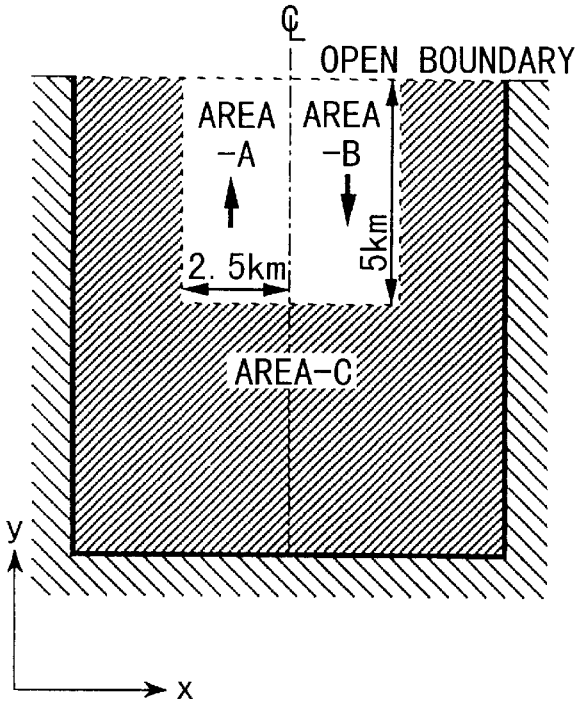
FIG. 81 is a view describing a model bay in accordance with model case 5' of the present invention.
Figure 82:
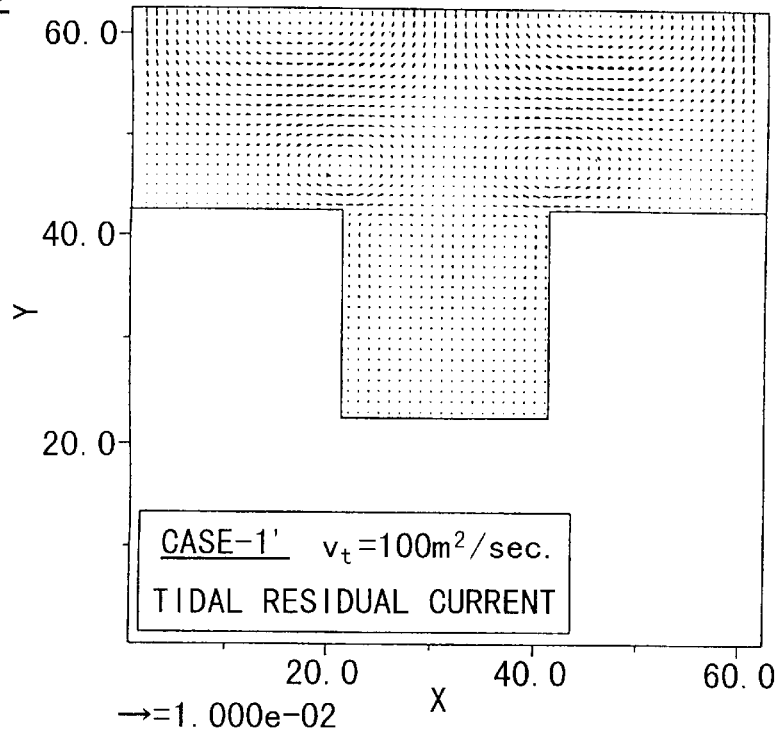
FIG. 82 is a view showing a calculational result of a tidal current simulation (tidal residual current) in accordance with model case 1' of the present invention.
Figure 83:
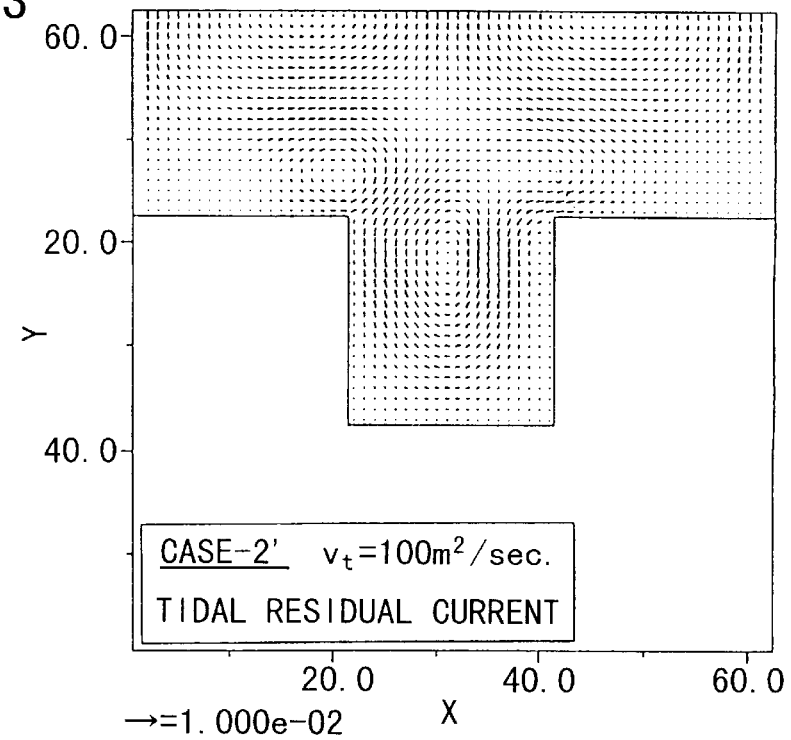
FIG. 83 is a view showing a calculational result of a tidal current simulation (tidal residual current) in accordance with model case 2' of the present invention.
Figure 84:
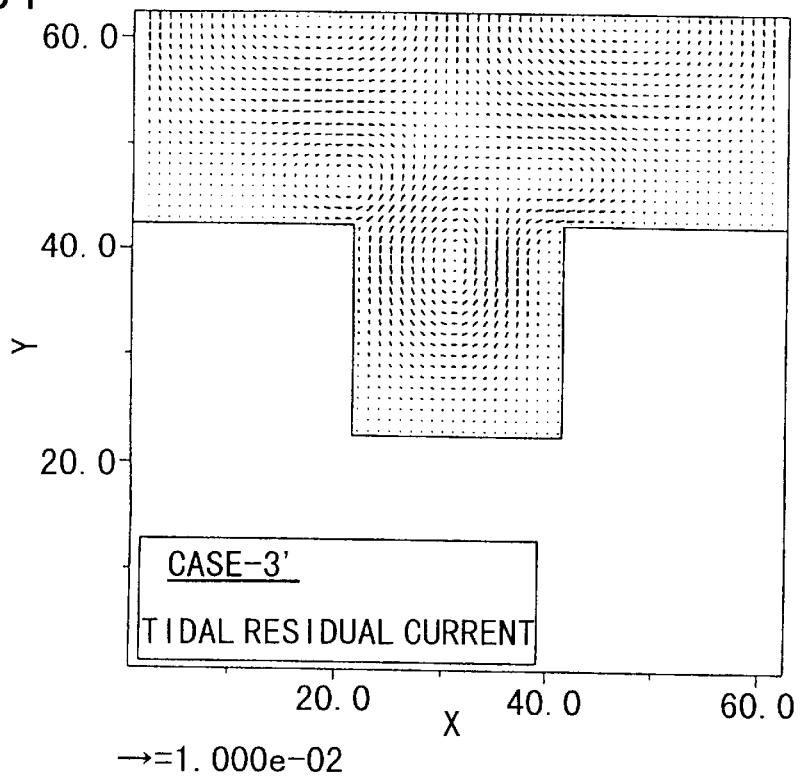
FIG. 84 is a view showing a calculational result of a tidal current simulation (tidal residual current) in accordance with model case 3' of the present invention.
Figure 85:
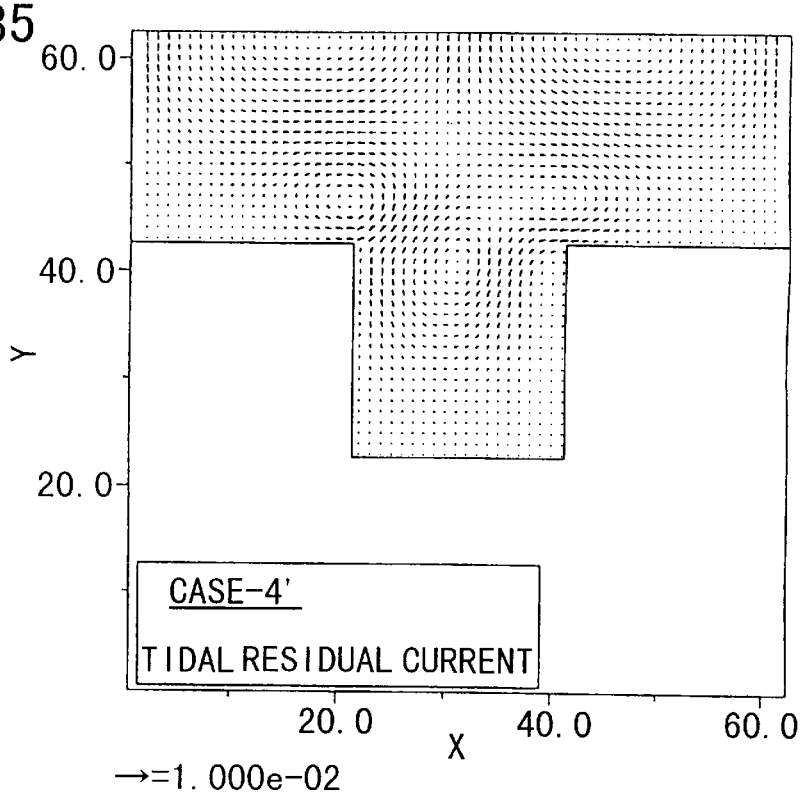
FIG. 85 is a view showing a calculational result of a tidal current simulation (tidal residual current) in accordance with model case 4' of the present invention.
Figure 86:
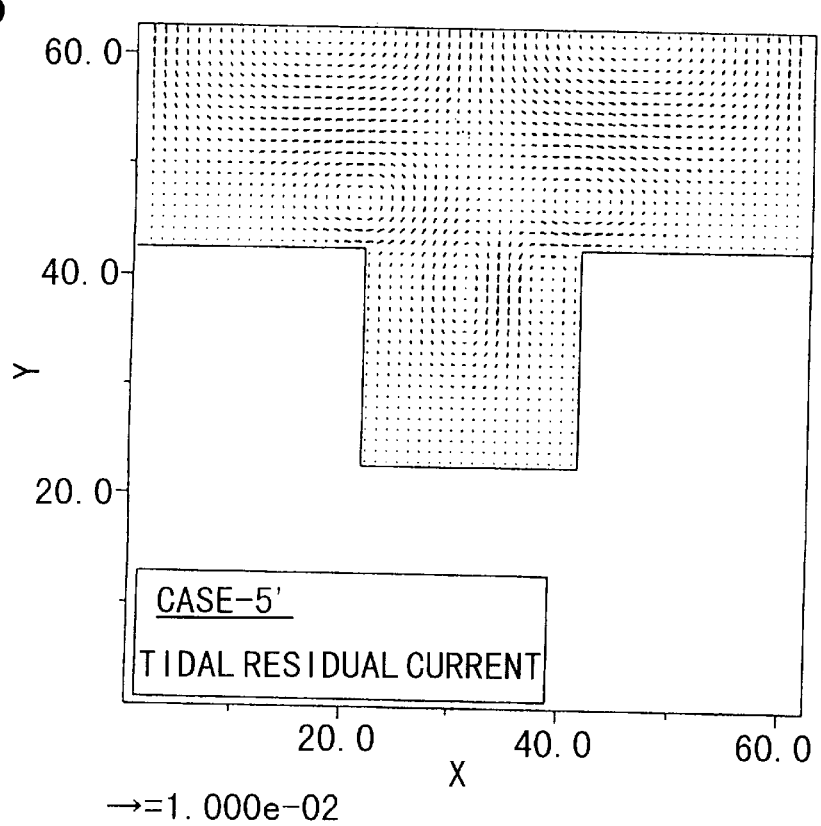
FIG. 86 is a view showing a calculational result of a tidal current simulation (tidal residual current) in accordance with model case 5' of the present invention.
Figure 87:
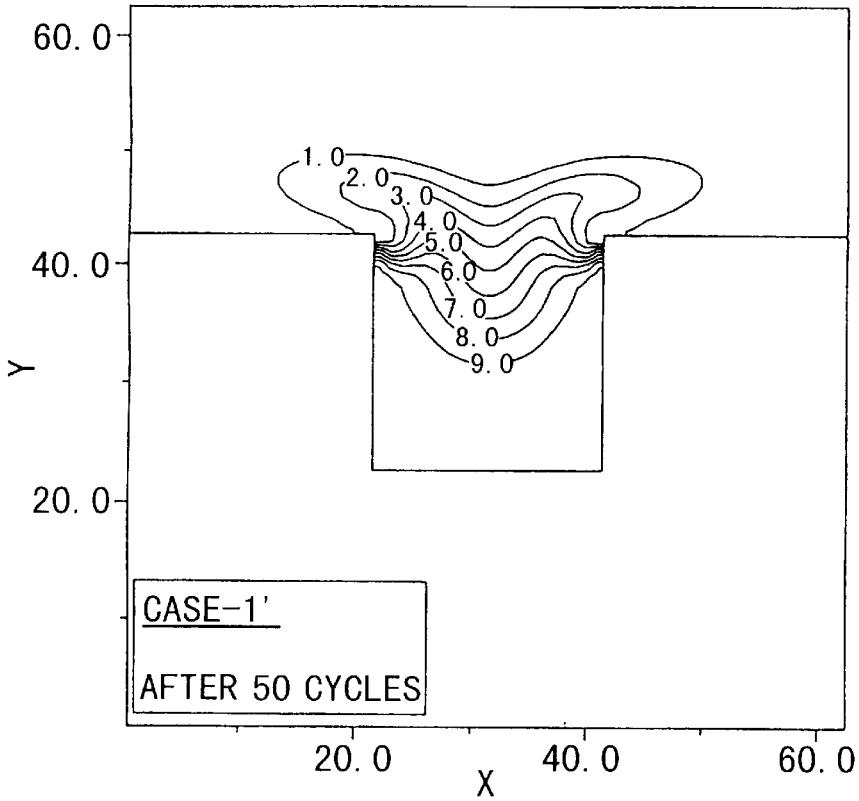
FIG. 87 is a view showing a calculational result of a contaminant distribution after 50 cycles (high tide).
Figure 88:
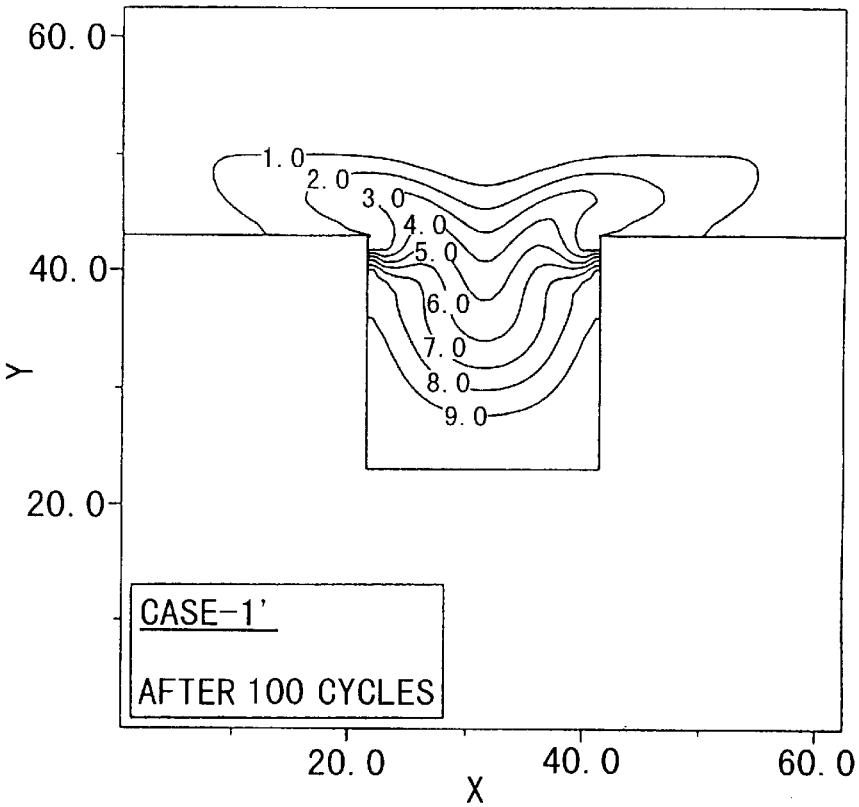
FIG. 88 is a view showing a calculational result of a contaminant distribution after 100 cycles (high tide).
Figure 89:
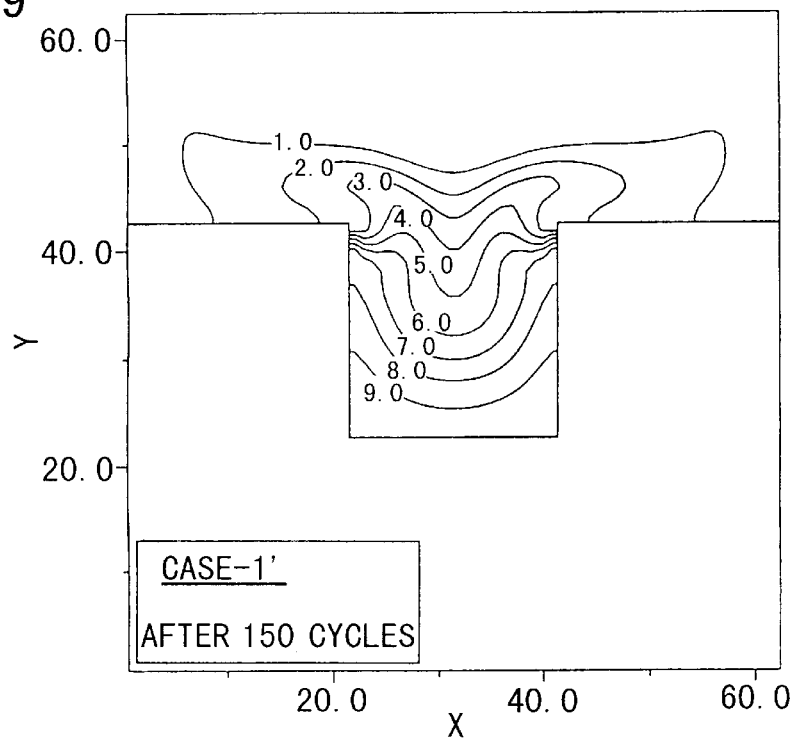
FIG. 89 is a view showing a calculational result of a contaminant distribution after 150 cycles (high tide).
Figure 90:
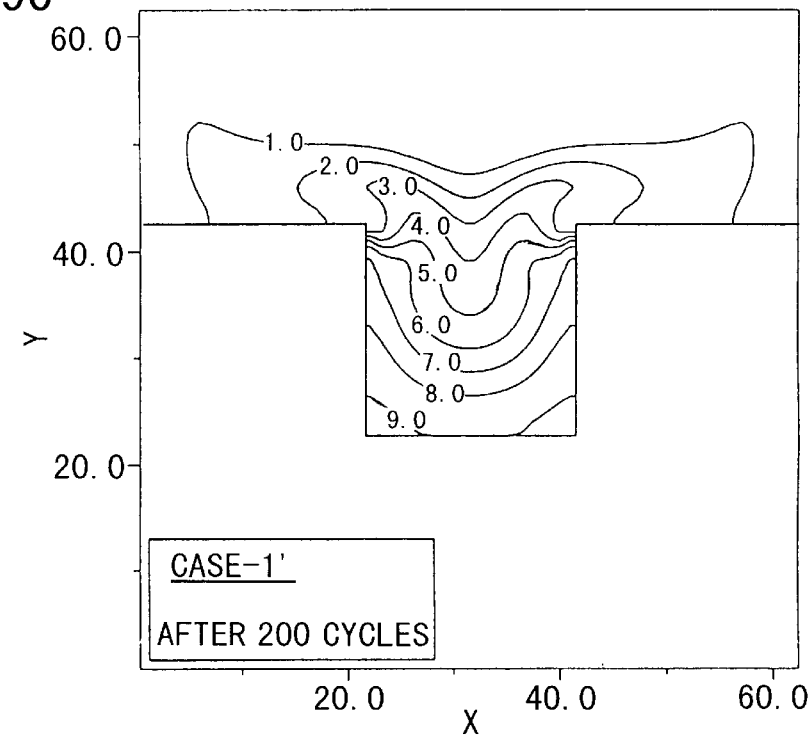
FIG. 90 is a view showing a calculational result of a contaminant distribution after 200 cycles (high tide).
Figure 91:
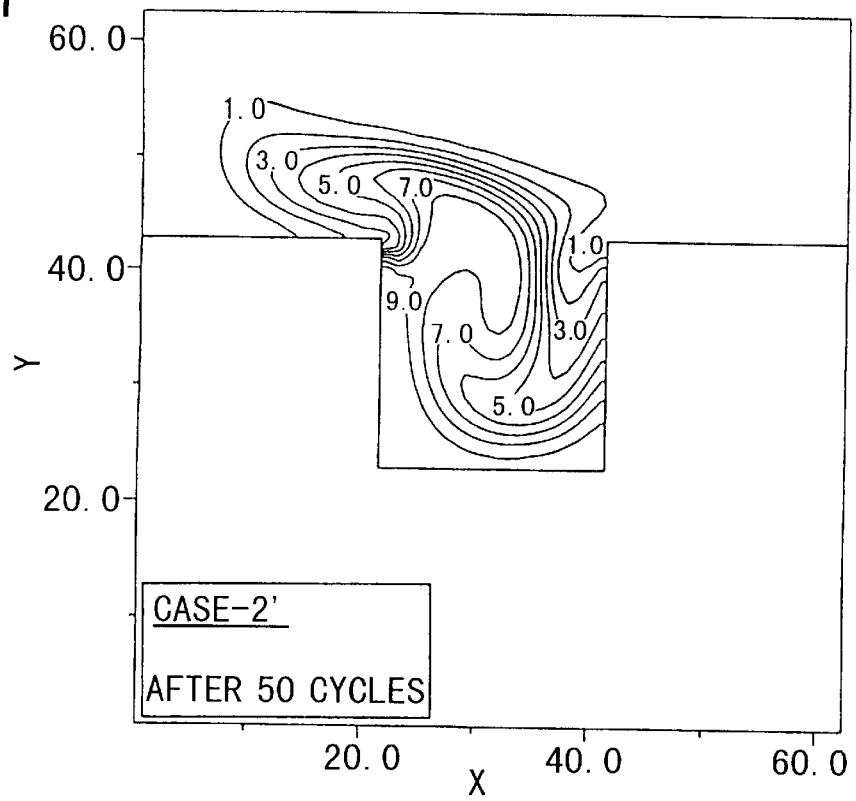
FIG. 91 is a view showing a calculational result of a contaminant distribution after 50 cycles (high tide).
Figure 92:
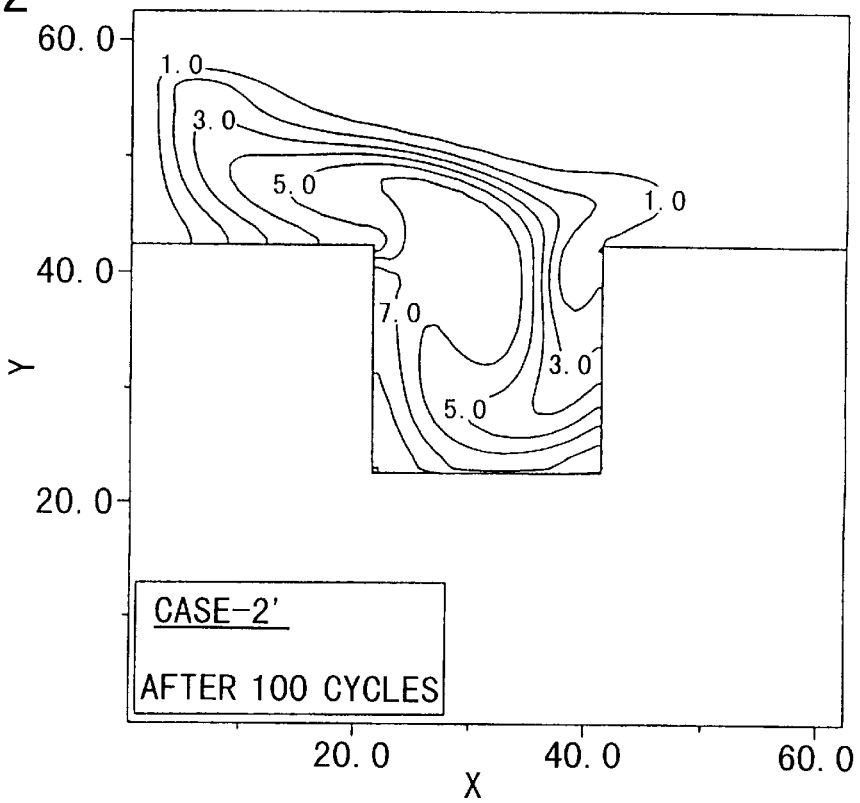
FIG. 92 is a view showing a calculational result of a contaminant distribution after 100 cycles (high tide).
Figure 93:
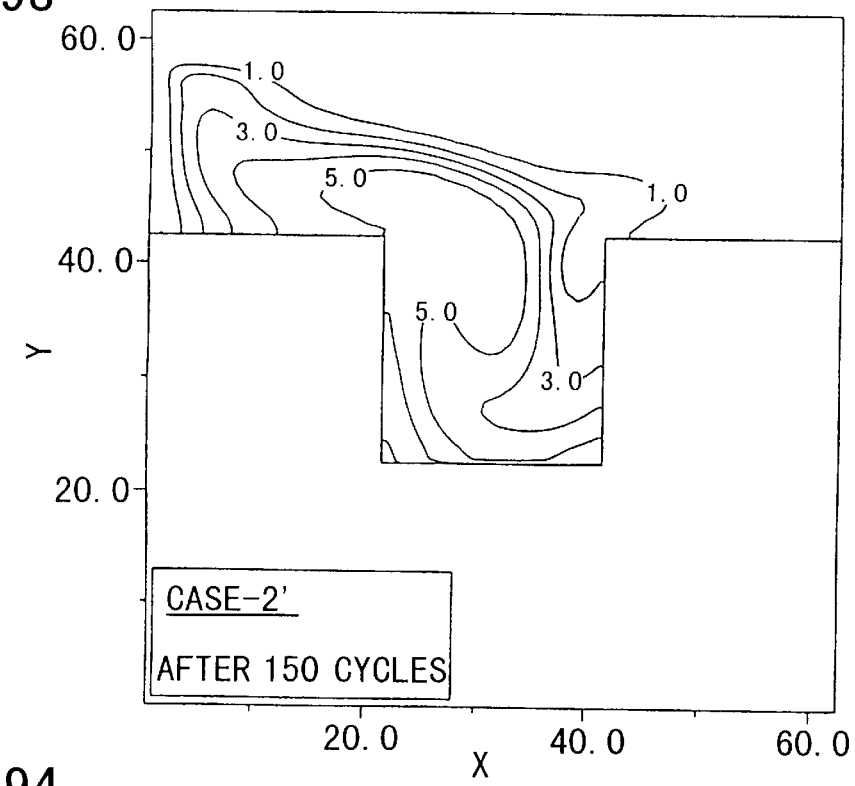
FIG. 93 is a view showing a calculational result of a contaminant distribution after 150 cycles (high tide).
Figure 94:
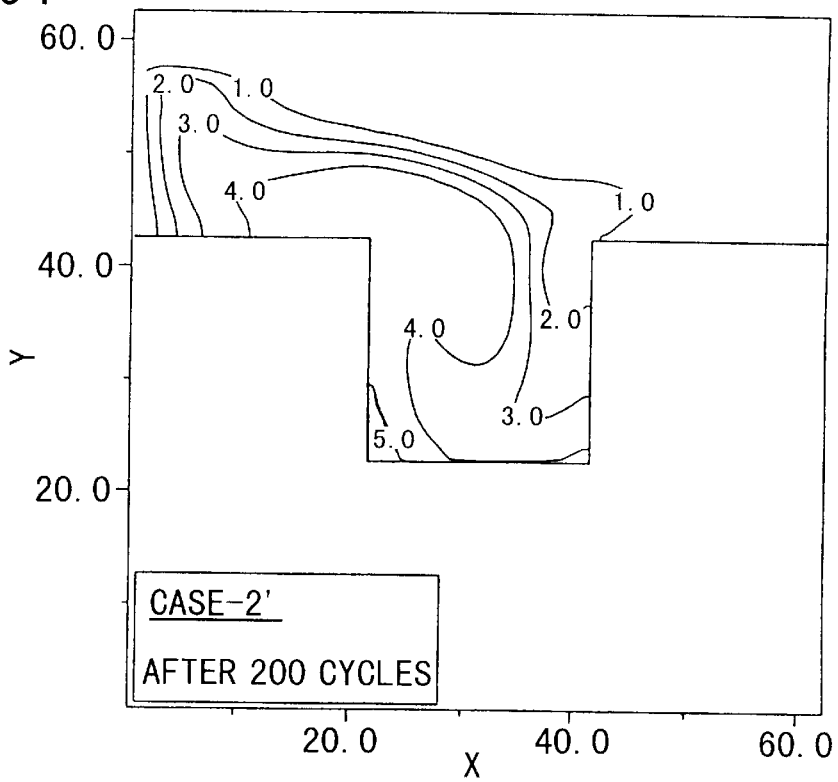
FIG. 94 is a view showing a calculational result of a contaminant distribution after 200 cycles (high tide).
Figure 95:
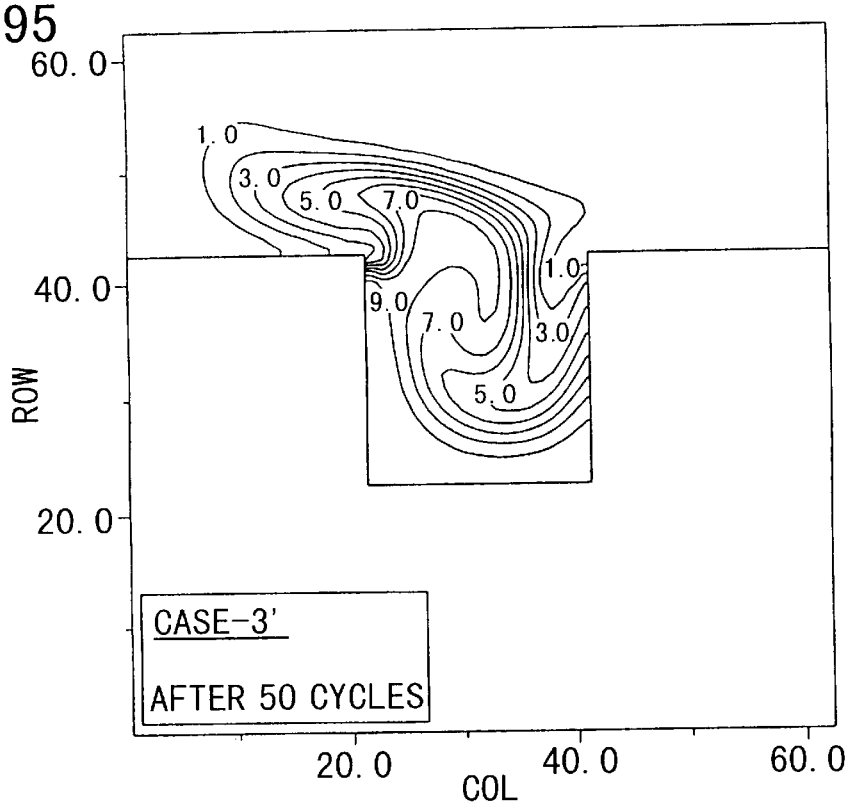
FIG. 95 is a view showing a calculational result of a contaminant distribution after 50 cycles (high tide).
Figure 96:
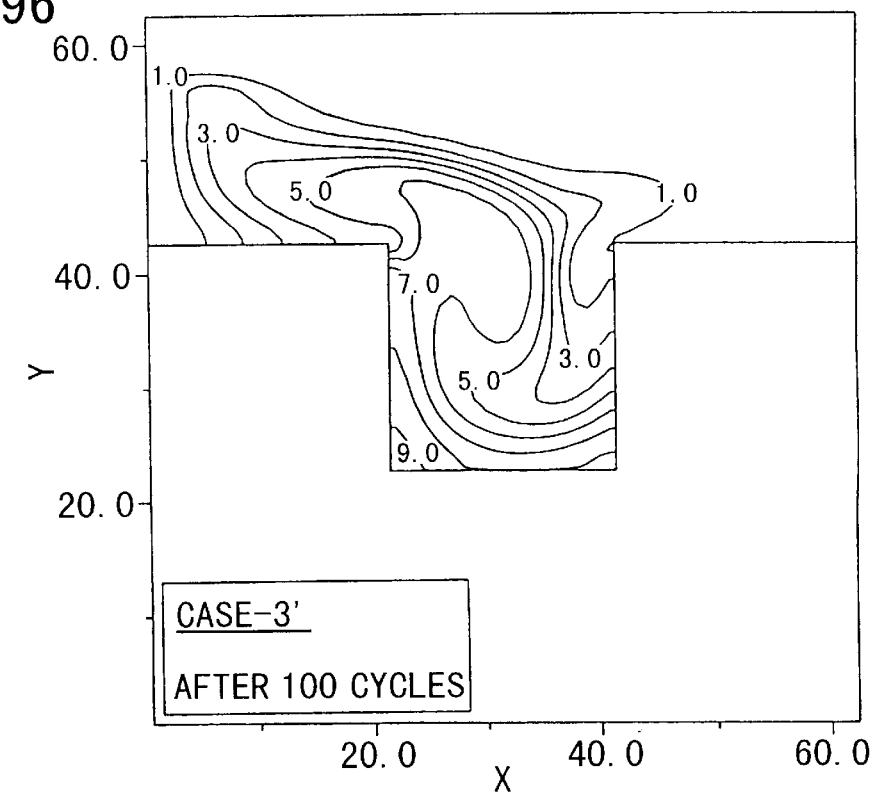
FIG. 96 is a view showing a calculational result of a contaminant distribution after 100 cycles (high tide).
Figure 97:
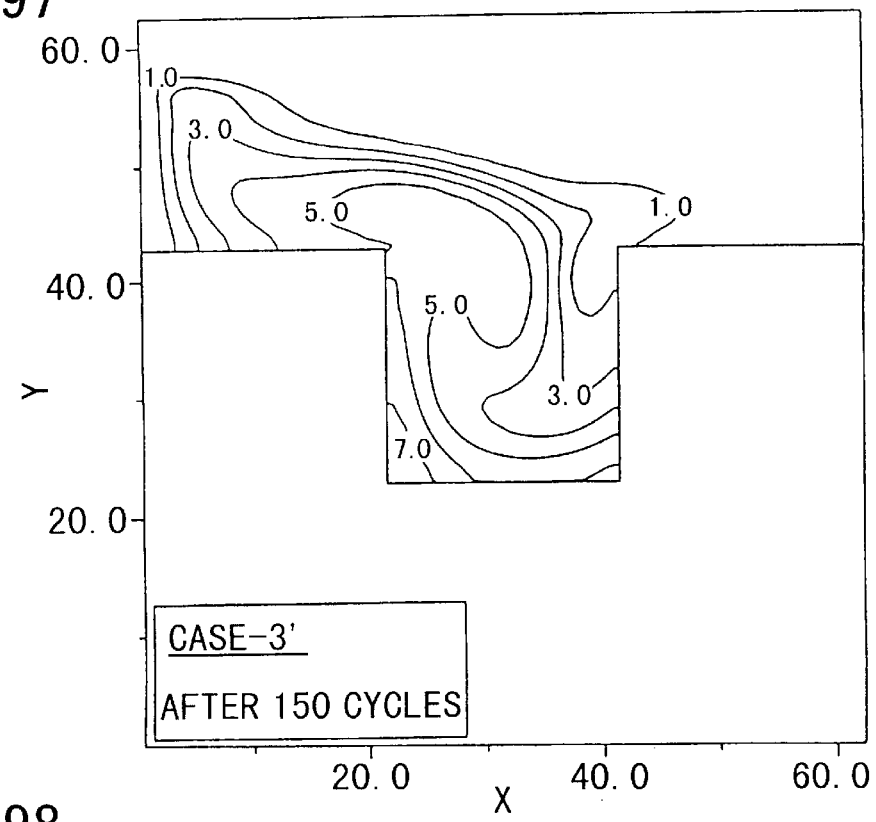
FIG. 97 is a view showing a calculational result of a contaminant distribution after 150 cycles (high tide).
Figure 98:
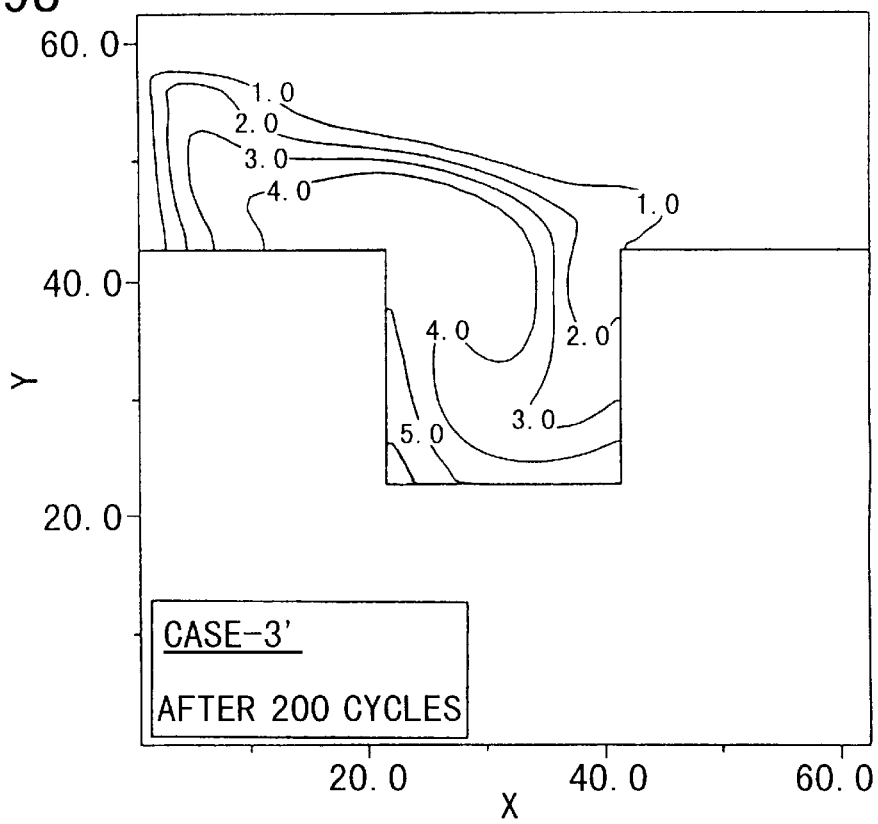
FIG. 98 is a view showing a calculational result of a contaminant distribution after 200 cycles (high tide).

FIG. 81 indicates Case (5') in which the water area A in the Case (3') is further divided into a left half portion as referred to as water area C and a right half portion as referred to as water area C.

In each of the Cases (3'), (4') and (5'), the bottom surface friction coefficient and the Manning's roughness coefficient are set as shown in Table 7 below.

Then, a description will be made of the results of computation obtained on the basis of the conditions for computation as described hereinabove for each of the Cases (1'), (2'), (3'), (4') and (5').

More specifically, FIGS. 82 to 86 indicate each the result of computation of the tidal residual current for the Cases (1'), (2'), (3'), (4') and (5'), respectively.

From the results, it is found that the tidal residual current in each of the Cases (2'), (3'), (4') and (5') is created in a substantially equal state.

Moreover, in order to make an investigation of the extent to which sea water in the bay is exchanged for sea water outside the bay, the distribution of the concentration of the contaminants retained in the bay is computed for each of the Cases (1'), (2') and (3') under the conditions that the contaminants are supplied in a constant concentration (C=10.0 mg/liter) to the inside of the bay at the initial time. The results after 50 cycles, 100 cycles, 150 cycles and 200 cycles for each case are shown in FIGS. 87 to 98.

Figure 99:
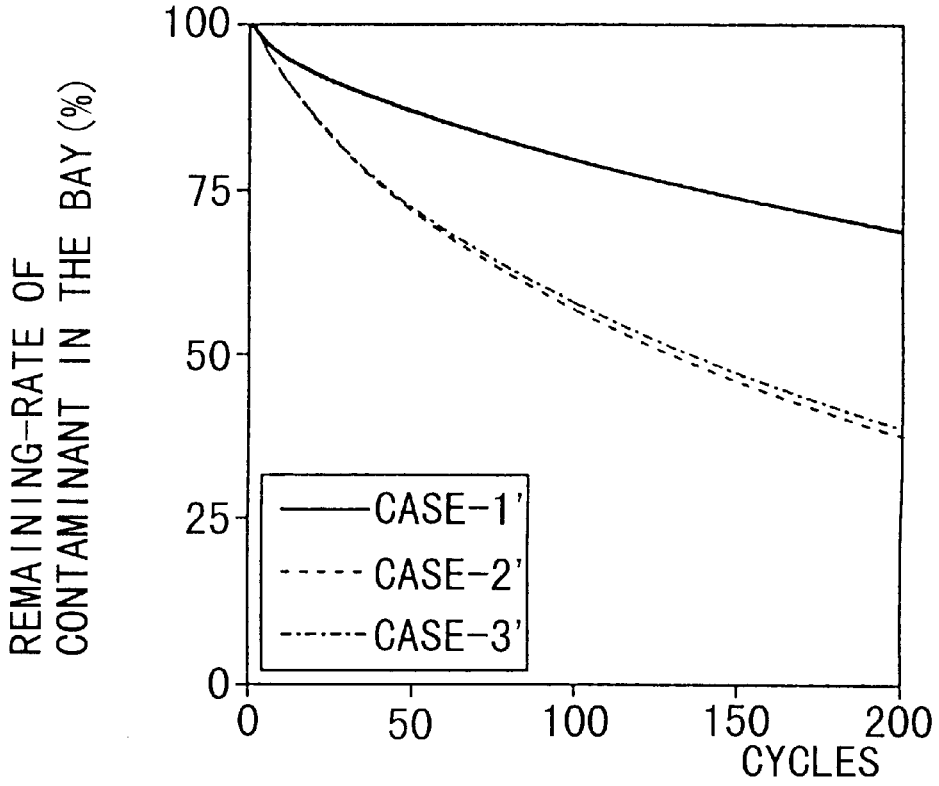
FIG. 99 is a graph showing a time series of a remaining rate of contaminants in the whole bay.

FIG. 99 indicates a ratio of the total amount of the contaminants remained in the bay each after the predetermined cycles to the total amount of the contaminants supplied in the bay at the initial time, that is, the results of a periodical variation in the remaining ratios.

From the results, it can be considered that the Case (2') can perform substantially the same ability of exchanging sea water as the Case (3').

More specifically, it is anticipated that a highly efficient tidal residual current can be created at a low degree of roughness by arranging the disposition of the bottom structure members 3 having the roughness.

(Fourth Embodiment)

Figure 100:
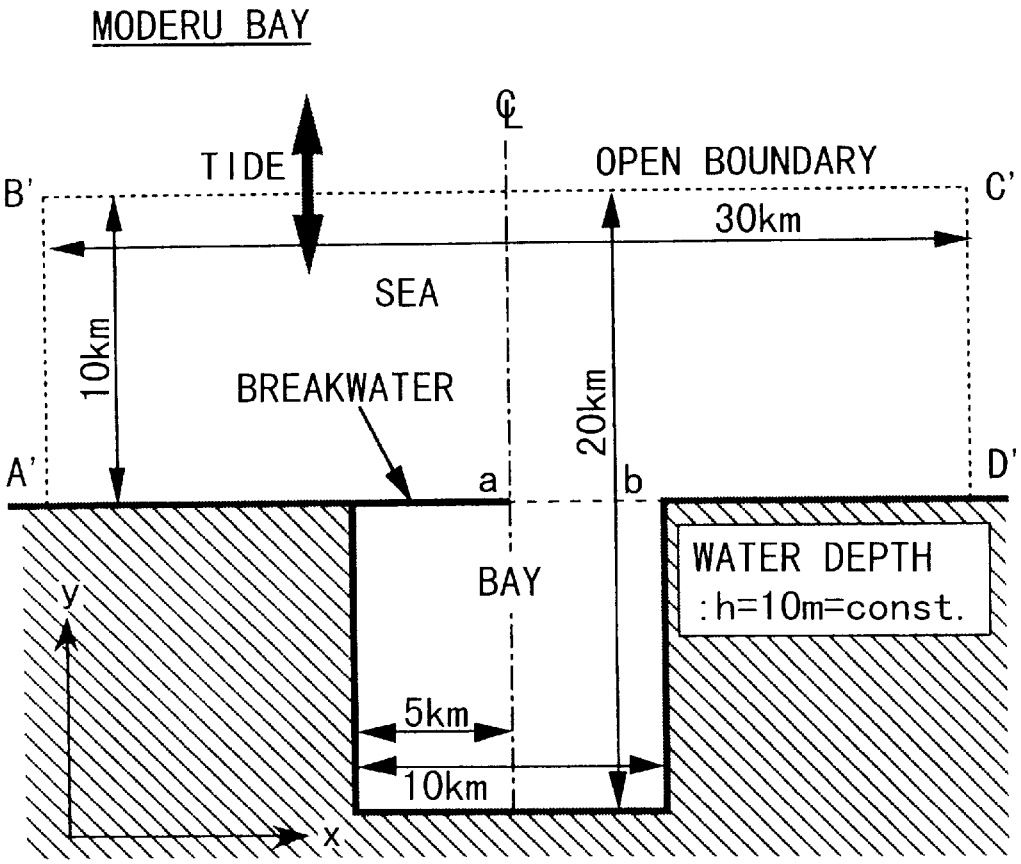
FIG. 100 is a view describing a model bay in accordance with the present invention.

In the fourth embodiment of the present invention, as shown in FIG. 100, a model bay 10 is configured in such a way that a breakwater 12 is built on a left half side of a bay entrance 1*a*. Using this model bay 10, a numerical analysis is made of the possibility that a pattern of an existing tidal residual current created in the model bay 10 can be varied by changing the disposition of the bottom structure members 3 having directional features. The conditions for computation and boundary conditions are set to be equal to the conditions as shown in Table 6 for the third embodiment.

Figure 101:
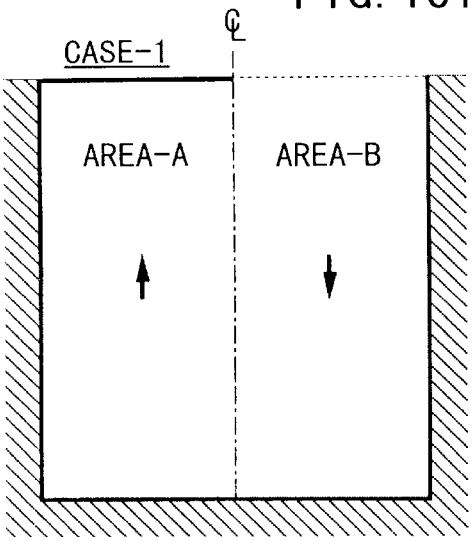
FIG. 101 is a view describing a model bay in accordance with model case (1) of the present invention.

FIG. 101 indicates Case (1) as a comparative example. In the Case (1), the model bay 10 is divided into a left half section thereof as a water area A and a right half section thereof as a water area B.

Figure 102:
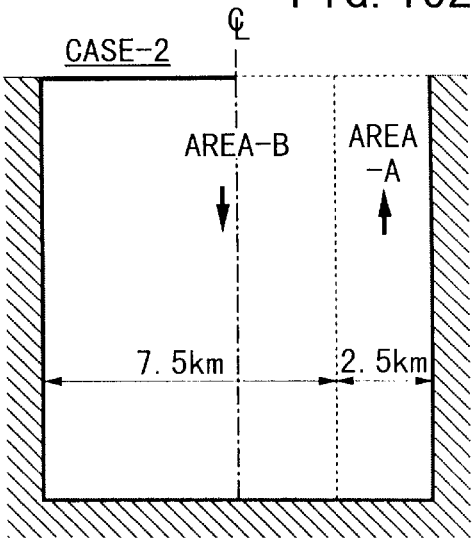
FIG. 102 is a view describing a model bay in accordance with model case (2) of the present invention.

FIG. 102 indicates Case (2) in which a ¼ portion of the right side of the model bay 10 is set as a water area A and the remaining ¾ portion of the left side thereof is set as a water area B.

Figure 103:
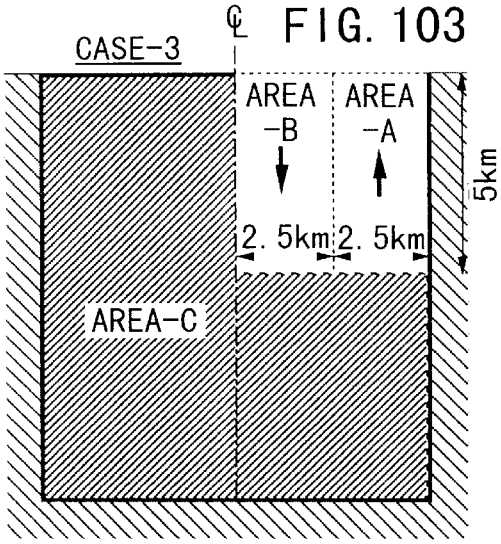
FIG. 103 is a view describing a model bay in accordance with model case (3) of the present invention.

FIG. 103 indicates Case (3) in which a water area in a right half section of the model bay 10 and in a ¼ portion on the bay entrance side thereof is divided into right and left half segments, the right half segment being set as a water area A and the right half segment being set as a water area B. Further, a water area outside the water areas A and B is set as a water area C in which no bottom structure members 3 are disposed.

Figure 104:
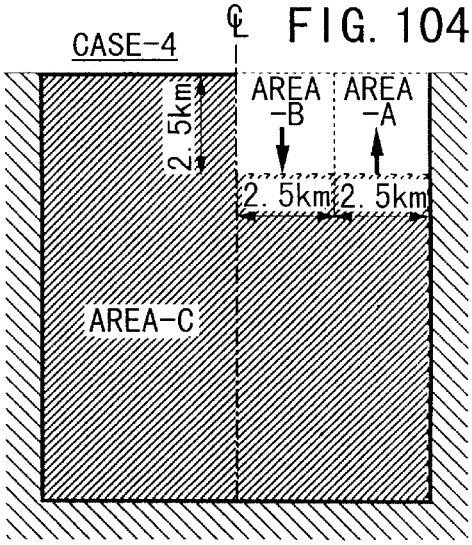
FIG. 104 is a view describing a model bay in accordance with model case (4) of the present invention.
Figure 105:
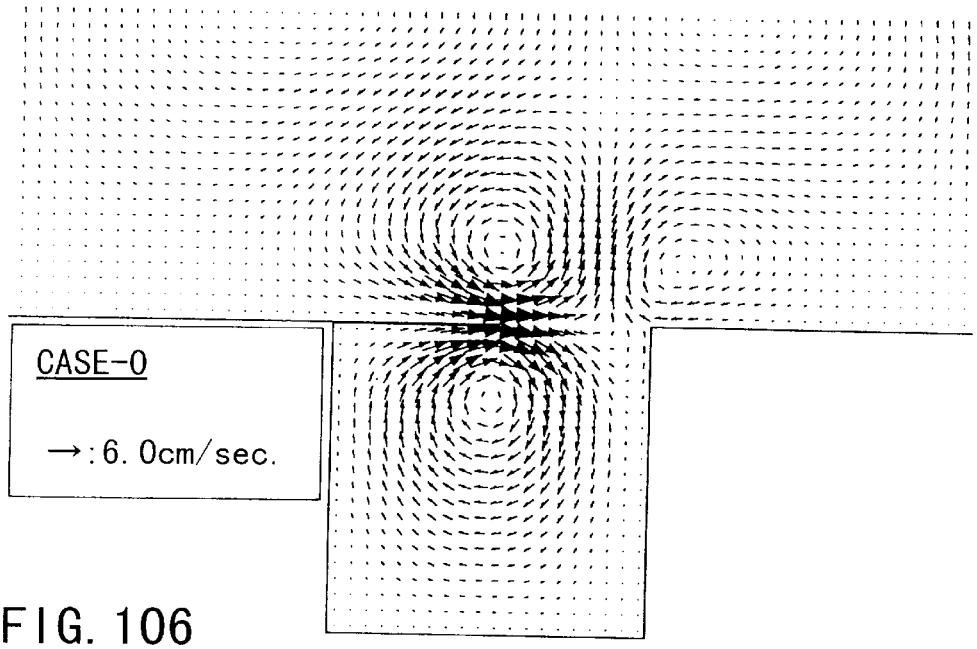
FIG. 105 is a view showing a calculational result of a tidal current simulation in accordance with model case (0) of the present invention.
Figure 106:
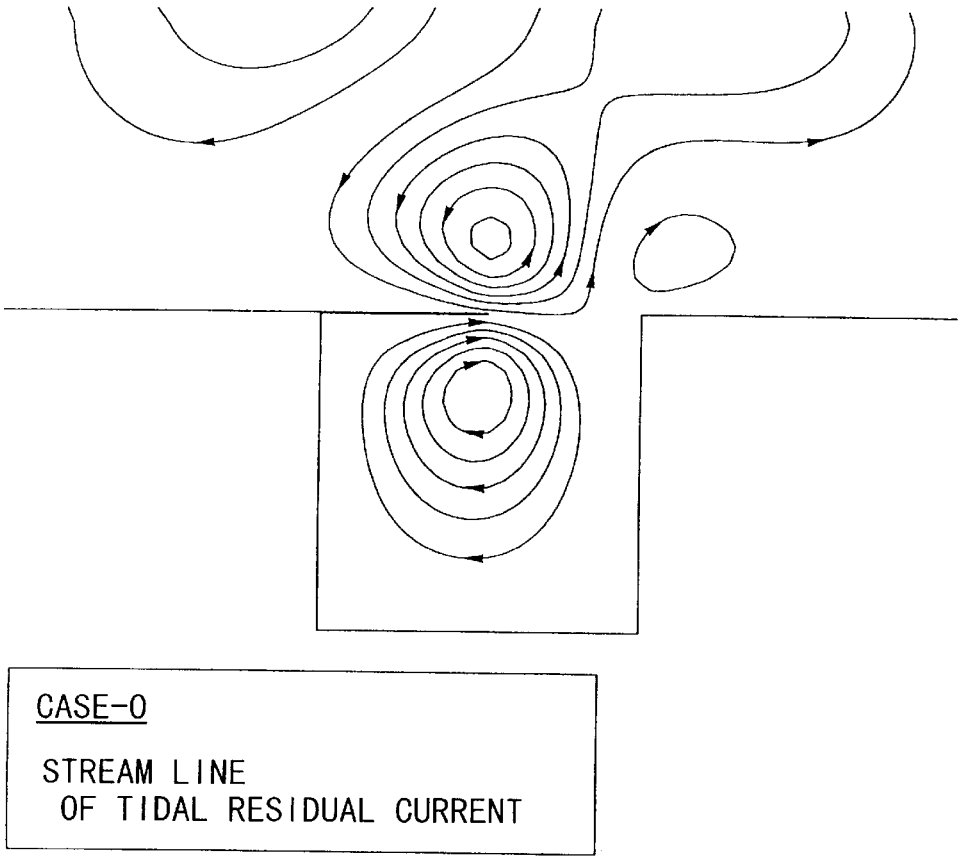
FIG. 106 is a view showing a stream line of a tidal current simulation (tidal residual current) in accordance with model case (0) of the present invention.
Figure 107:
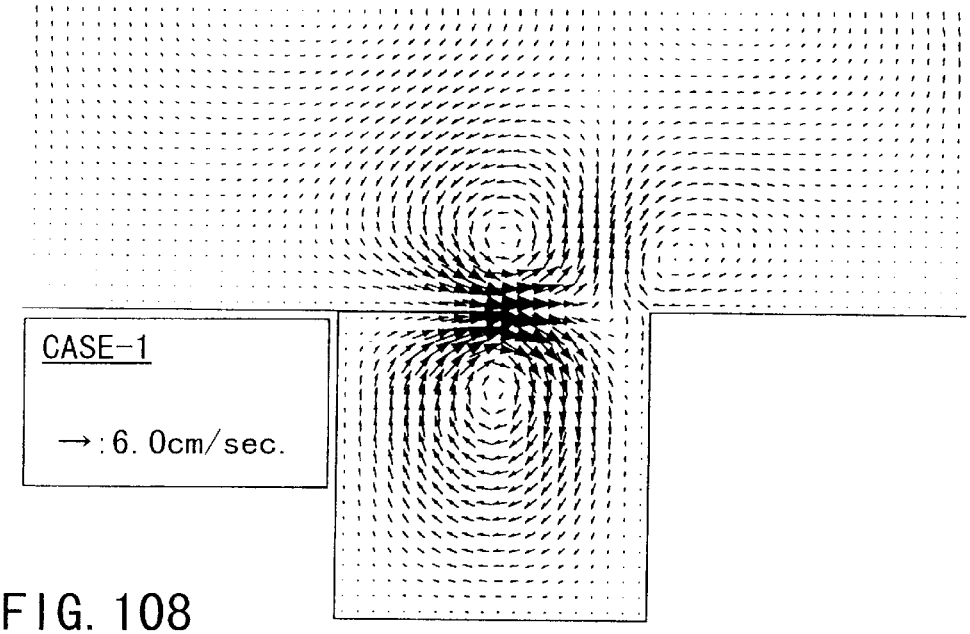
FIG. 107 is a view showing a calculational result of a tidal current simulation in accordance with model case (1) of the present invention.
Figure 108:
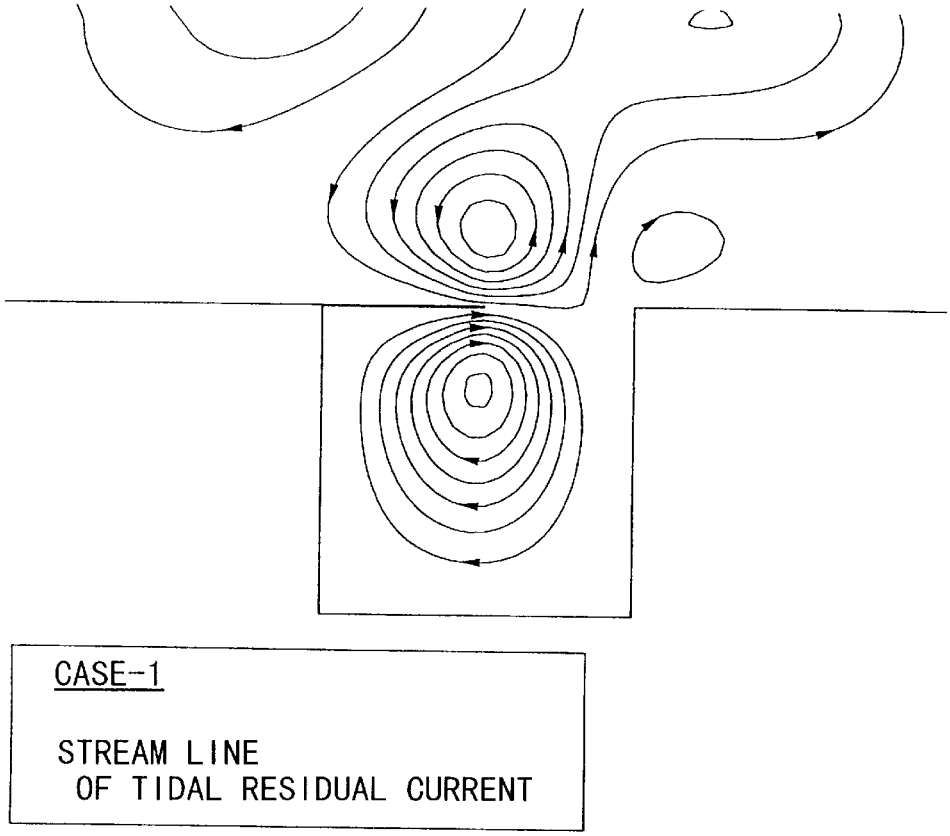
FIG. 108 is a view showing a stream line of a tidal current simulation (a tidal residual current) in accordance with model case (1) of the present invention.
Figure 109:
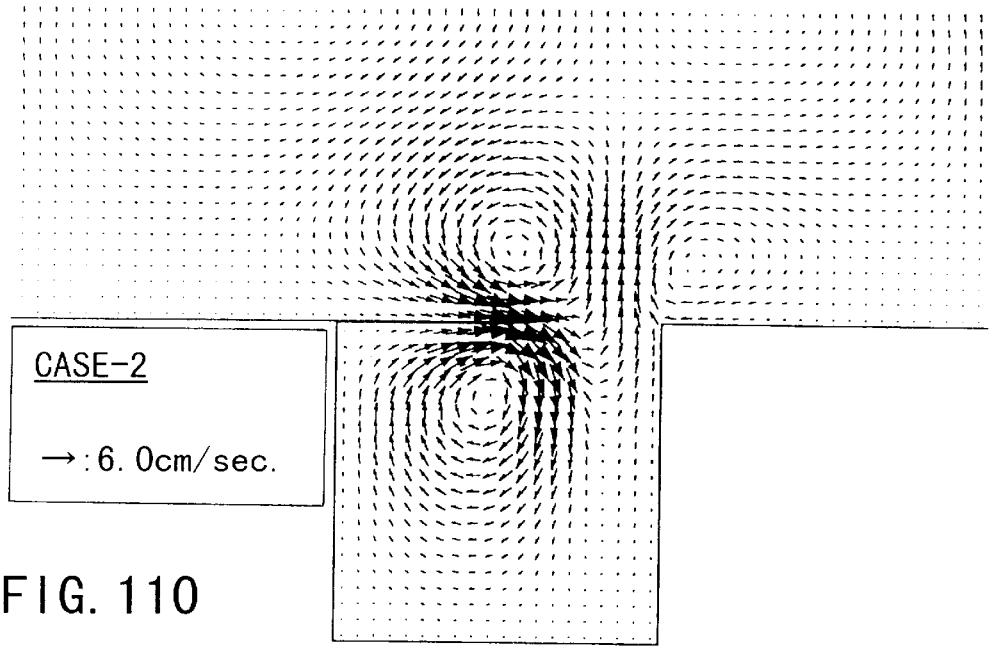
FIG. 109 is a view showing a calculational result of a tidal current simulation in accordance with model case (2) of the present invention.
Figure 110:
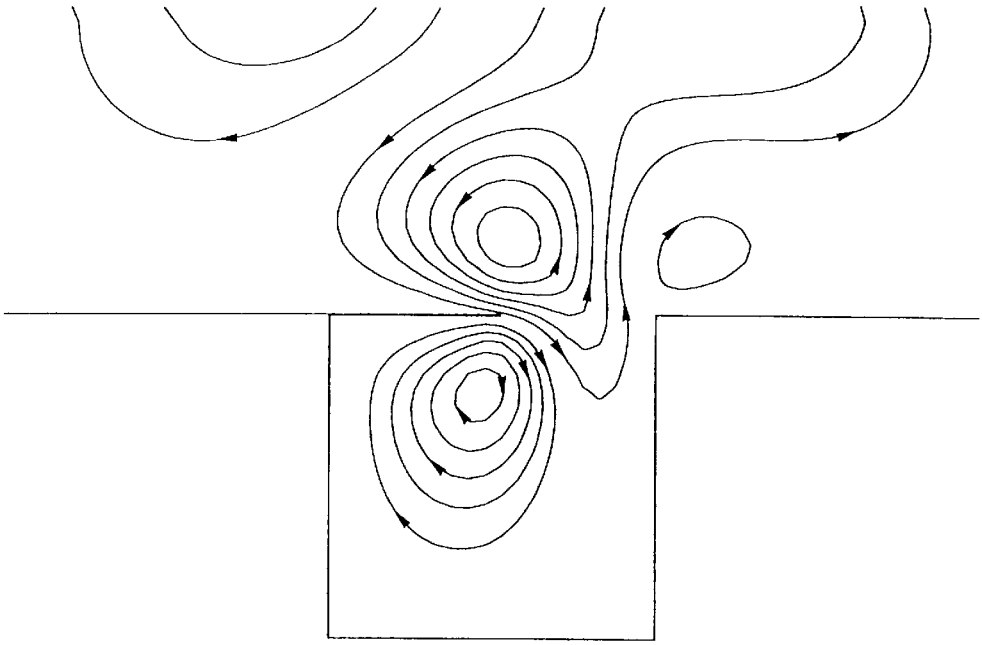
FIG. 110 is a view showing a stream line of a tidal current simulation (tidal residual current) in accordance with model case (2) of the present invention.
Figure 111:
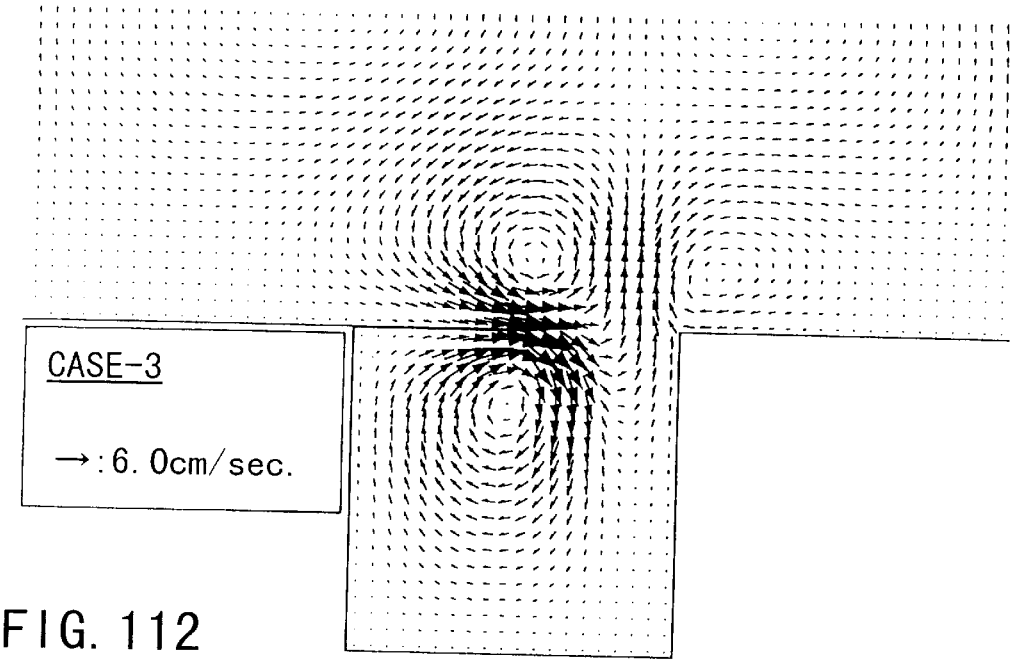
FIG. 111 is a view showing a calculational result of a tidal current simulation in accordance with model case (3) of the present invention.
Figure 112:
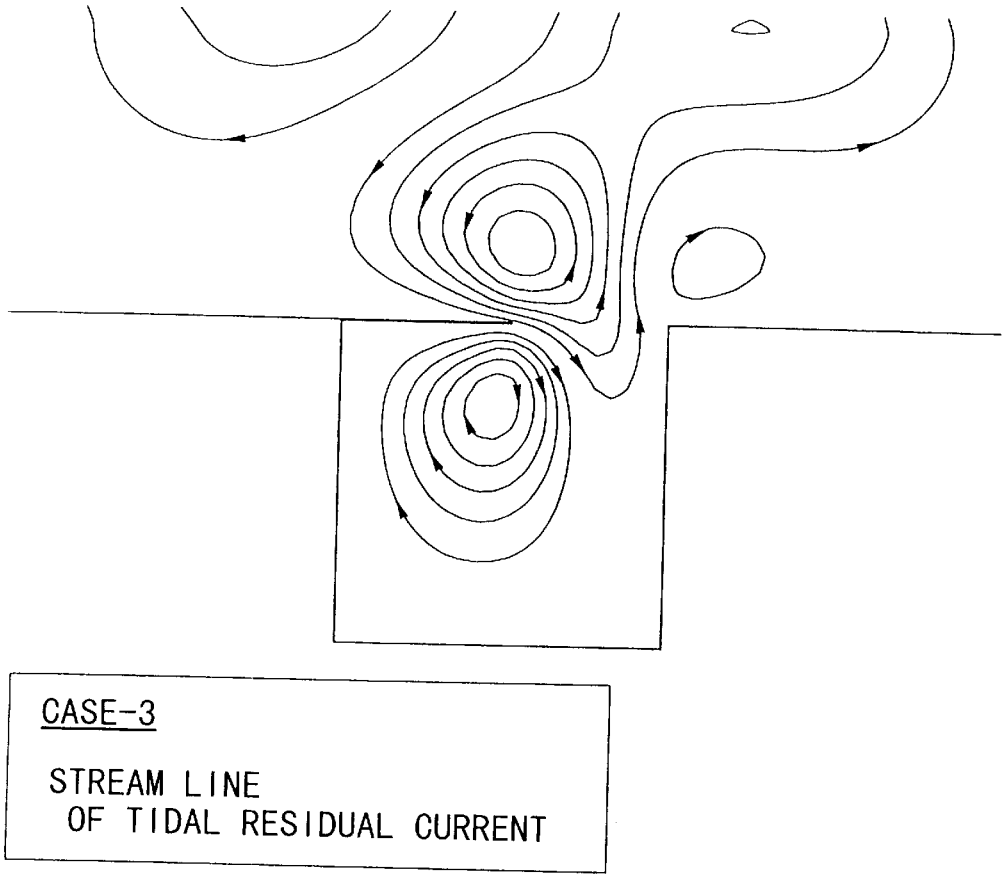
FIG. 112 is a view showing a stream line of a tidal current simulation (tidal residual current) in accordance with model case (3) of the present invention.
Figure 113:
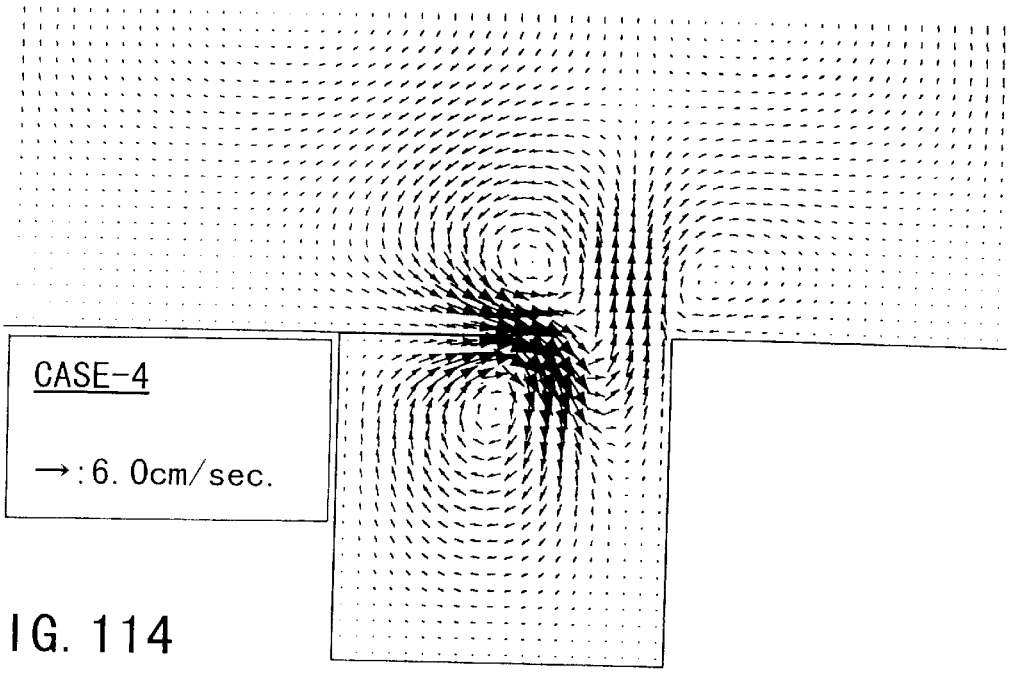
FIG. 113 is a view showing a calculational result of a tidal current simulation in accordance with model case (4) of the present invention.
Figure 114:
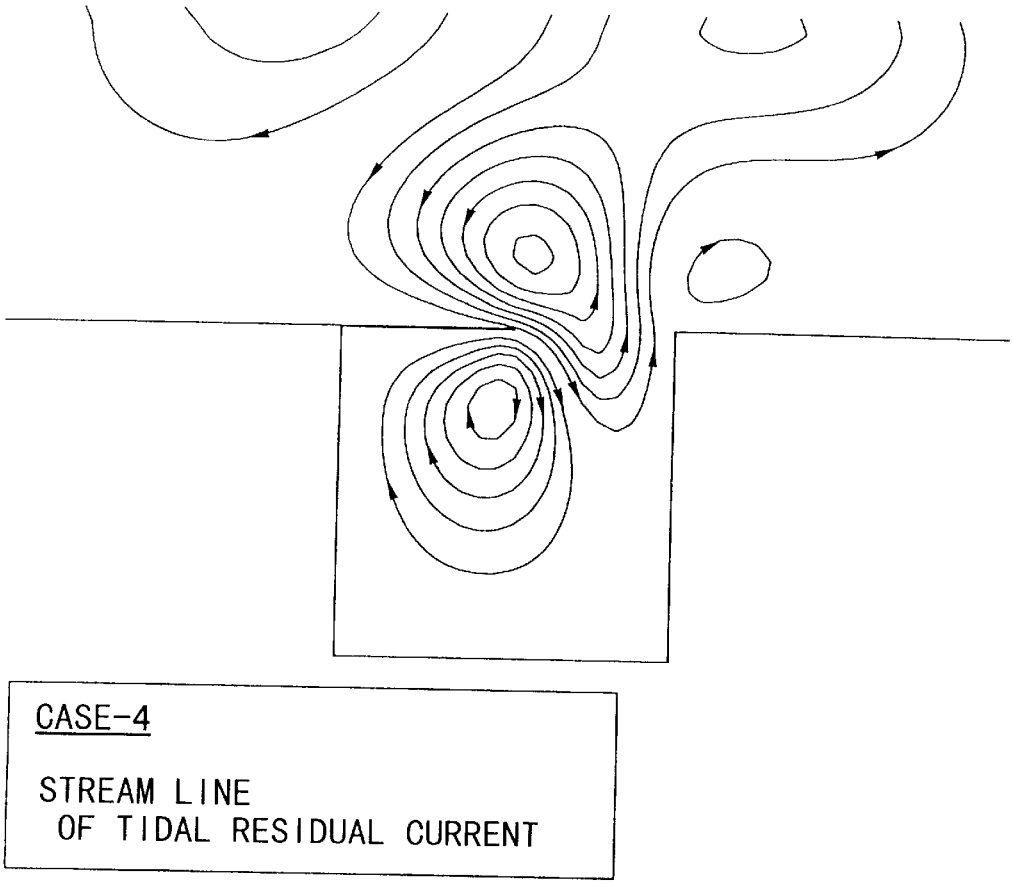
FIG. 114 is a view showing a stream line of a tidal current simulation (tidal residual current) in accordance with model case (4) of the present invention.
Figure 115:
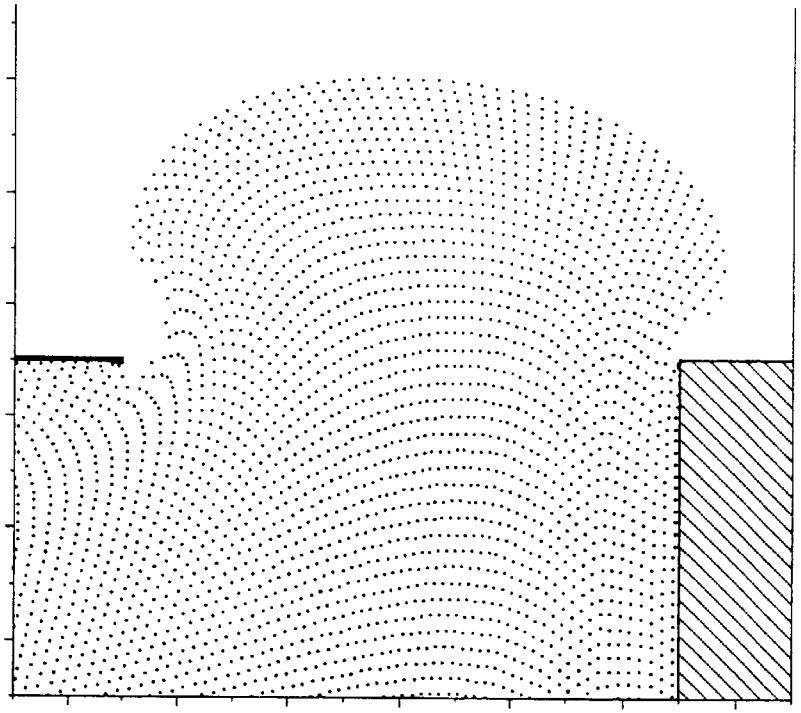
FIG. 115 is a view showing a calculational result of a particle-tracking simulation in accordance with model case (0) of the present invention (when Vmax is attained).
Figure 116:
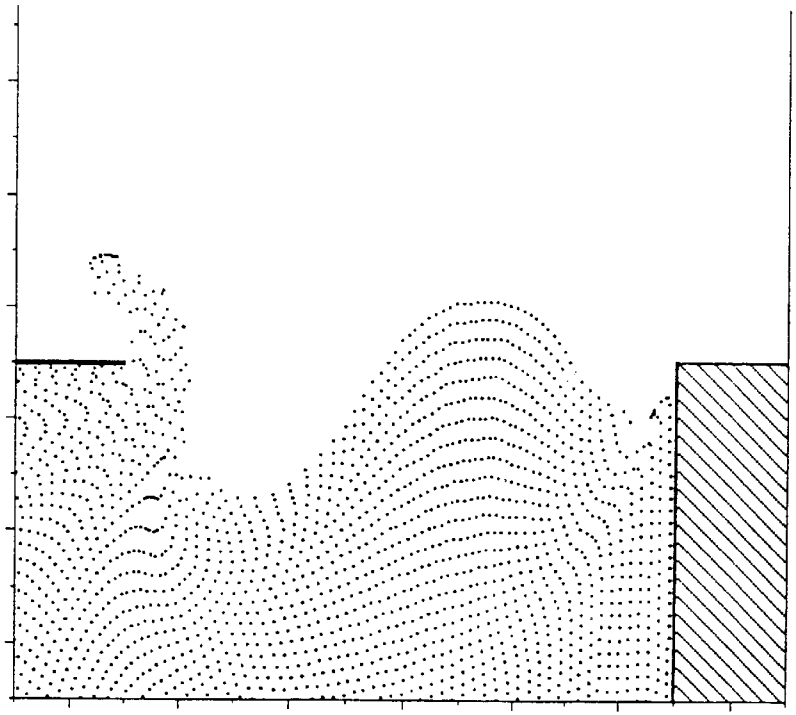
FIG. 116 is a view showing a calculational result of a particle-tracking simulation in accordance with model case (0) of the present invention (when Vres occurred in a maximum ebb tide after 1 cycle).
Figure 117:
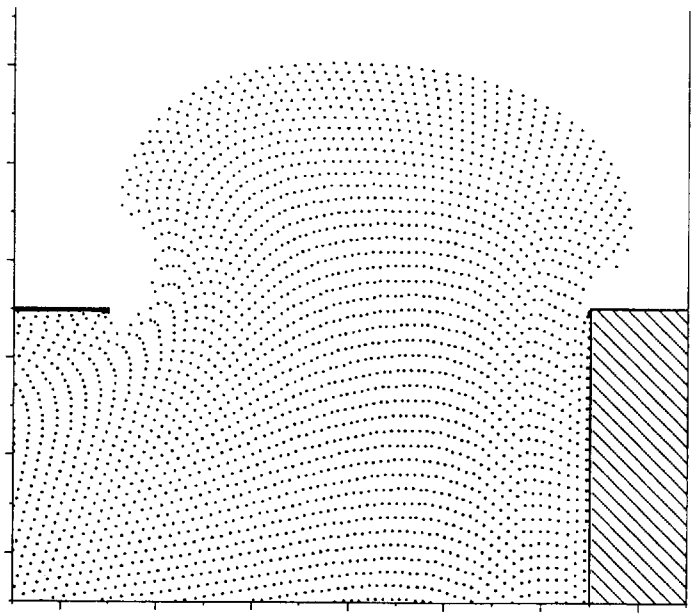
FIG. 117 is a view showing a calculational result of a particle-tracking simulation in accordance with model case (1) of the present invention (when Vmax is attained).
Figure 118:
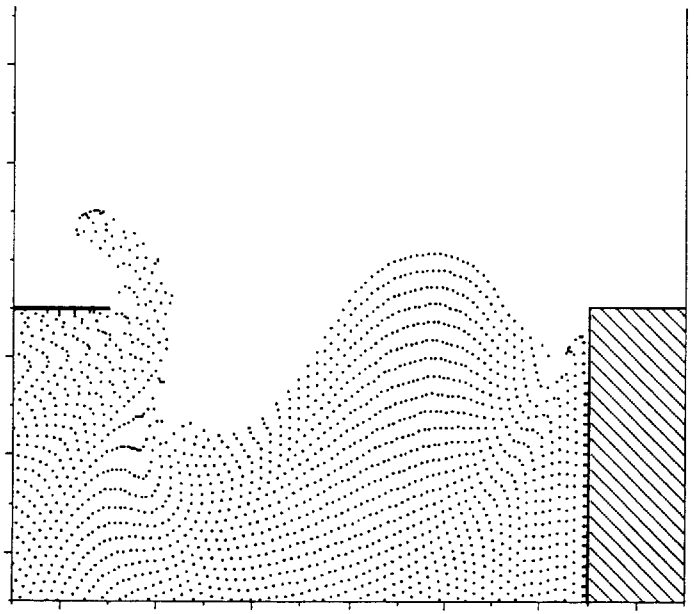
FIG. 118 is a view showing a calculational result of a particle-tracking simulation in accordance with model case (1) of the present invention (when Vres occurred in a maximum ebb tide after 1 cycle).
Figure 119:
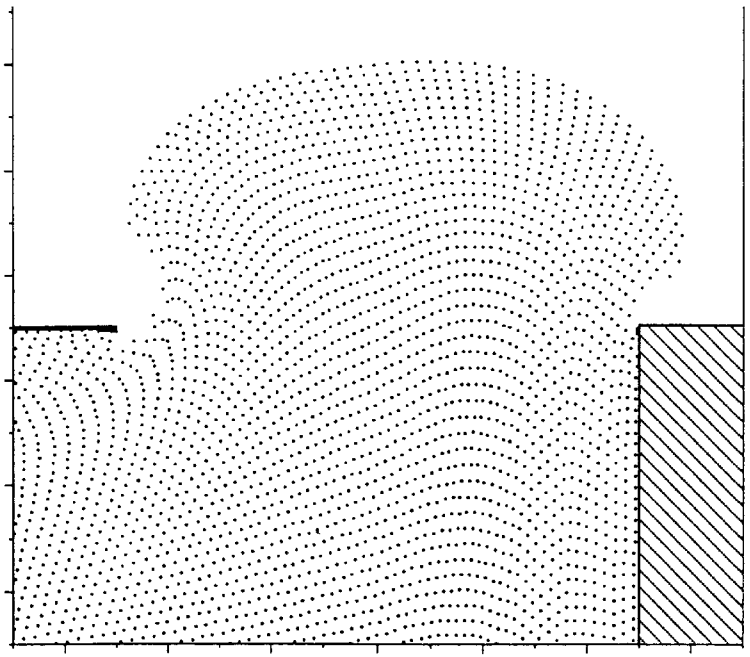
FIG. 119 is a view showing a calculational result of a particle-tracking simulation in accordance with model case (2) of the present invention (when Vmax is attained).
Figure 120:
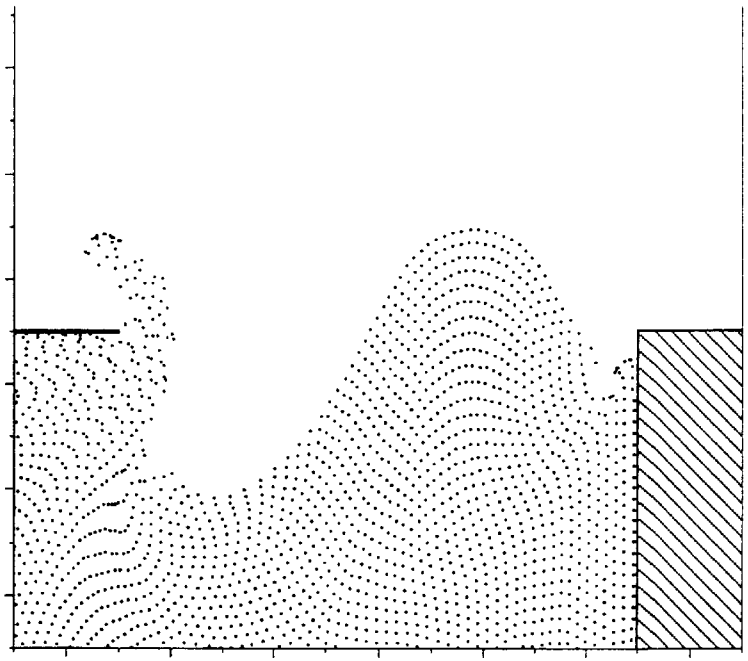
FIG. 120 is a view showing a calculational result of a particle-tracking simulation in accordance with model case (2) of the present invention (when Vres occurred in a maximum ebb tide after 1 cycle).
Figure 121:
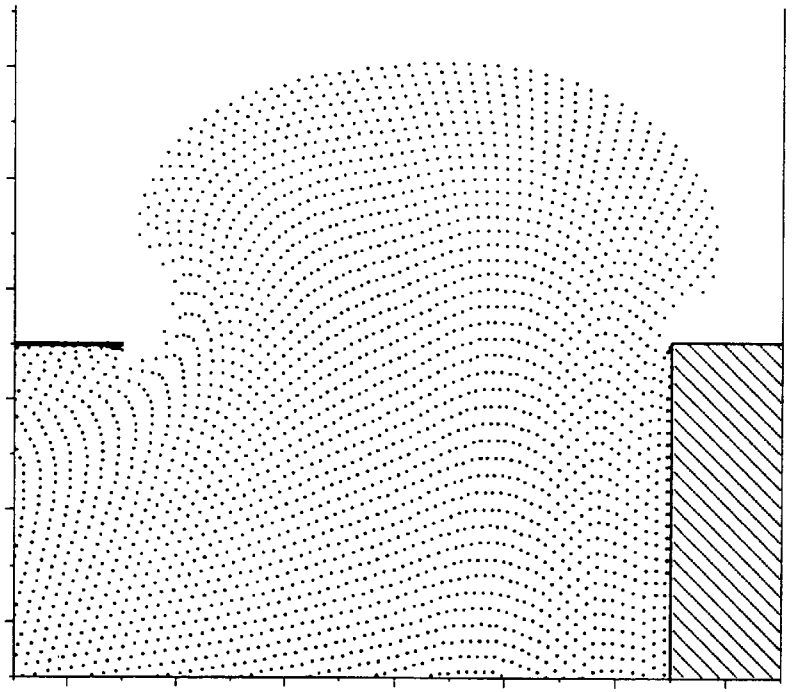
Figure 122:
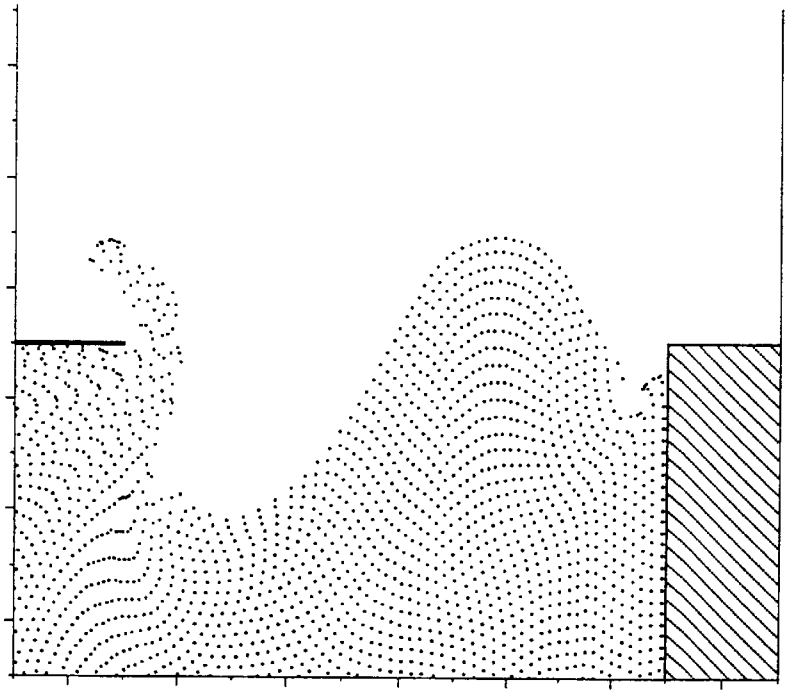
Figure 123:
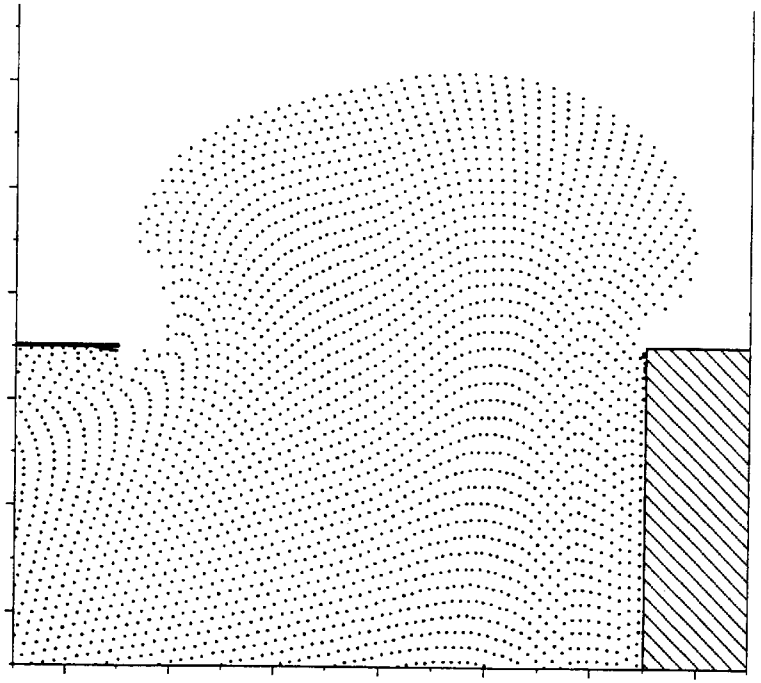
Figure 124:
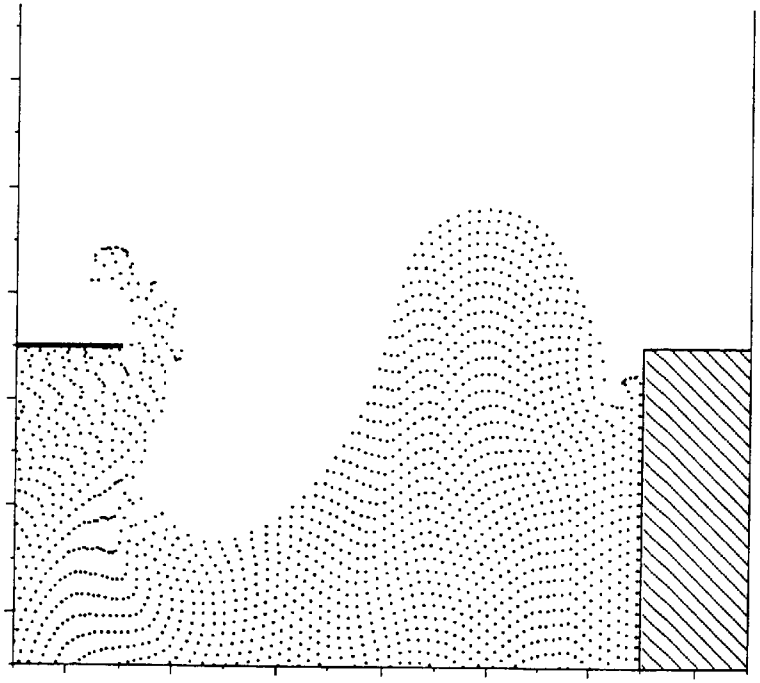
Figure 125:
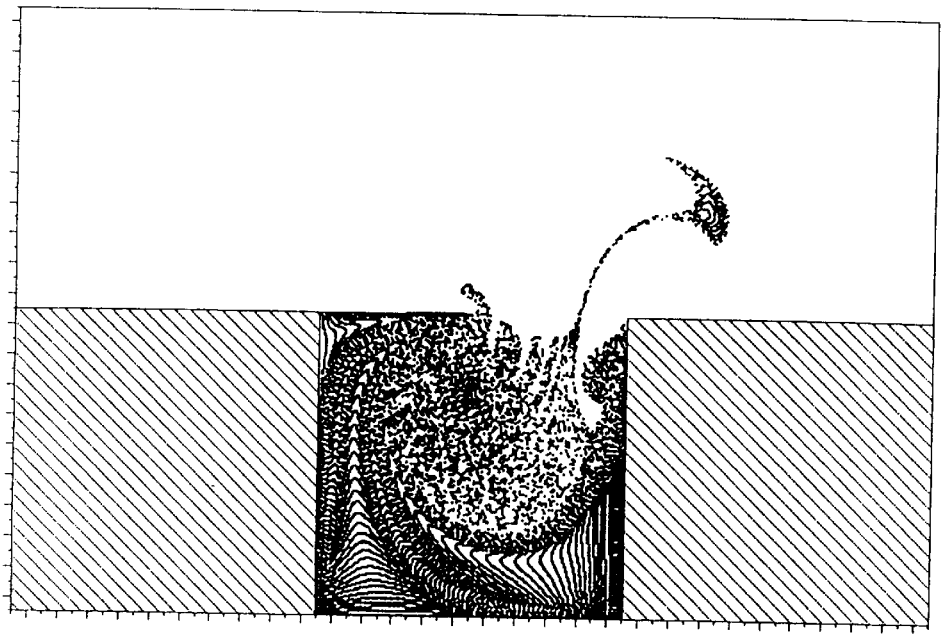
Figure 126:
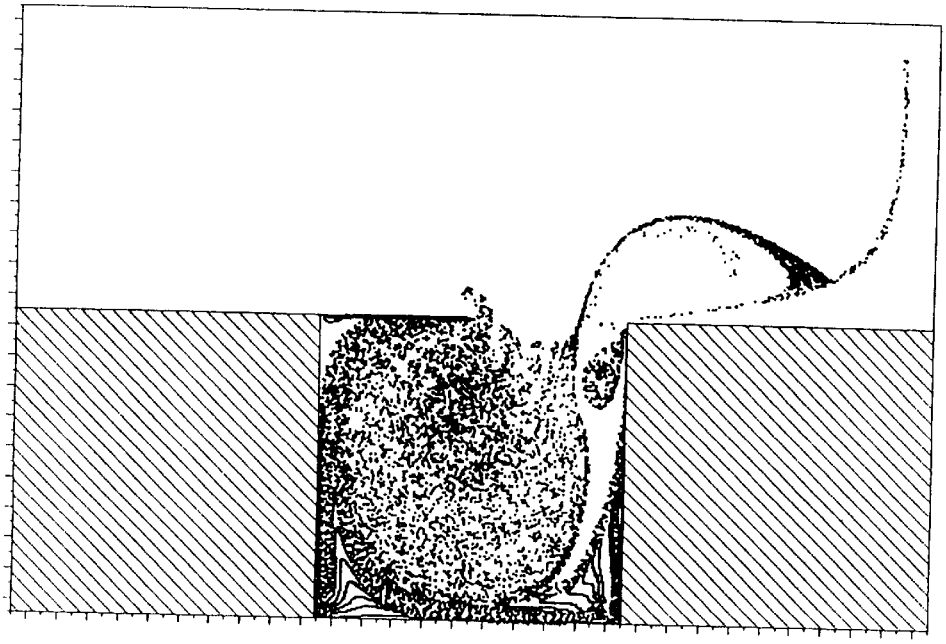
Figure 127:
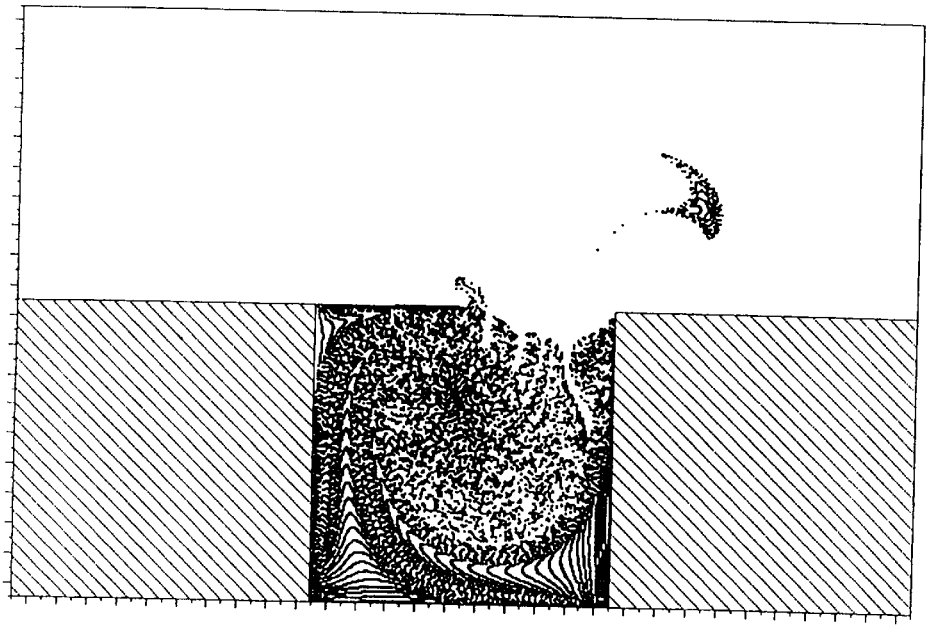
Figure 128:
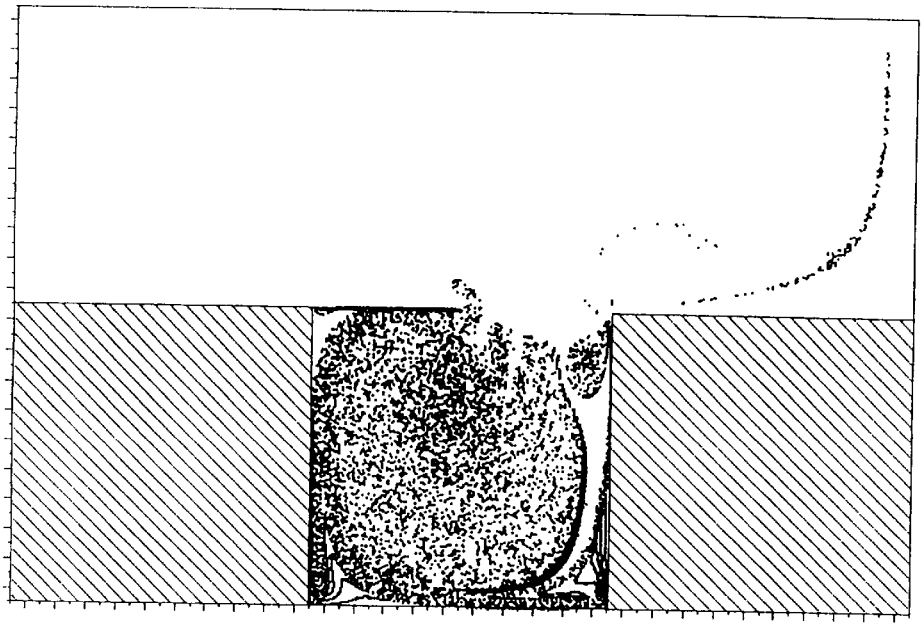
Figure 129:
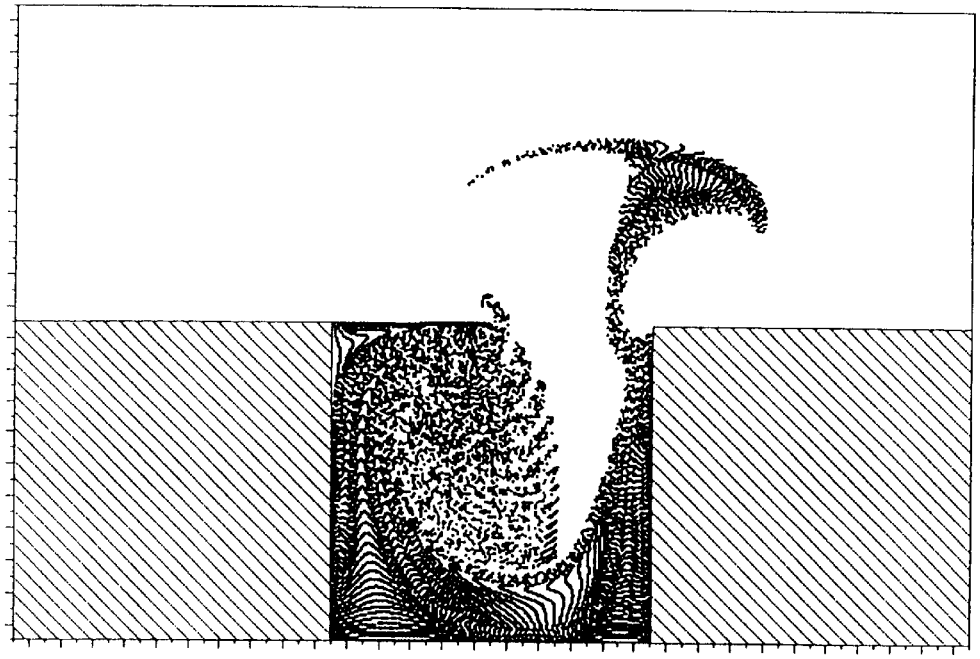
Figure 130:
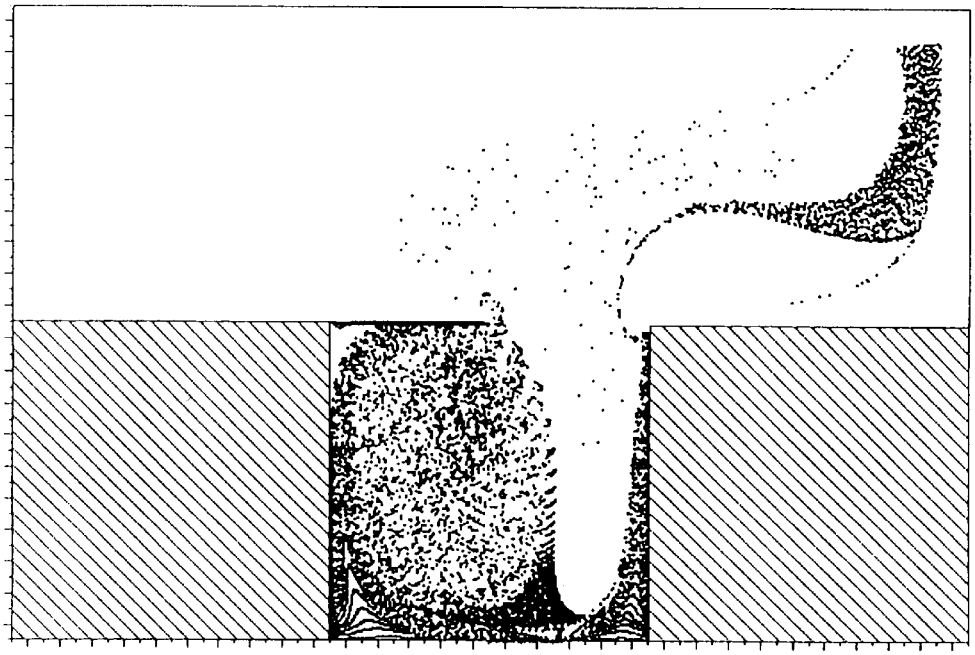
Figure 131:
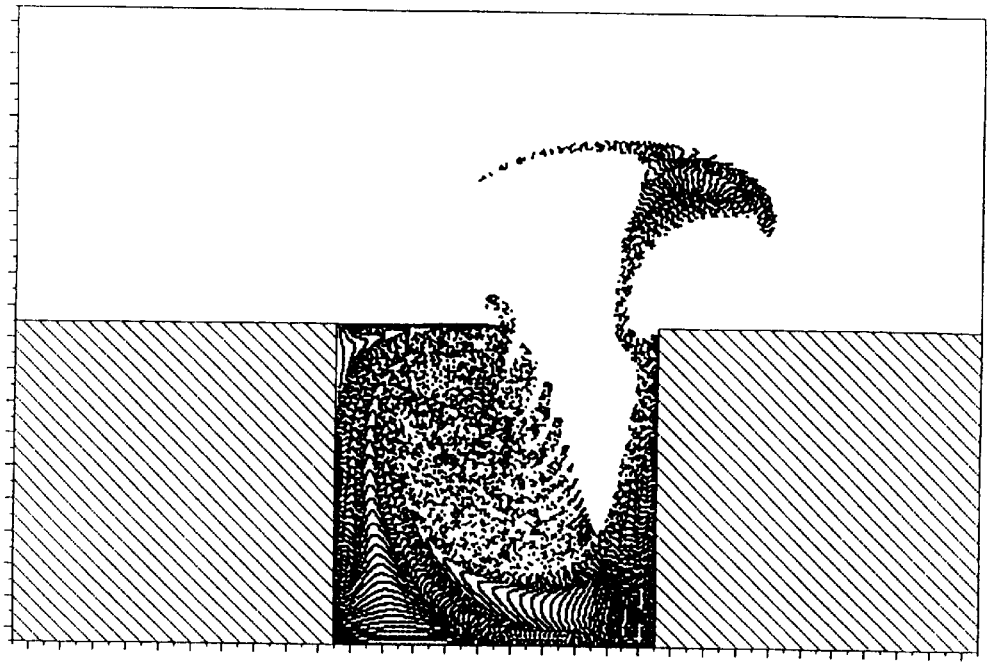
Figure 132:
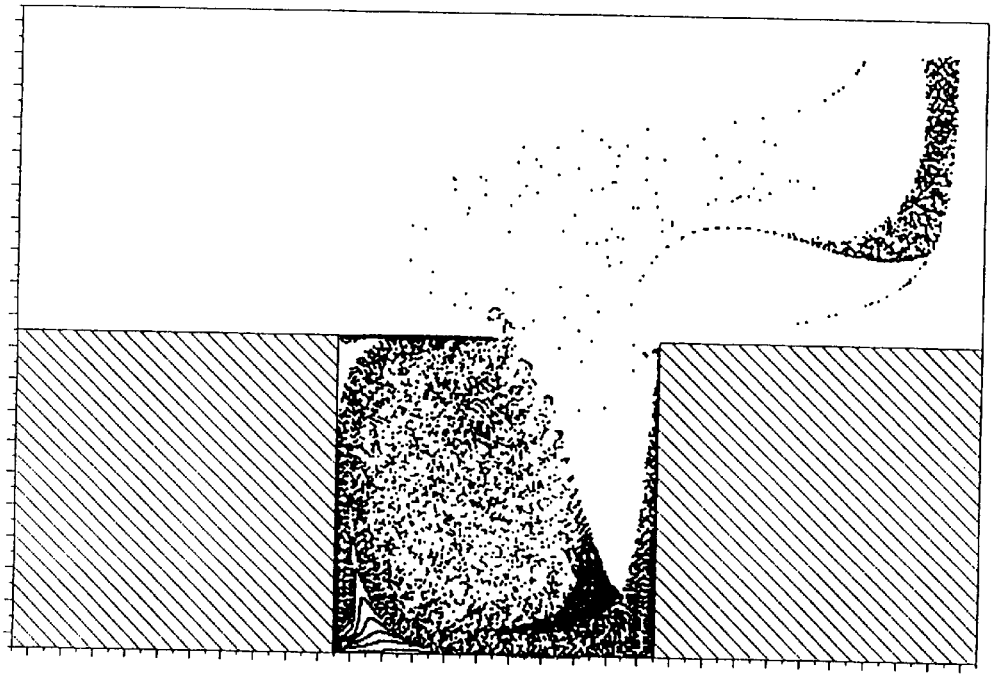

FIG. 104 indicates Case (4) in which a half area on the rear bay side of each of the water areas A and B is set as a water area C.

In the above Cases (1) to (4), inclusive, given the direction as indicated by the arrow being a forward current direction, the bottom friction coefficient $\gamma^2_b$ is set to be $\gamma^2_b$=0.0026 for the positive direction component in the y-axis of FIG. 100 and $\gamma^2_b$=0.0053 for the negative direction component in the y-axis thereof. It is provided herein, however, that in the Case (4) a difference in roughness coefficient is set to be twice for the backward current and the bottom friction coefficient is set to be $\gamma^2_b$=0.0088 (n=0.044).

Further, as Case (0), a model bay 10 is set where no bottom structure member 3 is disposed on the bottom of the bay.

Then, a description will be made of the results of computation for the Cases (0), (1), (2), (3) and (4) obtained on the basis of the conditions for computation as described hereinabove.

More specifically, FIGS. 105 to 114 indicate each the result of computation of the tidal residual current obtained by averaging the result of computation of the tidal residual current of one cycle portion for each of the Cases (0) to (4), inclusive, and a streamline thereof.

From these results, it is found that a circulating current is created on a scale of the entire bay in the Case (0), a circulating current created on the scale of the entire bay in the Case (0) is further enlarged in the Case (1), and a circulating current developed in the outside sea is penetrating into the bay in each of the Cases (2) to (4).

These results imply that the tidal residual current can be controlled in an efficient way by appropriately arranging the disposition of the bottom structure members 3 and disposing the bottom structure members 3 having a large difference in directional roughness.

Moreover, these results reveal that the circulating current within the bay can be enlarged as in the Case (1) as well as the circulating current in the outside sea existing nearby the bay entrance can be converted and penetrated into the bay as in each of the Cases (2) to (4), thereby mixing the circulating current in the outside sea with the circulating current within the bay and as a result activating exchanges of the circulating current within the bay for the circulating current existing in the outside sea.

Now, a computation for tracking particles (Euler-Lagrange Method) is made by placing labelled particles in the bay, in order to investigate an influence of the control of a tidal residual current by the bottom structure member upon exchanges for sea water.

In this case, a position vector of a particle at each time is computed by the following formula:

$$X(t+\Delta t) = X(t) + \Delta t \cdot U(X(t), t) + \frac{\Delta t^2}{2} \cdot \frac{DU(X(t), t)}{Dt} \tag{8}$$

in which:

$$\frac{DU_i(X(t), t)}{Dt} = \frac{\partial U_i(X(t), t)}{\partial t} + U(X(t), t) \cdot \nabla_H U_i(X(t), t),$$

$$\nabla_H = \left(\frac{\partial}{\partial x}, \frac{\partial}{\partial y}\right)$$

where X(t) is a position vector of a particle at each time; and

U(X(t),t) is a flow velocity vector in the respective position.

A migration of the labelled particles is computed on the basis of data on the flow velocity of one cycle portion obtained for each of the Cases (0) to (4), inclusive. An interval of the time for computation is set to be Δt=150 seconds in order to fail to allow the particles to migrate in a distance of 1 mesh or more. Further, the particles are treated in such a manner that all the particles reflect at the wall surface thoroughly and the particles outgoing from the open boundary limit are not caused to be returned again into the experimental area. In addition, the effects to be achieved by turbulent diffusion and advection distribution ar e not considered in this computation.

The boundary line for evaluating the ratio of water exchanges is set as indicated by line a'–b' of the bay entrance portion as shown in FIG. 100. In the test, the labelled particles are disposed over the entire area within the bay inside the line a'–b' at a rate of 25 particles per 1 mesh (500 meter×500 meter) in the total number of 10,000 particles. The computation is made by following a trace of each particle for a period of time of one ebb cycle starting with the highest ebb tide time.

The ratio of water exchanges is defined by the following formula:

$$EX = \frac{V_{res}}{V_{\max}} \tag{9}$$

in which Vmax is a volume of water within the bay at the time when the water within the bay represented by the particles caused to be flown outside the boundary line for one cycle of ebb amounts to the maximum volume (around the time of the maximum ebb tide in a usual case) and Vres is a volume of water within the bay at the time when the water within the bay represented by the particles remaining outside the boundary line at the time of the maximum ebb tide after one cycle.

In this embodiment, the effect of the bottom roughness is evaluated by the sea water exchange ratio EX.

As examples of the results of computation of tracking the particles, FIGS. 115 to 124 indicate each a distribution of particles nearby the bay entrance area at the time when Vmax and Vres were obtained for each of the Cases (0) to (4), inclusive. Table 8 further shows Vmax, Vres and the sea water exchange ratio EX for each of the Cases (0) to (4).

From these results, it is found that the exchanges of sea water can be effected in the most active way in the Case (4) and the sea water exchange ratio in this case is approximately two times the Case (0) where no bottom structure member is disposed. In the Case (4), the area where the bottom structure members are disposed is the smallest among the cases yet the difference in roughness is set to be larger than the other Cases (1) to (3). Therefore, it can be presumed from these results that it is of great importance to promote the formation of an excessive flow by creating a strong difference in roughness locally nearby the bay entrance area, in order to enlarge the sea water exchange ratio.

Then, in order to compare the ability of exchanging sea water in the bay for a long period of time, the computation of tracking the particles for 60 cycles (over a period of about one month). FIGS. 125 to 134 indicate each a distribution of the particles at the time of the highest ebb tide after 15 cycles and after 60 cycles from the initial time for each of the Cases (0) and (4), inclusive.

Further, FIG. 135 shows a periodical variation in remaining rates of the particles remaining within the bay at the last time of each cycle (at the time of the maximum ebb tide), out of the whole particles disposed within the bay at the initial time.

From a comparison of the results, it is found that, although the Case (4) that is high in the sea water exchange ratio at a relatively early stage has the great ability of outflowing the sea water within the bay, the amount of the sea water outflowing from the bay into the outside sea becomes smaller after 10 cycles. It is further found that rather the Case (2) can achieve the least remaining rate after 20 cycles, thereby performing the best results in the ability of sea water exchanges for a long run.

It can be found herein, when taken into account the fact that, in the Case (2) where the roughness is provided in an area ranging from the bay entrance to the rear bay portion, while in the Case (4) where the roughness is provided in an area nearby the bay entrance portion and a strong difference in resistance is created only near the bay entrance portion, two functions are required, that is, the one function being to ensure a great ability of exchanging sea water around the bay entrance area and the other function being to transfer the sea water within the rear bay area to the bay entrance area by the action of a circulating current on a scale over the whole bay area, in order to promote the exchanges of sea water in a closed water area.

(Fifth Embodiment)

In the fifth embodiment of the present invention, a review of resistance features of the forward current direction and the backward current direction is made for the bottom structure member 3 as the basic structure as described hereinabove and the bottom structure members 3 in the eighth to fourteenth variants, inclusive, by experiments in a room.

In this experiments, the effects acting upon each of the bottom structure members are measured using an experimental device M as shown in FIG. 136, in order to investigate an optimum shape of a bottom structure member as a single member so as to make the differential resistance between the forward current direction and the backward current direction.

First, a description will be made of the experimental device M. As shown in FIGS. 136 to 138, the experimental device M comprises a water arranging plate 41 disposed on the upstream side of a water path forming member 40, a drag measuring device 42 disposed at a central portion, a movable weir 43 disposed on the downstream side, and a water supply portion 44 disposed in the position immediately above on the upstream side of the water path forming member 40.

The water path forming member 40 is of an outside-inside double structure having a water path bed 40*a* disposed at a middle portion and left and right inner walls 40*b* and 40*b*.

The drag measuring device 42 has a roughness provision plate 46 disposed in an open portion 45 formed at a central portion of the water path bed 40*a* and supported by three sheets of phosphorus bronze plates 47, 47, 47 at three points, that is, at two points on the upstream side and at one point on the downstream side. Further, the phosphorus bronze plate 47 disposed on the downstream side is attached with a biasing gauge 48.

In FIGS. 136 to 138, L1=6,000 mm, L2=1,800 mm, L3=3,000 mm, L4=1,200 mm, L5=1,700 mm, L6=200 mm, L7=1,100 mm, H1=100 m, H2=385 mm, H3=15 mm, H4=80 mm, W1=424 mm, W2=38 mm, W3=38 m, W4=250 mm, W5=2 mm, W6=2 mm, t2=1 mm, t3=1 mm, and t4=2 mm.

The drag is determined by calibrating from a calibration curve obtained by reading a transformation of the phosphorus bronze plates 47 caused to occur by the force acting upon the roughness provision plate 46 from the biasing gauge 48 and comparing the values before and after the experiment. It is to be noted herein that the roughness provision plate 46 is set so as for its upper plane to be disposed on a level with an upper plane of the water path bed 40*a* when the bottom structure member 3 is disposed as roughness.

Now, a description will be made of the procedures for the experiment. In this experiment, the drag acting upon each of the bottom structure members 3 ($\tau f = Df - Ff$, $\tau f = Db - Fb$) is obtained by measuring the entire drag (Df, Db) acting upon the roughness 30 provision plate 46 disposed in the forward current direction (provided with lowercase f) and in the backward current direction (provided with lowercase b) in a state in which the bottom structure member 3 as roughness is fixed on the roughness provision plate 46 and then by subtracting the bottom friction force (Ff, Fb) from the entire drag (Df, Db), respectively, the bottom friction force (Ff, Fb) being obtained by measuring the friction force acting upon the roughness provision plate 46 from which the bottom structure member 3 has been removed.

The depth of water h is obtained by measuring a water level using a servo type water gage (not shown) at two locations apart ahead and behind by 1 meter from the roughness provision plate 46 and averaging the measured values. The flow quantity Q is measured by a flow bucket (not shown).

The drag coefficient Cd for each of the bottom structure members is determined from the following formula using t, h and Q in the manner as described hereinabove.

$$Cd = \frac{\tau}{\frac{1}{2}\rho A U^2} \tag{10}$$

where τ is a drag of roughness, ρ is a density of water, A is a projection area of roughness in the flow direction, and U is a section-averaged flow velocity (=Q/hB, B=42.4 cm).

The conditions for the experiment are shown in Table 9 below.

In this table, roughness member No. 1 is the bottom structure member 3 having a quarterly-cut spherical shape as shown in FIGS. 139 and 140; roughness member No. 2 is the bottom structure member of the eighth variant as shown in FIGS. 12 and 13; roughness member No. 3 is the bottom structure member of the ninth variant as shown in FIGS. 14 and 15; roughness member No. 4 is the bottom structure member of the tenth variant as shown in FIGS. 16 and 17; roughness member No. 5 is the bottom structure member of the eleventh variant as shown in FIGS. 18 and 19; roughness member No. 6 is the bottom structure member of the twelfth variant as shown in FIGS. 20 and 21; roughness member No. 7 is the bottom structure member of the thirteenth variant as shown in FIGS. 22 and 23; and roughness member No. 8 is the bottom structure member of the fourteenth variant as shown in FIGS. 24 and 25.

Further, in FIG. 140, reference symbol θ1 denotes an angle of the bottom structure member 3 from the water path bed 40*a* to an open plane and reference symbol θ2 denotes an open angle of the spherical section of the bottom structure member 3.

Specific values of roughness height k, roughness radius r, thickness t, roughness width b, angle θ, and distance l of each of roughness member Nos. 1 to 8 are indicated in Table 10 below.

It is to be noted herein that the differetial drag coefficient, ΔCd, as the difference in directional roughness can be obtained by subtracting the drag coefficient Cdf in the forward current direction from the drag coefficient Cdb in the backward current direction and that, when the differential drag coefficients ΔCd are equal to each other, a smaller drag coefficient can be said to be more advantageous.

As a comprehensive evaluation of the bottom structure members, a comparison is made of efficiency on the basis of a ratio α of the differential drag coefficient ΔCd to the drag coefficient Cdf in the forward current direction as will be described as follows:

$$\alpha = \frac{\Delta Cd}{Cdf} = \frac{Cdb - Cdf}{Cdf} \tag{11}$$

FIGS. 141 to 143 indicate the differential drag coefficients ΔCd for each of the roughness member Nos. 1 to 8 and FIGS. 144 to 146 indicate the ratio α=ΔCd/Cdf for each of them. From these figures, it is obviously seen that the roughness member Nos. 7 and 8 take each a larger value in respect of the difference of drag coefficients ΔCd and the roughness member No. 8 also takes a relatively large value in respect of the ratio α=ΔCd/Cdf.

As a result, it can be considered that the bottom structure members as referred to as the roughness member Nos. 7 and 8 can achieve the most effective performance.

Moreover, it can also be found that the bottom structure member 3 having a simple shape as for the roughness member Nos. 1 and 3 can take a relatively large value in respect of the difference of drag coefficients ΔCd and the ratio α=ΔCd/Cdf.

INDUSTRIAL UTILIZABILITY

The present invention can achieve the effects as will be described as follows:

(1) The present invention is configured in such a manner that plural bottom structure members appropriate for use in controlling a tidal oscillation flow are disposed on a sea bottom in a sea area to create a tidal residual current so that the tidal residual current connecting with the outside sea can be created regardless of a width of a flow path in a closed sea area. Therefore, the present invention can make a closed sea area equal to an open sea area by activating exchanges of sea water by the such tidal residual current.

Further, the direction of a flow of the tidal residual current can be set freely and in an optional direction by setting the position of the disposition and the size of the bottom structure members for controlling the tidal oscillation flow. Moreover, the present invention can create a new flow in a closed sea area and consequently make the closed sea area equal to an open sea area.

Therefore, in instances where contaminated or polluted water or the like is flown into such a closed water area from rivers, drainage channels and so on, the contaminated or polluted water or the like are allowed to be outflown from the closed water area and little retained therein, thereby enabling cleaning water quality in the closed water area in time series and at the same time preventing the pollution of water.

Moreover, as the bottom structure members disposed on the sea bottom can create a rising current, they can destroy the stratification of water in a water area and control the formation of a phenomenon of stratifying the water area. This phenomenon further can assist, on the one hand, in supplying a deep-layered water rich in nutritious materials to an upper water layer poor in nutritious materials nearby the water surface and, on the other hand, in supplying a surface-layered water rich in dissolved oxygen nearby the water surface to a deep layer free from or poor in oxygen, thereby configuring a system for growing plankton in a stable way as well as at the same time forming a stable fishing place and eventually serving as a preservation of environment of the ocean.

In addition, the bottom structure members to be used for the present invention can provide a place suitable for growing marine plants such as seaweeds and so on by making the surfaces of the bottom structure members of a shape or of a material likely for such marine plants to be attached thereto. With the arrangement of the bottom structure members as described hereinabove, the present invention can create a new water environment in a coastal area.

(2) Further, the present invention can present the effects as described in item (1) above because the bottom structure members to be used for the present invention are provided with roughness. Moreover, the bottom structure members to be used therefor are simple in structure.

(3) In accordance with the present invention, as the bottom structure member is so configured as to produce a difference in directional roughness between the roughness on the forward current direction side for the tidal oscillation flow in the forward current direction and the roughness on the backward current direction side for the tidal oscillation flow in the backward current direction, a desired tidal residual current can be created, thereby achieving the effects as described in item (1) above with high efficiency.

(4) In accordance with the present invention, as the bottom structure member is so configured as for its momentum-adding surface to provide the tidal oscillation flow with momentum in a predetermined direction, the momentum-adding surface can add a new momentum component to the tidal oscillation flow as the tidal oscillation flow strikes the momentum-adding surface, whereby a residual momentum is produced in a direction in which the vector of the momentum component is synthesized by a one-cycle average of tidal oscillation flow and the resulting residual momentum can create a tidal residual current in time series.

Therefore, the such bottom structure members can produce a new tidal residual current in a curved shape with certainty by placing them along a direction intersecting the flow direction of the tidal oscillation flow.

(5) In accordance with the present invention, the bottom structure members with the difference in directional roughness as described in item (3) provided thereon are disposed on a sea bottom in a water area along or parallel to a flow direction of the tidal oscillation flow and the bottom structure members with the momentum-adding surface as described in item (4) provided thereon are disposed along or parallel to a direction intersecting the flow direction of the tidal oscillation flow in order to create a new tidal residual current having a curved flow pattern, thereby producing a predetermined tidal residual current in a bay with high efficiency and as a consequence preventing contaminants and pollutants and so on from being retained within the bay with certainty.

(6) The present invention can further provide a fish breeding place in a closed water area that has been converted into a water area equal to an open water area because the bottom structure members have functions of gathering fish and providing fish with nests, in addition to the effects as described in item (1) above.

TABLE 1

| |
|---|
| Conditions for computation: |
| (1) Common: |
| Water Depth: h = 20 meters = constant<br>Grid Size: $\Delta x = \Delta y = 500$ meters |
| (2) Tidal current simulation: |
| Increment of Time Step: $\Delta t = 15$ seconds<br>Eddy Viscosity: $\nu t = 100.0$ sq. meter/sec.<br>Coriolis Parameter: f = 0 1/sec. |
| (3) Diffusion simulation: |
| Diffusion coefficient: D = 1.0 sq. meter/sec. |

TABLE 1-continued

| |
|---|
| Boundary conditions: |
| (1) Tidal simulation: |
| Open boundary: |
| Amplitude: a = 1.0 meter<br>Cycle: T = 12 hours 25 minutes |
| Wall surface boundary: |
| No-slip conditions |
| (2) Diffusion simulation: |
| Open boundary: |
| Concentration: C = 0.0 mg/liter |
| Wall surface boundary: |
| Conditions with no flux |

TABLE 2

| |
|---|
| Conditions for computation: |
| Sea Area A: |
| $V > 0$: $n = 0.0268$ ($\gamma_b^2 = 0.0026$)<br>$V < 0$: $n = 0.0368$ ($\gamma_b^2 = 0.0049$) |
| Sea Area B: |
| $V > 0$: $n = 0.0268$ ($\gamma_b^2 = 0.0026$)<br>$V < 0$: $n = 0.0368$ ($\gamma_b^2 = 0.0049$) |

TABLE 3

| |
|---|
| Conditions for computation: |
| y-Direction: |
| Sea Area A: |
| $V > 0$: $n = 0.0268$ ($\gamma_b^2 = 0.0026$)<br>$V < 0$: $n = 0.0368$ ($\gamma_b^2 = 0.0049$) |
| Sea Area B: |
| $n = 0.0368$ ($\gamma_b^2 = 0.0049$) |
| Sea Area C: |
| $V < 0$: $n = 0.0268$ ($\gamma_b^2 = 0.0026$)<br>$V > 0$: $n = 0.0368$ ($\gamma_b^2 = 0.0049$) |
| x-Direction: |
| Sea Area D: |
| $V < 0$: $n = 0.0268$ ($\gamma_b^2 = 0.0026$)<br>$V > 0$: $n = 0.0368$ ($\gamma_b^2 = 0.0049$) |

TABLE 4

| |
|---|
| Initial conditions: |
| Water depth-averaged concentration of diffused materials in the whole water area of the bay:<br>C = 10.0 mg/liter |
| Open boundary conditions: |
| $V < 0$: C = 0.0 mg/liter<br>$V > 0$: Linear extrapolation (free outflow conditions) |

TABLE 5

| Conditions for computation: |
|---|
| Sea Area A: |
| V > 0: n = 0.0239 ($\gamma_b^2$ = 0.0026) |
| V < 0: n = 0.0328 ($\gamma_b^2$ = 0.0049) |
| Sea Area B: |
| V < 0: n = 0.0239 ($\gamma_b^2$ = 0.0026) |
| V > 0: n = 0.0328 ($\gamma_b^2$ = 0.0049) |

TABLE 6

| Conditions for computation: |
|---|
| (1) Common: |
| Water Depth: h = 20 meters = constant |
| Grid Size: Δx = Δy = 500 meters |
| (2) Tidal current simulation: |
| Increment of Time Step: Δt = 15 seconds |
| Eddy Viscosity: νt = 100.0 sq. meter/sec. |
| Coriolis Parameter: f = 0 1/sec. |
| (3) Diffusion simulation: |
| Diffusion coefficient: D = 1.0 sq. meter/sec. |
| Boundary conditions: |
| (1) Tidal simulation: |
| Open boundary (B'-C'): |
| Amplitude: a = 1.0 meter |
| Cycle: T = 12 hours 25 minutes |
| Open boundary (A'-B', C'-D'): |
| U = 0 |
| Wall surface boundary: |
| No-slip Conditions |
| (2) Diffusion simulation: |
| Open boundary: |
| Flood tide: C = 0.0 |
| Ebb tide: Linear extrapolation (free outflow conditions) |
| Wall surface boundary: |
| Conditions with no flux |

TABLE 7

| Conditions for Computation: |
|---|
| Sea Area A: |
| V > 0: n = 0.0239 ($\gamma_b^2$ = 0.0026) |
| V < 0: n = 0.0328 ($\gamma_b^2$ = 0.0049) |
| Sea Area B: |
| V < 0: n = 0.0239 ($\gamma_b^2$ = 0.0026) |
| V > 0: n = 0.0328 ($\gamma_b^2$ = 0.0049) |
| Sea Area C: |
| V > 0: n = 0.0239 ($\gamma_b^2$ = 0.0026) |
| V < 0: n = 0.0328 ($\gamma_b^2$ = 0.0049) |

TABLE 8

VALUES OF Vmax, Vres & EX

| Conditions | Vmax ($10^6$ $m^3$) | Vres ($10^6$ $m^3$) | EX (%) |
|---|---|---|---|
| 0 | 103.1 | 13.9 | 13.5 |
| 1 | 103.0 | 14.7 | 14.3 |
| 2 | 103.4 | 19.1 | 18.5 |
| 3 | 103.2 | 19.2 | 18.6 |
| 4 | 103.2 | 26.1 | 25.3 |

TABLE 9

| Condition | Reynolds' Number | Relative Water Depth h/k | Roughness Member No. |
|---|---|---|---|
| 1 | $6 \times 10^4$ | 4,5,6 | 1–8 |
| 1–82 | $7 \times 10^4$ | 4,5,6 | 1–8 |
| 3 | $8 \times 10^4$ | 4,5,6 | 1,3–5,7,8 |

TABLE 10

| Roughness No. | Roughness Height | Roughness Radius | Thickness | Roughness Width | Angle | Distance |
|---|---|---|---|---|---|---|
| 1 | k = 5 | | t1 = 0.2 | b = 10 | θ1 = 90°<br>θ2 = 180° | |
| 2 | k = 5 | | t1 = 0.1 | b1 = 11.5<br>b2 = 9<br>b3 = 5 | | |
| 3 | | 2r = 7.5 | t1 = 0.1 | | | |
| 4 | k = 5 | r1 = 7.5<br>r2 = 4.5<br>r3 = 2.5 | t1 = 0.3 | | | 11 = 7.5<br>12 = 7.5 |
| 5 | k1 = 5<br>k2 = 4 | r1 = 7.5<br>r2 = 4.5 | t1 = 0.3 | | | 11 = 7. 5 |
| 6 | k = 5 | | t1 = 0.3 | b = 20 | | |
| 7 | k1 = 3<br>k2 = 2 | | t1 = 0.2 | b1 = 9<br>b2 = 11 | θ3 = 132° | |
| 8 | k1 = 3<br>k2 = 2 | | t1 = 0.3 | b1 = 9<br>b2 = 1 | θ3 = 132° | |

(Unit: mm)

What is claimed is:

1. A method for developing a residual tidal current in a partially closed sea area having an opening communicating with a sea, a rear bay area at an opposite side from said opening, a front bay area proximate said opening, and first and second side bay areas, wherein the partially closed sea area lacks inflow of a substantial amount of fresh water from outside the partially closed sea area to exchange for water existing therein, the method for developing the residual tidal current comprising the steps of:

providing a plurality of bottom structure members each having a forward current side and a rearward current side, said forward current side having a configuration providing a forward current roughness for providing resistance to a current flow striking said forward current side, said rearward current side having a configuration providing a rearward current roughness for providing resistance to a rearward current flow striking said rearward current side, said rearward current roughness providing greater resistance than said forward current roughness so as to produce a net directional flow in a net flow direction extending from said forward current side toward said rearward current side over a tidal oscillation cycle;

defining a first bottom area at one of said first and second side bay areas;

defining a second bottom area at another one of said first and second side bay areas;

disposing a first group of said plurality of bottom structure members on said first bottom area with said net flow direction oriented to substantially oppose an ebbing tide direction of said tidal oscillation cycle;

disposing a second group of said plurality of bottom structure members on said first bottom area with said net flow direction oriented to substantially oppose a rising tide direction of said tidal oscillation cycle; and whereby said first and second groups interact with tidal current to produce the residual tidal current in a form of a circulating flow within said partially closed sea area due to the first group providing greater resistance against the ebbing tide than against the rising tide, and the second group providing greater resistance against the rising tide than against the ebbing tide, the circulating flow thereby promoting exchange of sea water via said opening.

2. The method as claimed in claim 1, further comprising the step of disposing a third group of said bottom structure members on another sea bottom area of said partially closed sea area with said net flow direction oriented substantially orthogonally to said ebbing tide direction and said rising tide direction so as to form the residual tidal current into a curved flow pattern.

3. The method as claimed in claim 2, further comprising the step of configuring at least some of said bottom structure members so as to provide a tide sheltered volume which functions as a fish-gathering place.

4. The method as claimed in claim 1, further comprising the steps of disposing a third group of said bottom structure members on a third sea bottom area in said rear bay area of said partially closed sea area and orienting said net flow direction of said third group substantially orthogonally to said ebbing tide direction and said rising tide direction so as to form the residual tidal current into a curved flow pattern.

5. A method for developing a residual tidal current in a partially closed sea area having an opening communicating with a sea, a rear bay area at an opposite side from said opening, a front bay area proximate said opening, and first and second side bay areas, wherein the partially closed sea area lacks inflow of a substantial amount of fresh water from outside the partially closed sea area to exchange for water existing therein, the method for developing the residual tidal current comprising the steps of:

providing a plurality of bottom structure members each having a forward current side, a rearward current side, and a current momentum directing surface configuration providing a forward current roughness for providing resistance to a current flow striking said forward current side first which is greater than resistance to a rearward current flow striking said rearward current side first so as to produce a net directional flow in a net flow direction extending from said forward current side toward said rearward current side over a tidal oscillation cycle;

defining a first bottom area at one of said first and second side bay areas;

defining a second bottom area at another one of said first and second side bay areas;

disposing a first group of said plurality of bottom structure members on said first bottom area with said net flow direction oriented to substantially oppose an ebbing tide direction of said tidal oscillation cycle;

disposing a second group of said plurality of bottom structure members on said first bottom area with said net flow direction oriented to substantially oppose a rising tide direction of said tidal oscillation cycle; and whereby said first and second groups interact with tidal current to produce the residual tidal current in a form of a circulating flow within said partially closed sea area due to the first group providing greater resistance against the ebbing tide than against the rising tide, and the second group providing greater resistance against the rising tide than against the ebbing tide, the circulating flow thereby promoting exchange of sea water via said opening.

6. The method as claimed in claim 5, further comprising the steps of disposing a third group of said bottom structure members on a third sea bottom area in said rear bay area of said partially closed sea area and orienting said net flow direction of said third group substantially orthogonally to said ebbing tide direction and said rising tide direction so as to form the residual tidal current into a curved flow pattern.

* * * * *